US011847956B2

(12) United States Patent
In

(10) Patent No.: US 11,847,956 B2
(45) Date of Patent: Dec. 19, 2023

(54) SCAN DRIVER

(71) Applicant: Samsung Display Co., Ltd., Yongin-Si (KR)

(72) Inventor: Hai Jung In, Yongin-si (KR)

(73) Assignee: Samsung Display Co., Ltd., Yongin-Si (KR)

( * ) Notice: Subject to any disclaimer, the term of this patent is extended or adjusted under 35 U.S.C. 154(b) by 0 days.

(21) Appl. No.: 18/084,224

(22) Filed: Dec. 19, 2022

(65) Prior Publication Data

US 2023/0274687 A1 Aug. 31, 2023

(30) Foreign Application Priority Data

Feb. 25, 2022 (KR) ..... 10-2022-0025477

(51) Int. Cl.
*G09G 3/20* (2006.01)

(52) U.S. Cl.
CPC ... *G09G 3/2096* (2013.01); *G09G 2310/0267* (2013.01); *G09G 2310/08* (2013.01); *G09G 2330/021* (2013.01)

(58) Field of Classification Search
CPC ..... G09G 3/2096; G09G 2310/0267; G09G 2310/08; G09G 2330/021
See application file for complete search history.

(56) References Cited

U.S. PATENT DOCUMENTS

| | | | | |
|---|---|---|---|---|
| 10,431,159 | B2 | 10/2019 | Fujimura | |
| 10,923,064 | B2 | 2/2021 | Takeuchi et al. | |
| 11,138,940 | B2 | 10/2021 | Han et al. | |
| 11,222,596 | B2 | 1/2022 | Kim | |
| 2012/0038609 | A1* | 2/2012 | Chung | G09G 3/3266 345/211 |

FOREIGN PATENT DOCUMENTS

| | | | |
|---|---|---|---|
| KR | 1870519 | B1 | 6/2018 |
| KR | 10-2021-0028774 | A | 3/2021 |
| KR | 10-2021-0080960 | A | 7/2021 |
| KR | 10-2021-0089296 | A | 7/2021 |

* cited by examiner

*Primary Examiner* — Gerald Johnson

(57) ABSTRACT

A scan driver is disclosed that includes a plurality of stages for supplying scan signals to scan lines. A first stage among the stages includes: a first sub-stage circuit for generating a first scan signal, based on an input signal, a first clock signal, a second clock signal, a first power source, and a second power source; and a first charge pump circuit for supplying a bias voltage to the first sub-stage circuit, based on a third power source. The first sub-stage circuit includes: a first driver for controlling voltages of a first node and a second node, based on the input signal, the first clock signal, the second clock signal, the first power source, and the second power source; a second driver for controlling a voltage of an output node, based on the voltage of the first node, the voltage of the second node, the first power source, and the second power source; and an output unit for outputting the first scan signal through a first output terminal, based on the voltage of the output node, the first power source, and the second power source.

20 Claims, 31 Drawing Sheets

FIG. 16A

<First Mode>

BVGL L

FIG. 16B

<Second Mode>

BVGL H

T1_1: T1a, T1b
T14_1: T14a, T14b

SCAN DRIVER

CROSS-REFERENCE TO RELATED APPLICATION

The present application claims priority under 35 U.S.C. § 119(a) to Korean patent application No. 10-2022-0025477 filed on Feb. 25, 2022, in the Korean Intellectual Property Office, the entire disclosure of which is incorporated herein by reference.

BACKGROUND

1. Technical Field

The present disclosure generally relates to a scan driver.

2. Related Art

A display device includes a data driver for supplying a data signal to data lines, a scan driver for supplying a scan signal to scan lines, an emission driver for supplying an emission control signal to emission control lines, and pixels located to be connected to the data lines, the scan lines, and the emission control lines.

The scan driver includes a stage for generating a scan signal. The stage may include a plurality of transistors and a plurality of capacitors, and generate an output signal obtained by shifting an input signal, based on a plurality of clock signals.

SUMMARY

Embodiments may provide a scan driver capable of reducing power consumption.

According to an embodiment, there is provided a scan driver including: a plurality of stages configured to supply scan signals to scan lines, wherein a first stage among the stages includes: a first sub-stage circuit configured to generate a first scan signal, based on an input signal, a first clock signal, a second clock signal, a first power source, and a second power source; and a first charge pump circuit configured to supply a bias voltage to the first sub-stage circuit, based on a third power source, and wherein the first sub-stage circuit includes: a first driver configured to control voltages of a first node and a second node, based on the input signal, the first clock signal, the second clock signal, the first power source, and the second power source; a second driver configured to control a voltage of an output node, based on the voltage of the first node, the voltage of the second node, the first power source, and the second power source; and an output unit configured to output the first scan signal through a first output terminal, based on the voltage of the output node, the first power source, and the second power source.

In an embodiment, the output unit may include an n-type transistor and a p-type transistor. The first charge pump circuit may supply the bias voltage to a back-gate electrode of the n-type transistor included in the output unit.

In an embodiment, a voltage level of the third power source may be lower than a voltage level of the first power source and be higher than a voltage level of the second power source. A voltage level of the bias voltage may be lower than the voltage level of the second power source.

In an embodiment, the first driver may include: a first transistor connected between a first input terminal to which the input signal is supplied and an input node, the first transistor including a gate electrode connected to a second input terminal to which the first clock signal is supplied; a second transistor including a first electrode connected to a first power input terminal to which a voltage of the first power source is supplied and a gate electrode connected to the second node; a third transistor connected between a second electrode of the second transistor and the input node, the third transistor including a gate electrode connected to a third input terminal to which the second clock signal is supplied; a fourth transistor connected between the second node and the second input terminal, the fourth transistor including a gate electrode connected to the input node; a fifth transistor connected between the second node and a second power input terminal to which a voltage of the second power source is supplied, the fifth transistor including a gate electrode connected to the second input terminal; and a sixth transistor connected between the input node and the first node, the sixth transistor including a gate electrode connected to the second power input terminal.

In an embodiment, the first driver may further include a first capacitor connected between the first power input terminal and the second node.

In an embodiment, the second driver may include: a seventh transistor connected between a first power input terminal to which a voltage of the first power source is supplied and the output node, the seventh transistor including a gate electrode connected to the second node; and an eighth transistor connected between the output node and a third input terminal to which the second clock signal is supplied, the eighth transistor including a gate electrode connected to the first node.

In an embodiment, the second driver may further include a second capacitor connected between the output node and the first node.

In an embodiment, the output unit may include: a ninth transistor connected between a first power input terminal to which a voltage of the first power source is supplied and the first output terminal, the ninth transistor including a gate electrode connected to the output node; and a tenth transistor connected between the first output terminal and a second power input terminal to which a voltage of the second power source is supplied, the tenth transistor including a gate electrode connected to the output node.

In an embodiment, the ninth transistor may be a p-type transistor, and the tenth transistor may be an n-type transistor.

In an embodiment, the first charge pump circuit may include: an eleventh transistor connected between a third power input terminal to which a voltage of the third power source is supplied and a third node, the eleventh transistor including a gate electrode connected to the third power input terminal; a twelfth transistor including a first electrode connected to a third input terminal to which the second clock signal is supplied and a gate electrode connected to the third node; a third capacitor connected between a second electrode of the twelfth transistor and the third node; a fourth capacitor including a first electrode connected to any one of a first power input terminal to which a voltage of the first power source is supplied, a second power input terminal to which a voltage of the second power source is supplied, and the third power input terminal; and a thirteenth transistor connected between a second electrode of the fourth capacitor and the third node, the thirteenth transistor including a gate electrode connected to the third node.

In an embodiment, the first charge pump circuit may include: a fourteenth transistor including a first electrode connected to a third power input terminal to which a voltage of the third power source is supplied and a gate electrode connected to a second input terminal to which the first clock signal is supplied; an eleventh transistor connected between a second electrode of the fourteenth transistor and a third node, the eleventh transistor including a gate electrode connected to a second power input terminal to which a voltage of the second power source is supplied; a twelfth transistor including a first electrode connected to a third input terminal to which the second clock signal is supplied and a gate electrode connected to the third node; and a third capacitor connected between a second electrode of the twelfth transistor and the third node.

In an embodiment, the first charge pump circuit may further include: a fourth capacitor including a first electrode connected to any one of a first power input terminal to which a voltage of the first power source is supplied, the second power input terminal, and the third power input terminal; and a thirteenth transistor connected between a second electrode of the fourth capacitor and the third node, the thirteenth transistor including a gate electrode connected to the third node.

In an embodiment, the bias voltage may correspond to a voltage of a node to which the second electrode of the fourth capacitor is connected.

In an embodiment, the first charge pump circuit may further include: a fourth capacitor including a first electrode connected to any one of a first power input terminal to which a voltage of the first power source is supplied, the second power input terminal, and the third power input terminal; a thirteenth transistor including a first electrode connected to a second electrode of the fourth transistor, a second electrode, and a gate electrode; and a fifteenth transistor connected between a node to which the second electrode and the gate electrode of the thirteenth transistor are connected and the third node, the fifteenth transistor including a gate electrode connected to the third node.

According to an embodiment, there is provided a scan driver including a plurality of sub-stage circuits configured to supply scan signals to scan lines and a plurality of charge pump circuits configured to generate a bias voltage, wherein each of the sub-stage circuits includes: a first driver configured to control voltages of a first node and a second node, based on an input signal, a first clock signal, a second clock signal, a first power source, and a second power source; a second driver configured to control a voltage of an output node, based on the voltage of the first node, the voltage of the second node, the first power source, and the second power source; and an output unit configured to output a scan signal through an output terminal, based on the voltage of the output node, the first power source, and the second power source, and wherein a first sub-stage circuit configured to generate a first scan signal as the scan signal and a second sub-stage circuit configured to generate a second scan signal as the scan signal among the sub-stage circuits are commonly connected to a first charge pump circuit among the charge pump circuits.

In an embodiment, the first charge pump circuit may supply the bias voltage to each of the output unit included in the first sub-stage circuit and the output unit included in the second sub-stage circuit.

According to an embodiment, there is provided a scan driver including a plurality of stages configured to supply first sub-scan signals to first sub-scan lines, and supply second sub-scan signal to second sub-scan lines, wherein a first stage among the stages includes: a first sub-stage circuit configured to generate a (1-1)th sub-scan signal and a (2-1)th sub-scan signal, based on an input signal, a first clock signal, a second clock signal, a fourth clock signal, a first power source, and a second power source; and a first charge pump circuit configured to supply a bias voltage to the first sub-stage circuit, based on a third power source, wherein the first sub-stage circuit includes: a first driver configured to control voltages of a first node and a second node, based on the input signal, the first clock signal, the second clock signal, the first power source, and the second power source; a second driver configured to control a voltage of an output node, based on the voltage of the first node, the voltage of the second node, the first power source, and the fourth clock signal; a first sub-output unit configured to output the (1-1)th sub-scan signal through a (1-1)th sub-output terminal, based on the voltage of the output node, the first power source, and the second power source; and a second sub-output unit configured to output the (2-1)th sub-scan signal through a (2-1)th sub-output terminal, based on the voltage of the first node, the voltage of the second node, the first power source, and the second clock signal, and wherein the (1-1)th sub-scan signal has a pulse of a high level, and the (2-1)th sub-scan signal has a pulse of a low level.

In an embodiment, the first sub-output unit may include: a ninth transistor connected between a first power input terminal to which a voltage of the first power source is supplied and the (1-1)th sub-output terminal, the ninth transistor including a gate electrode connected to the output node; and a tenth transistor connected between the (1-1)th sub-output terminal and a fifth input terminal to which the fourth clock signal is supplied, the tenth transistor including a gate electrode connected to the output node. The ninth transistor may be a p-type transistor, and the tenth transistor may be an n-type transistor.

In an embodiment, the second sub-output unit may include: a sixteenth transistor connected between the first power input terminal and the (2-1)th sub-output terminal, the sixteenth transistor including a gate electrode connected to the second node; and a seventeenth transistor connected between a third input terminal to which the second clock signal is supplied and the (2-1)th sub-output terminal, the seventeenth transistor including a gate electrode connected to the first node.

In an embodiment, the first stage among the stages may receive the fourth clock signal, and a second stage among the stages may receive a third clock signal. The fourth clock signal may be a signal shifted from the third clock signal.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

As used herein, the word "or" means logical "or" so, unless the context indicates otherwise, the expression "A, B, or C" means "A and B and C," "A and B but not C," "A and C but not B," "B and C but not A," "A but not B and not C," "B but not A and not C," and "C but not A and not B."

Figure 1:
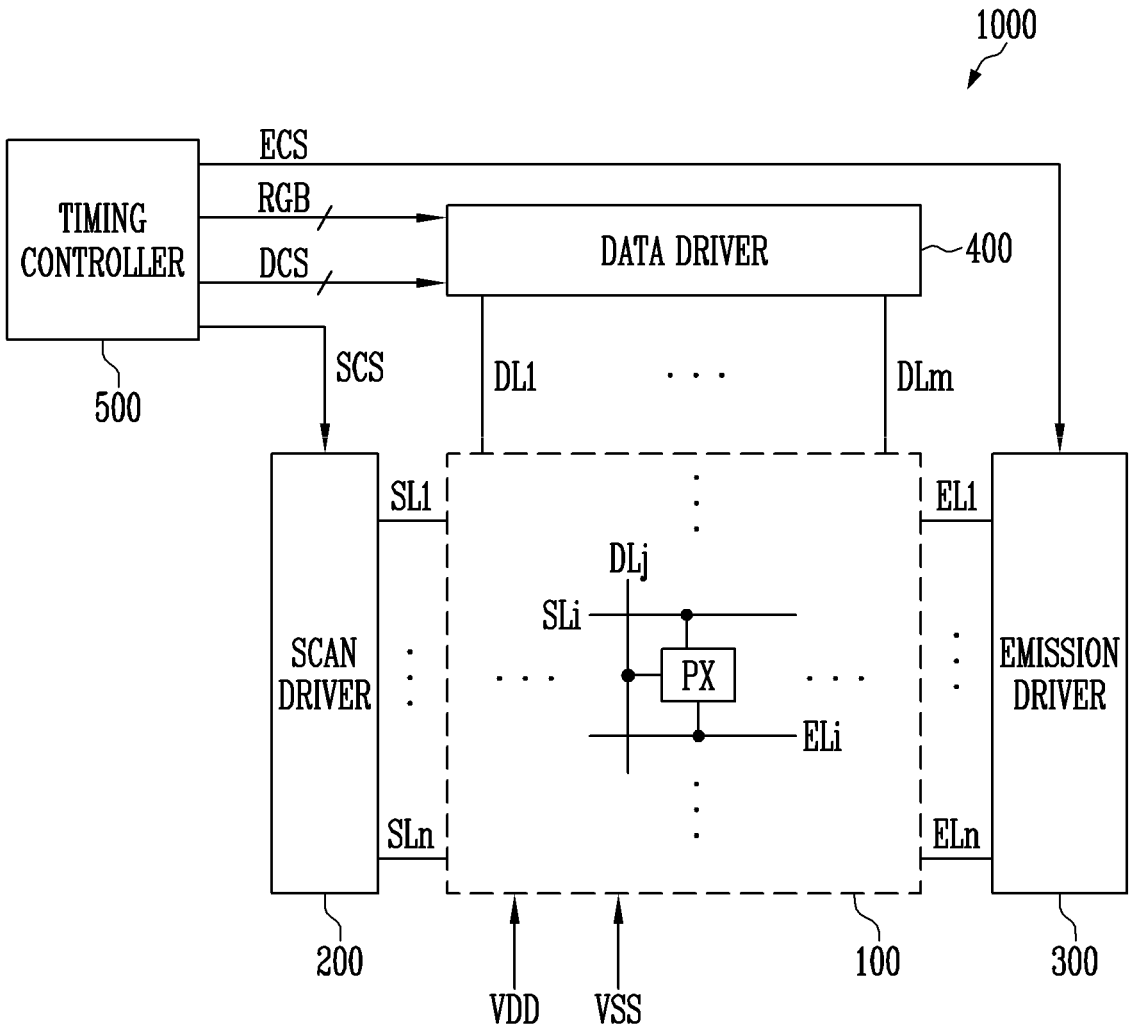

FIG. 1 is a block diagram illustrating a display device in accordance with embodiments of the present disclosure.

Figure 2:
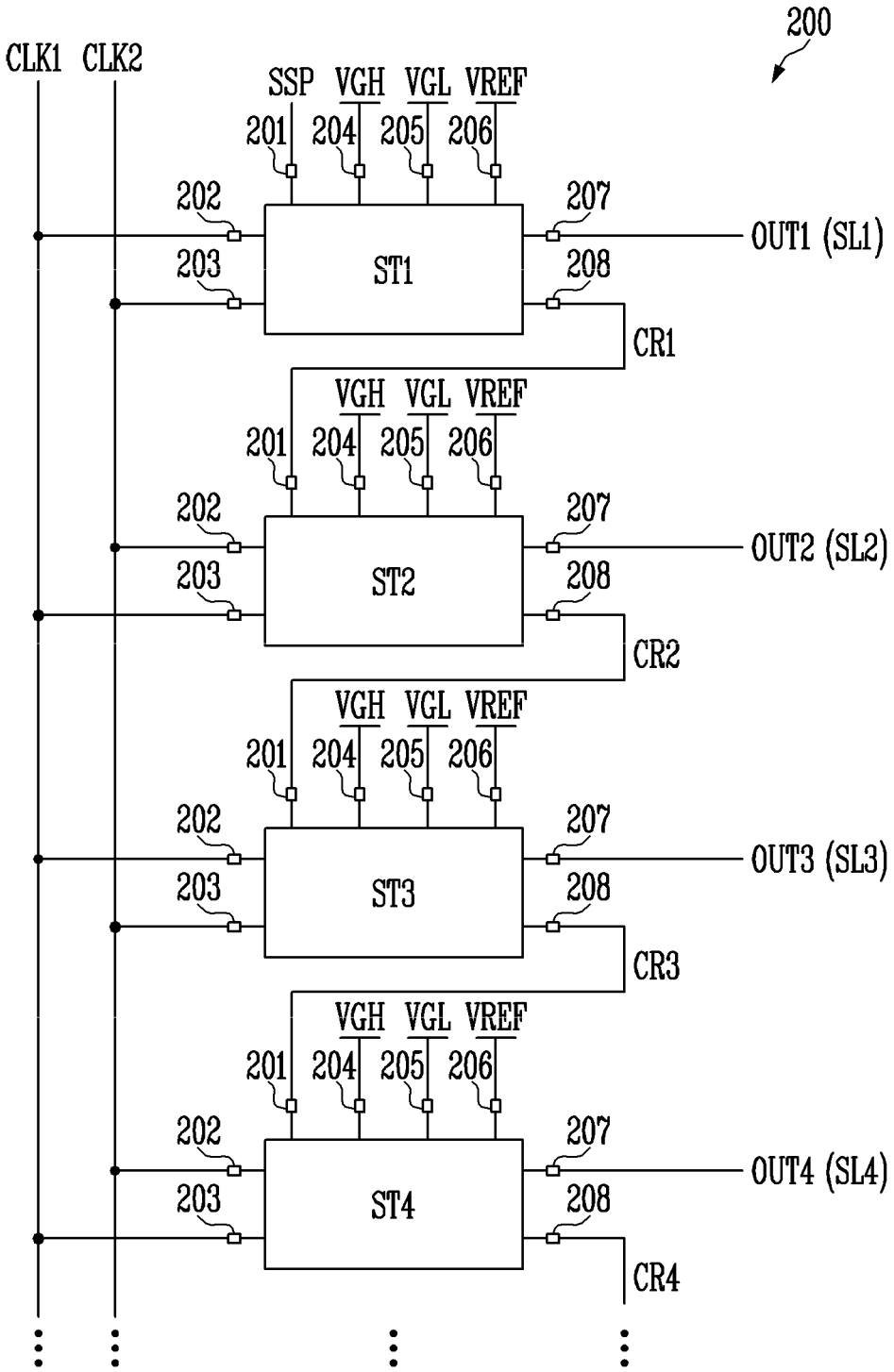

FIG. 2 is a block diagram illustrating a scan driver (gate driver) in accordance with embodiments of the present disclosure.

Figure 3:
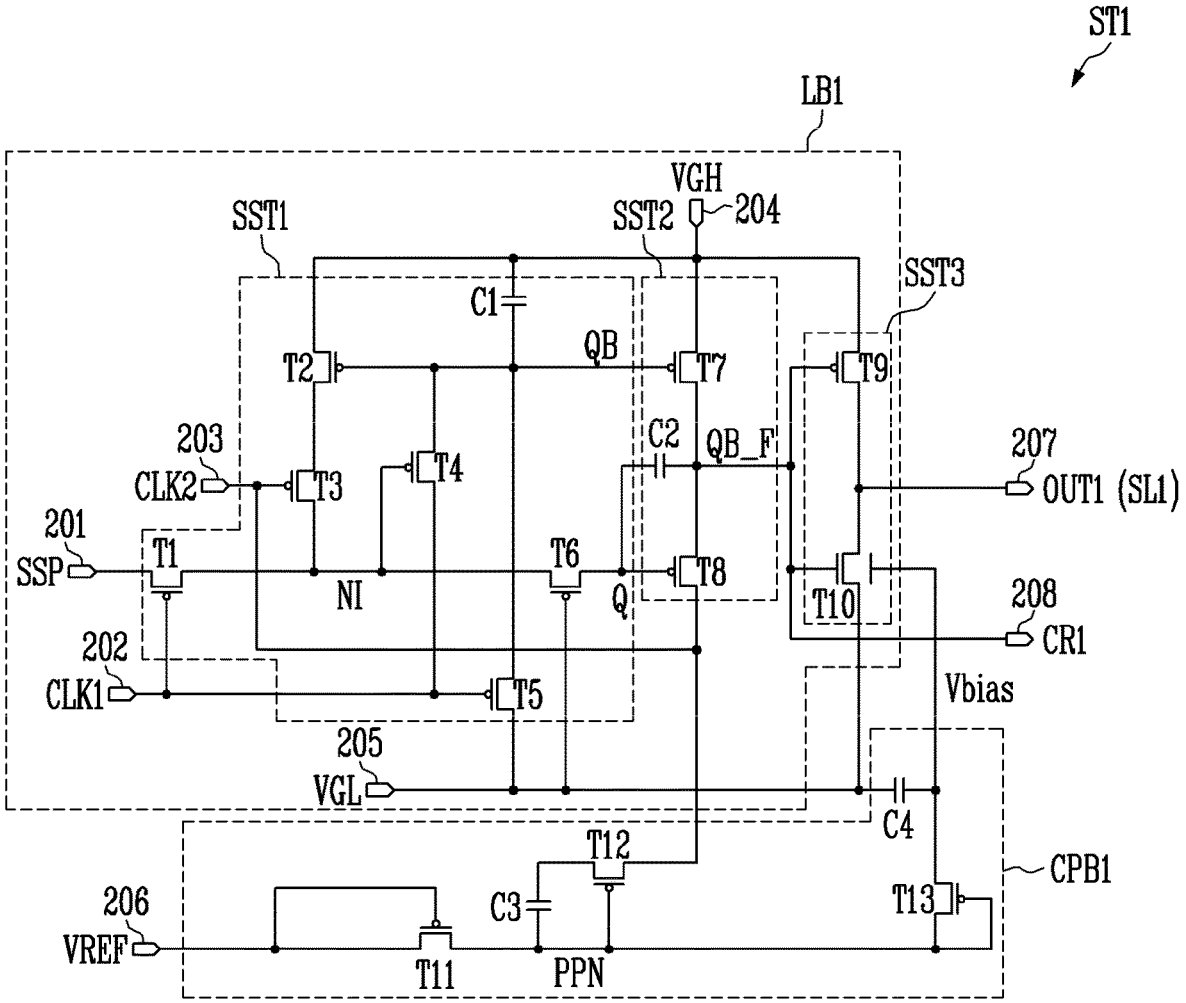

FIG. 3 is a circuit diagram illustrating an example of a first stage included in the scan driver shown in FIG. 2.

Figure 4:
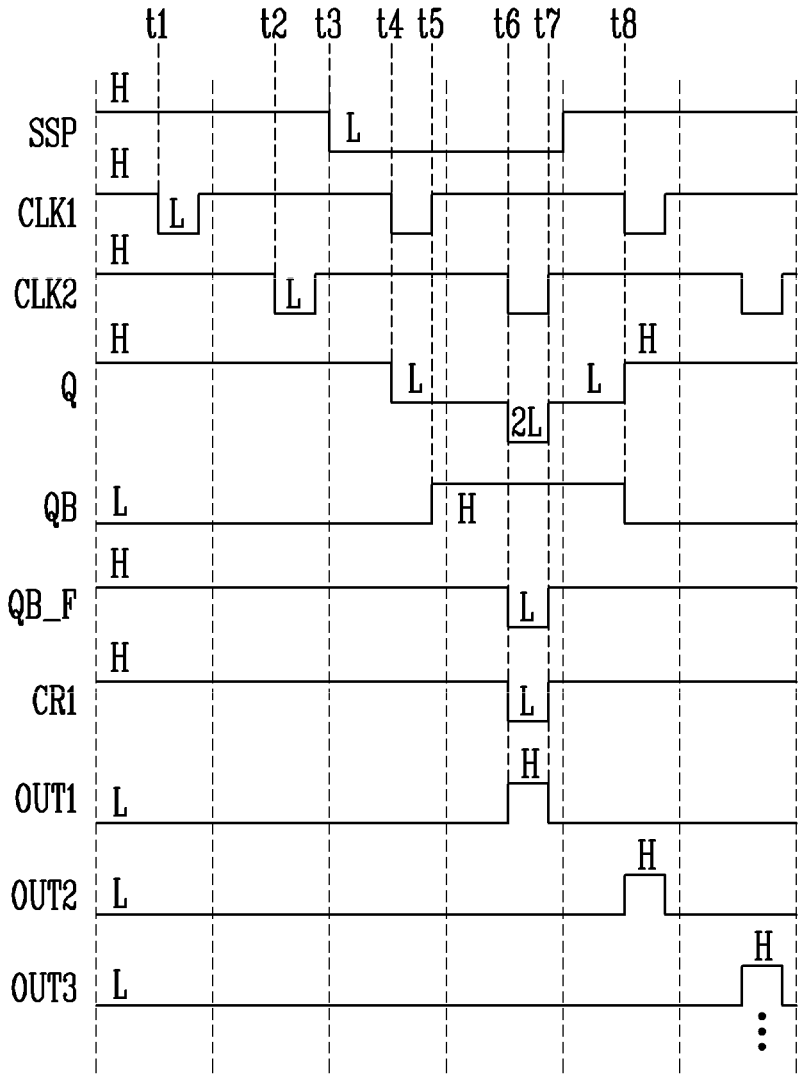

FIG. 4 is a timing diagram illustrating an example of driving of the first stage shown in FIG. 3.

Figure 5:
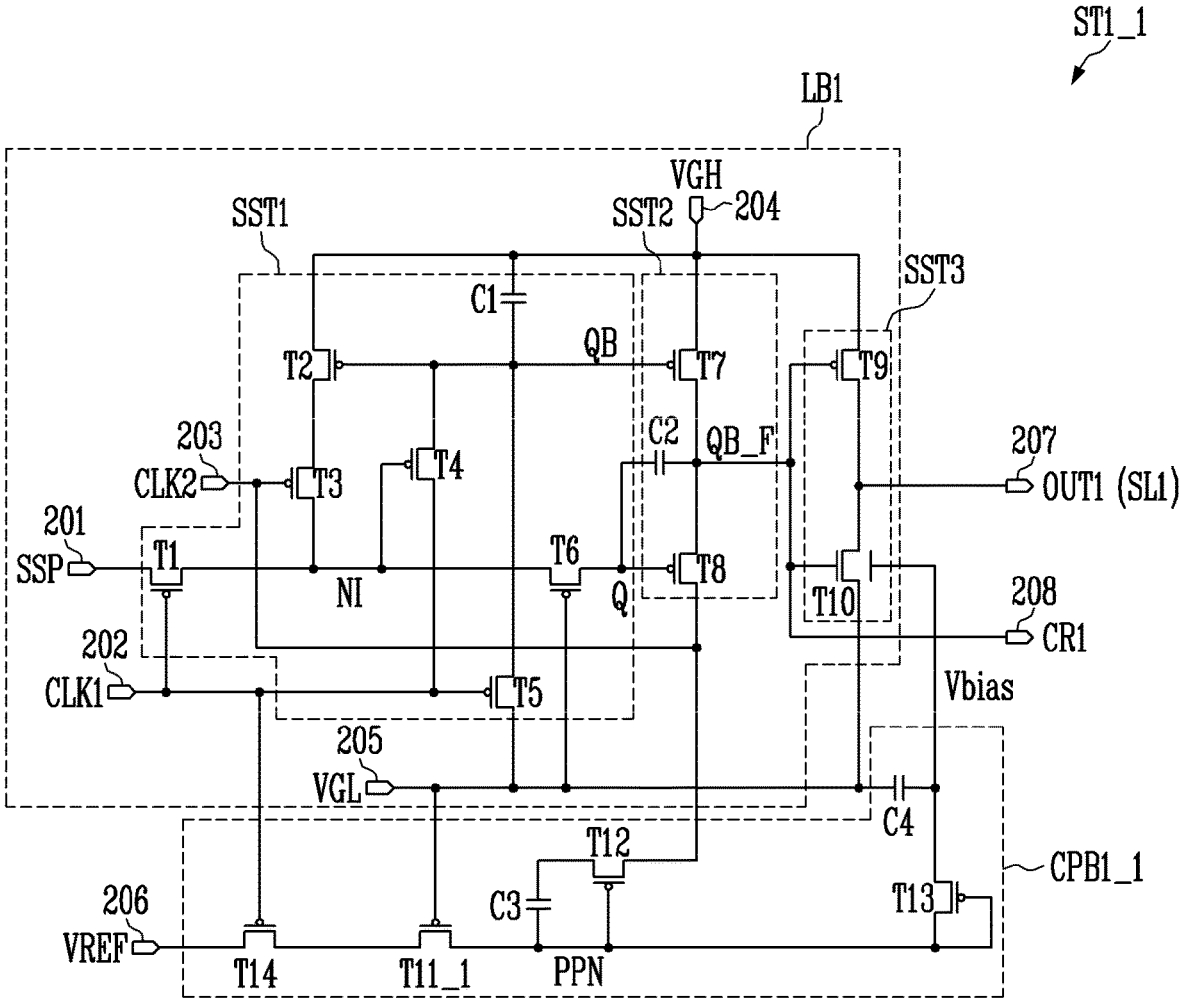

FIG. 5 is a circuit diagram illustrating an example of the first stage included in the scan driver shown in FIG. 2.

Figure 6:
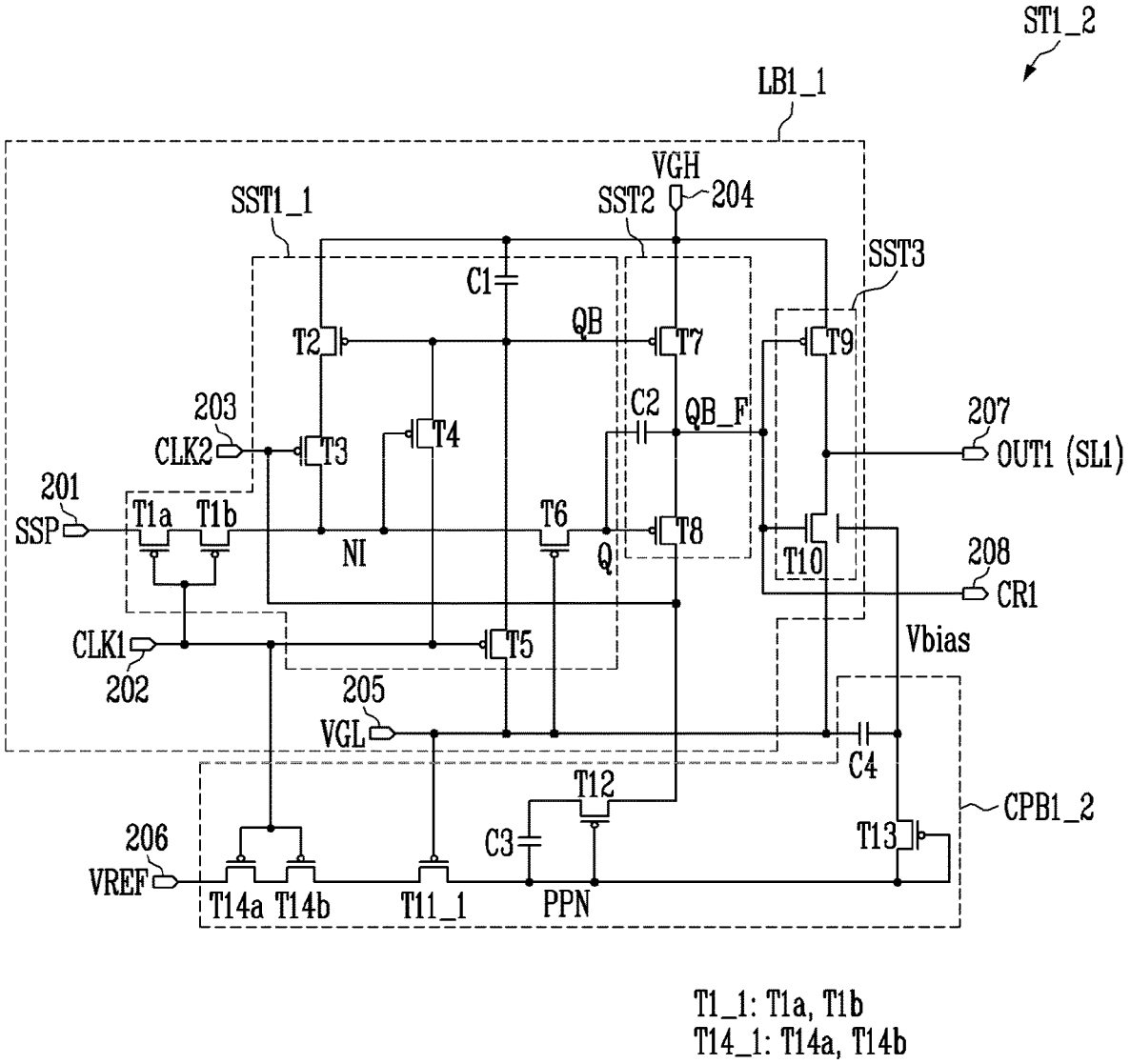

FIG. 6 is a circuit diagram illustrating an example of the first stage included in the scan driver shown in FIG. 2.

Figure 7:
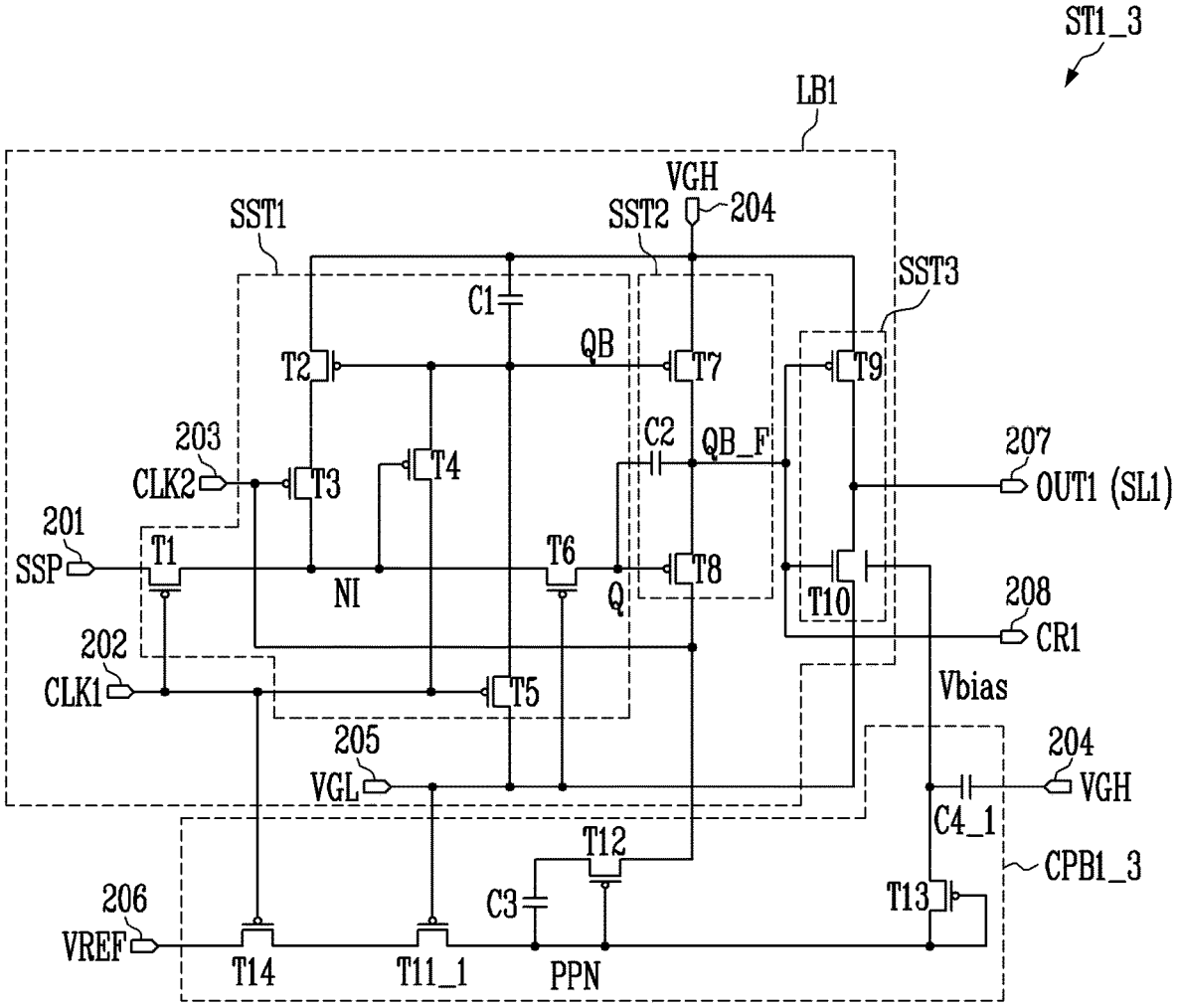

FIG. 7 is a circuit diagram illustrating an example of the first stage included in the scan driver shown in FIG. 2.

Figure 8:
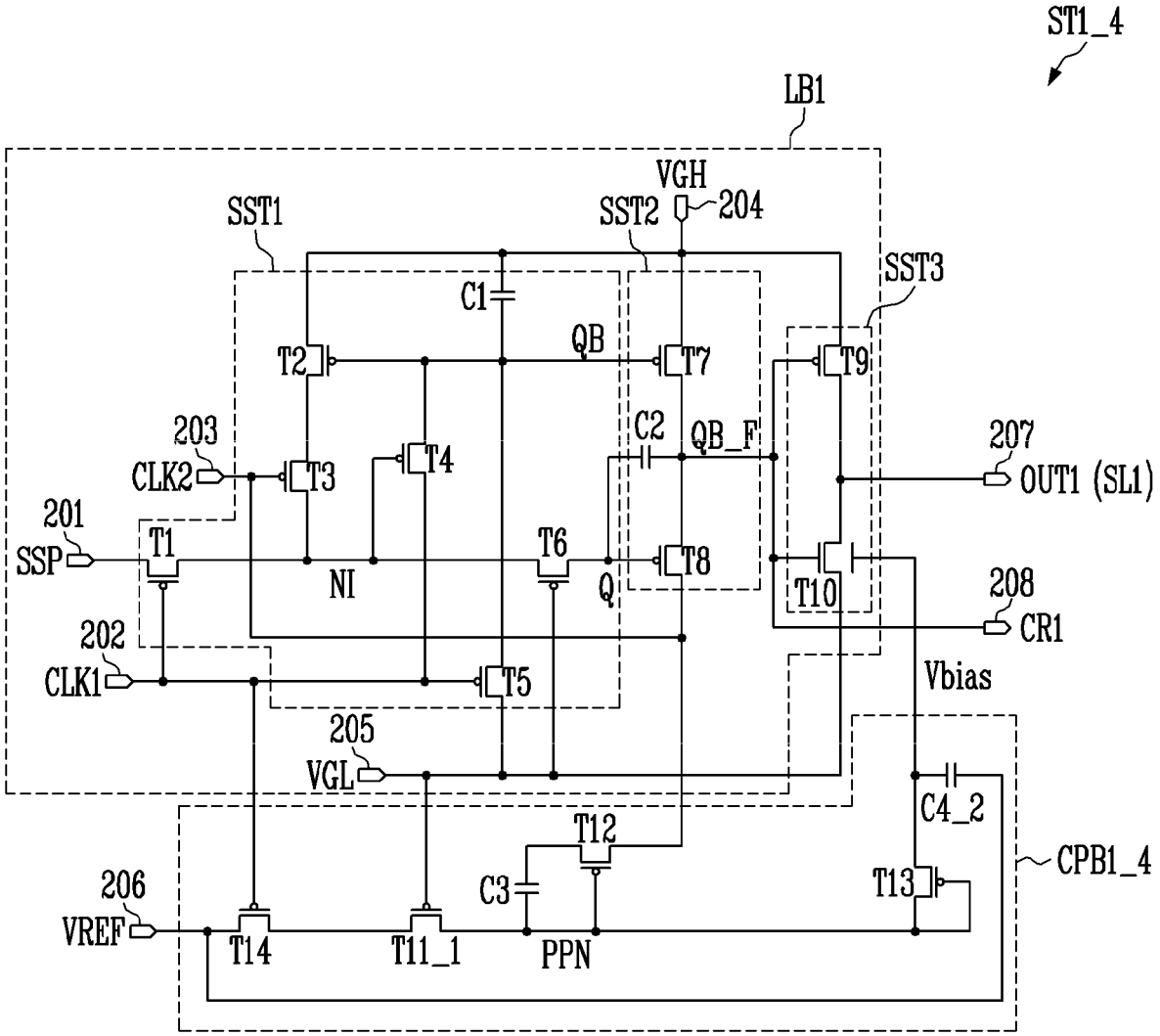

FIG. 8 is a circuit diagram illustrating an example of the first stage included in the scan driver shown in FIG. 2.

Figure 9:
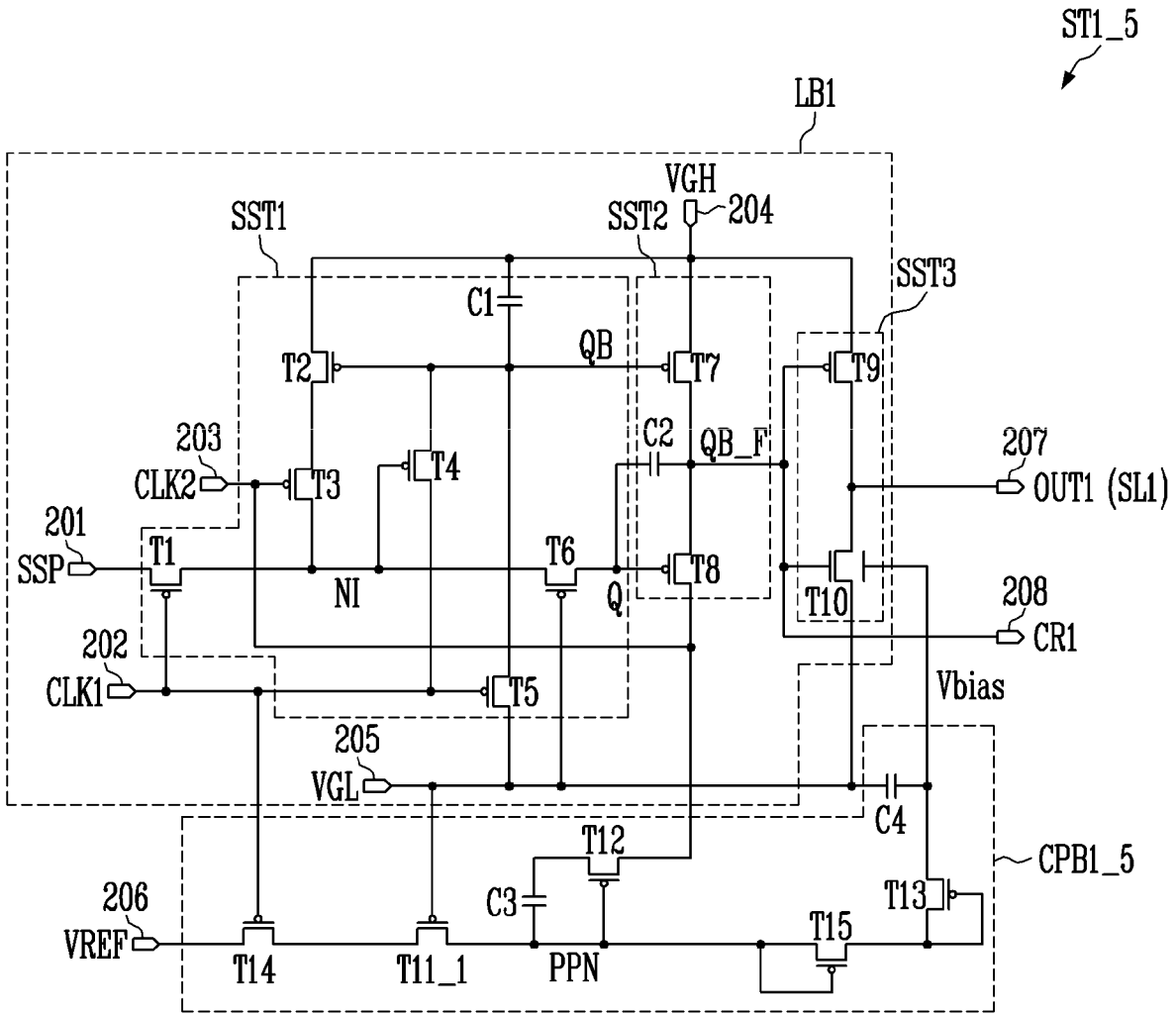

FIG. 9 is a circuit diagram illustrating an example of the first stage included in the scan driver shown in FIG. 2.

Figure 10:
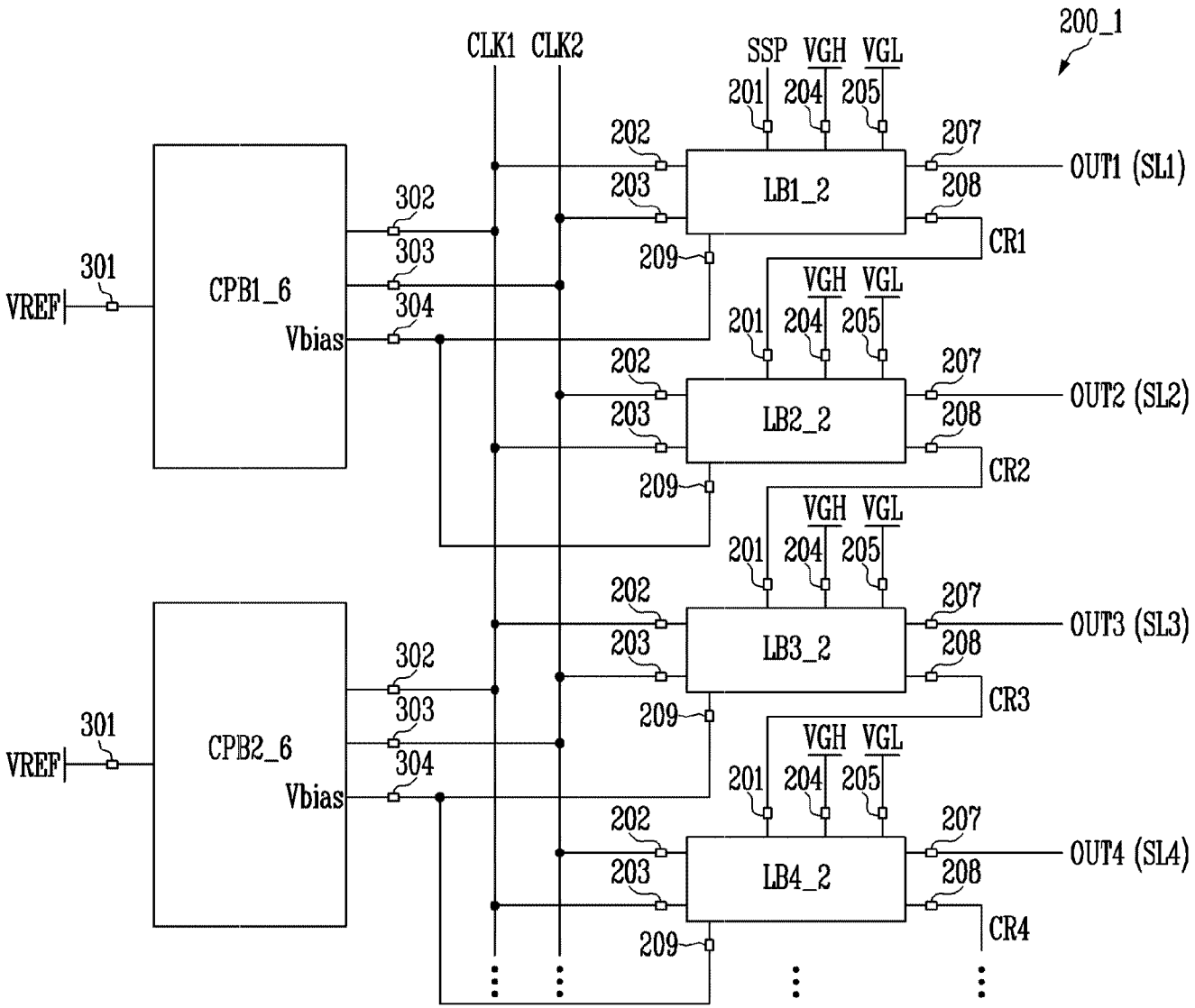

FIG. 10 is a block diagram illustrating a scan driver (gate driver) in accordance with embodiments of the present disclosure.

Figure 11:
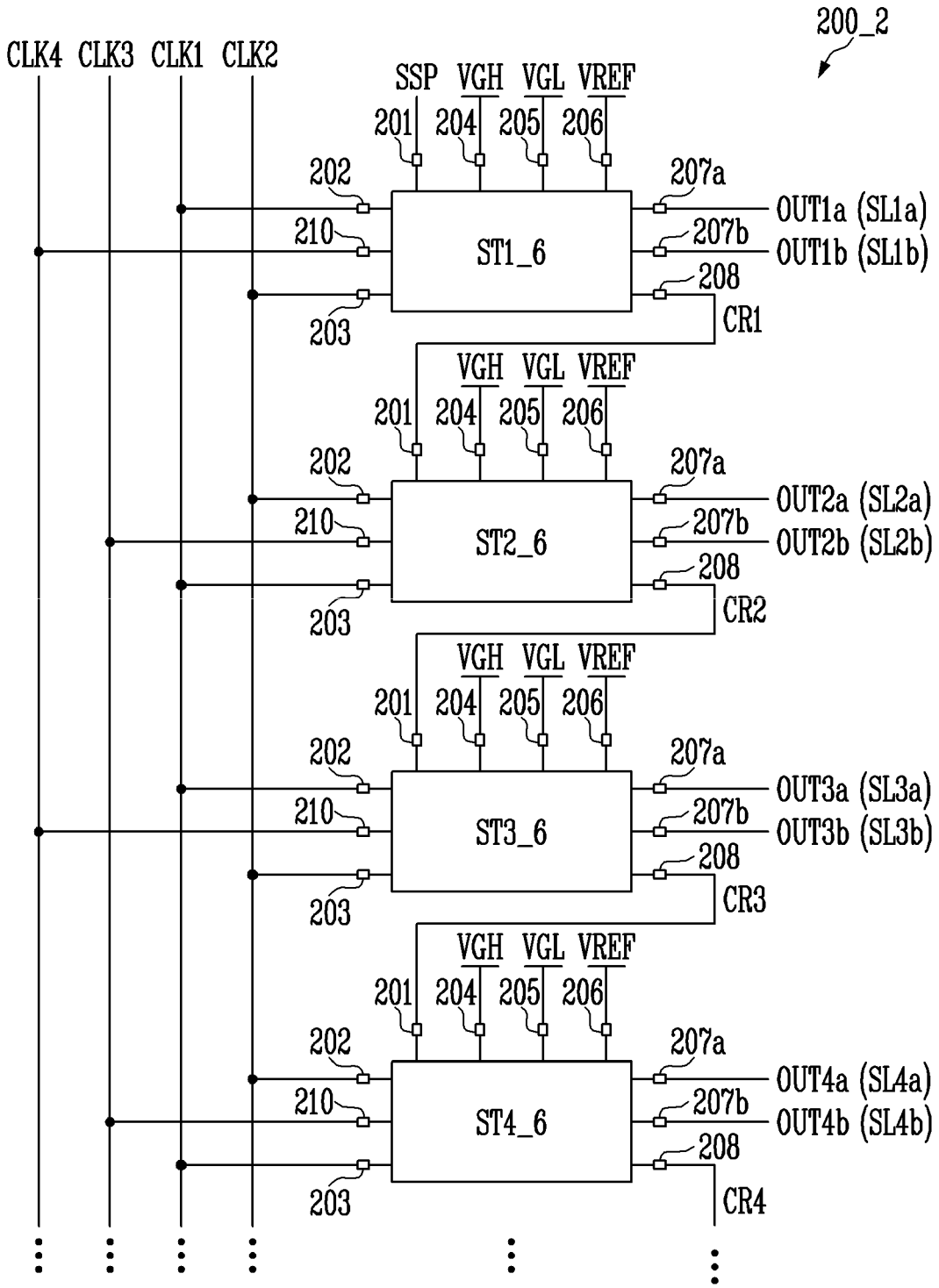

FIG. 11 is a block diagram illustrating a scan driver (gate driver) in accordance with embodiments of the present disclosure.

Figure 12:
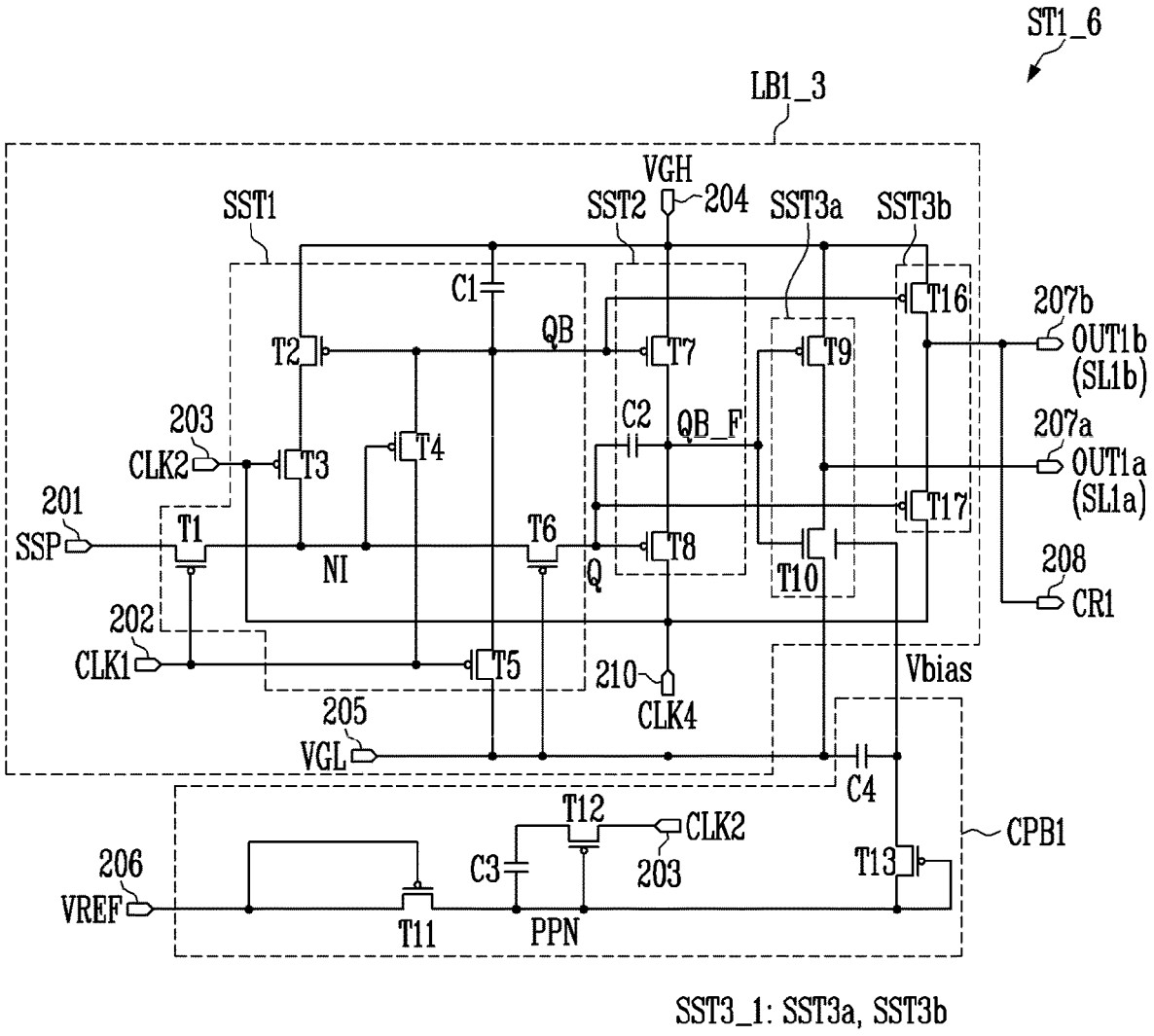

FIG. 12 is a circuit diagram illustrating an example of a first stage included in the scan driver shown in FIG. 11.

Figure 13:
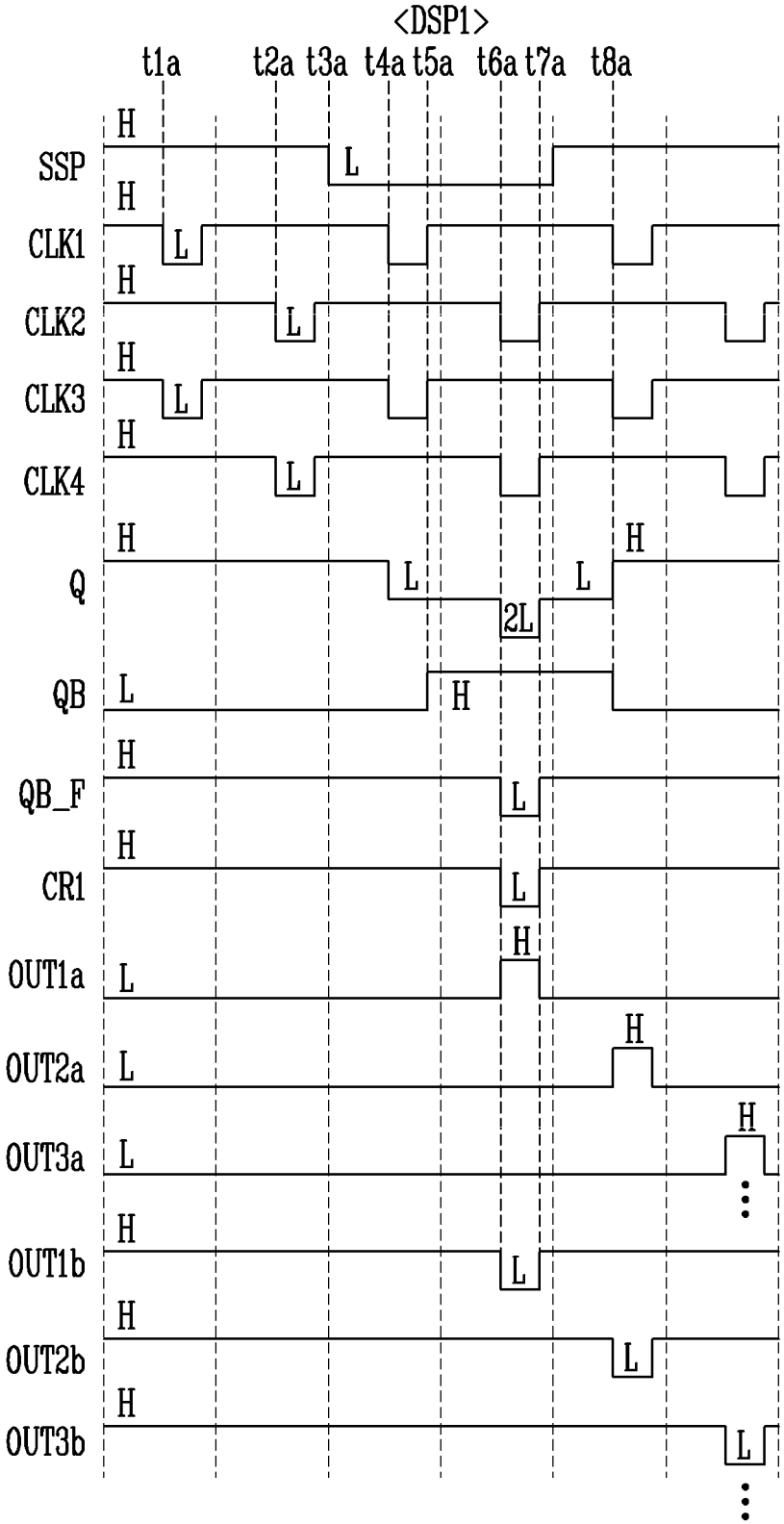

FIG. 13 is a timing diagram illustrating an example of driving of the first stage shown in FIG. 12.

Figure 14:
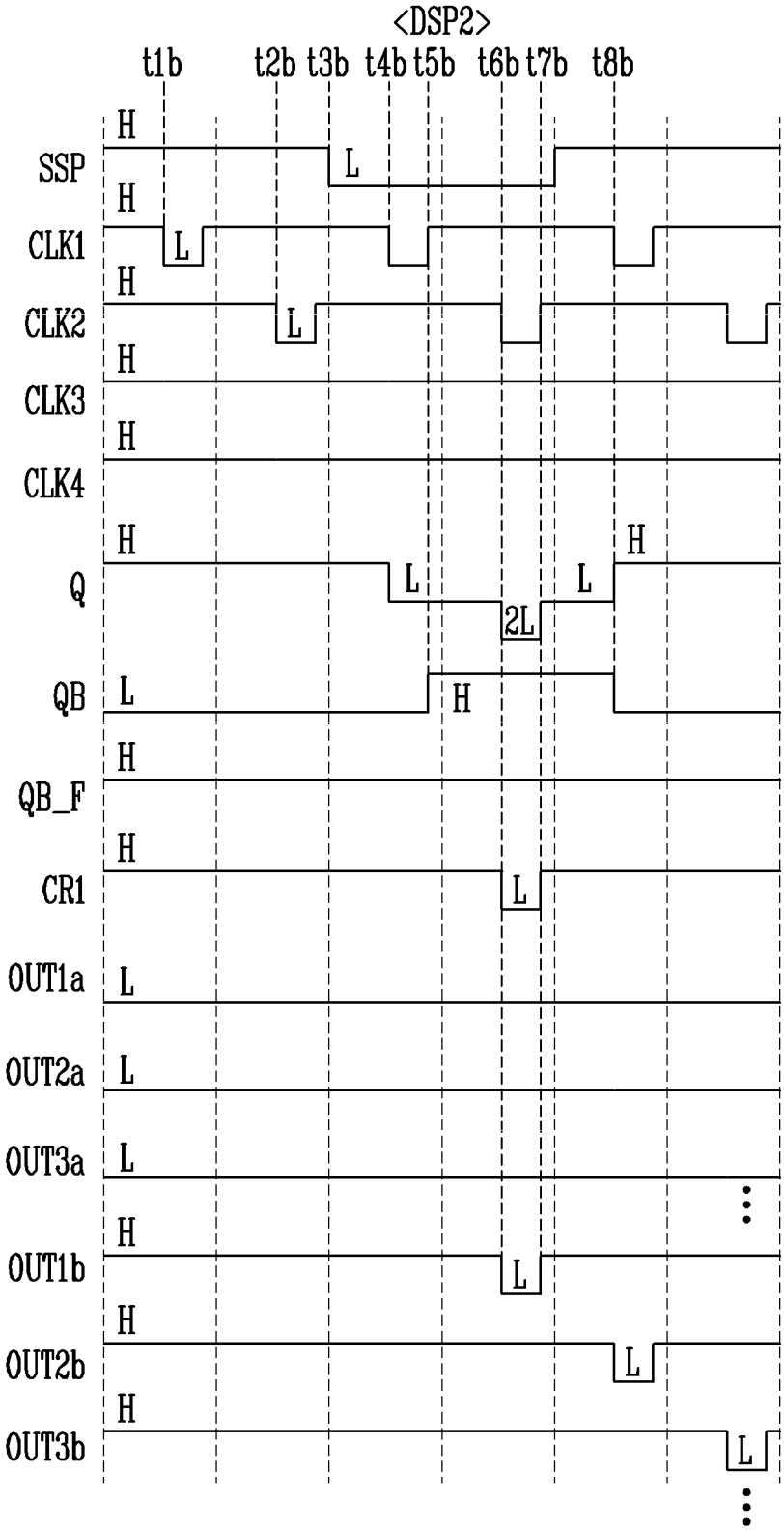

FIG. 14 is a timing diagram illustrating an example of the driving of the first stage shown in FIG. 12.

Figure 15:
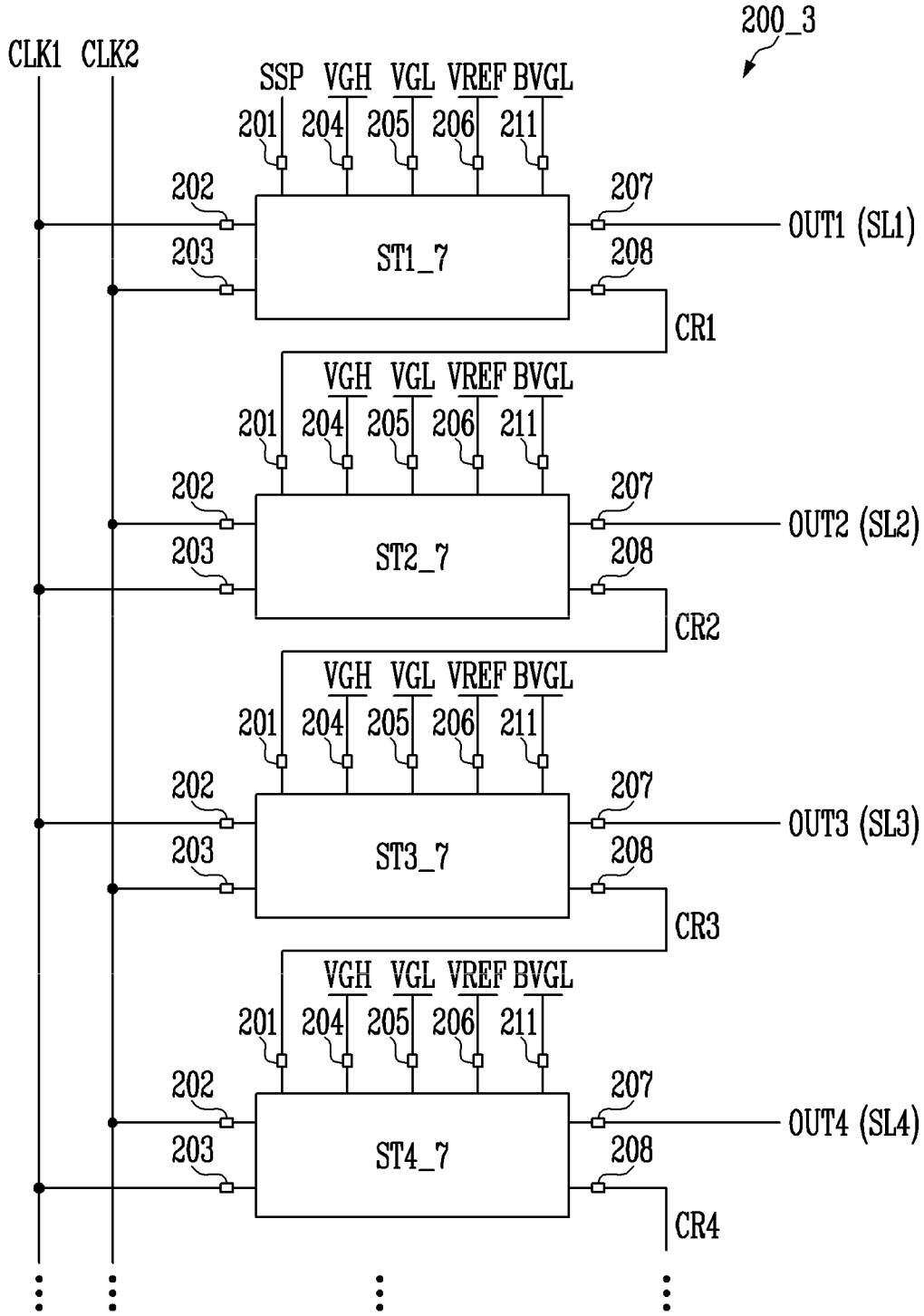

FIG. 15 is a block diagram illustrating a scan driver (gate driver) in accordance with embodiments of the present disclosure.

FIGS. 16A and 16B are diagrams illustrating a voltage level of a fourth power source applied to stages included in the scan driver shown in FIG. 15.

Figure 17:
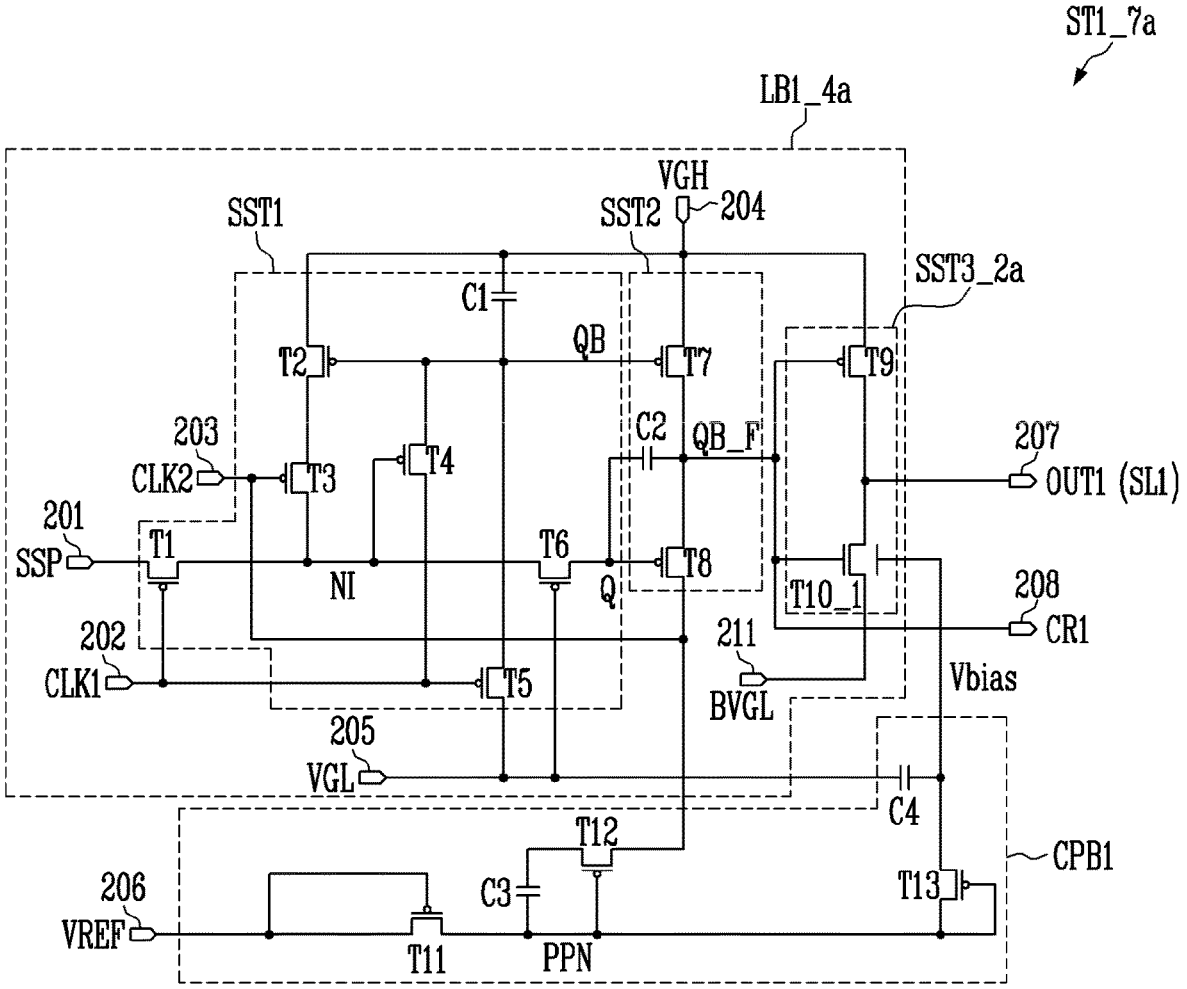

FIG. 17 is a circuit diagram illustrating an example of a first stage included in the scan driver shown in FIG. 15.

Figure 18:
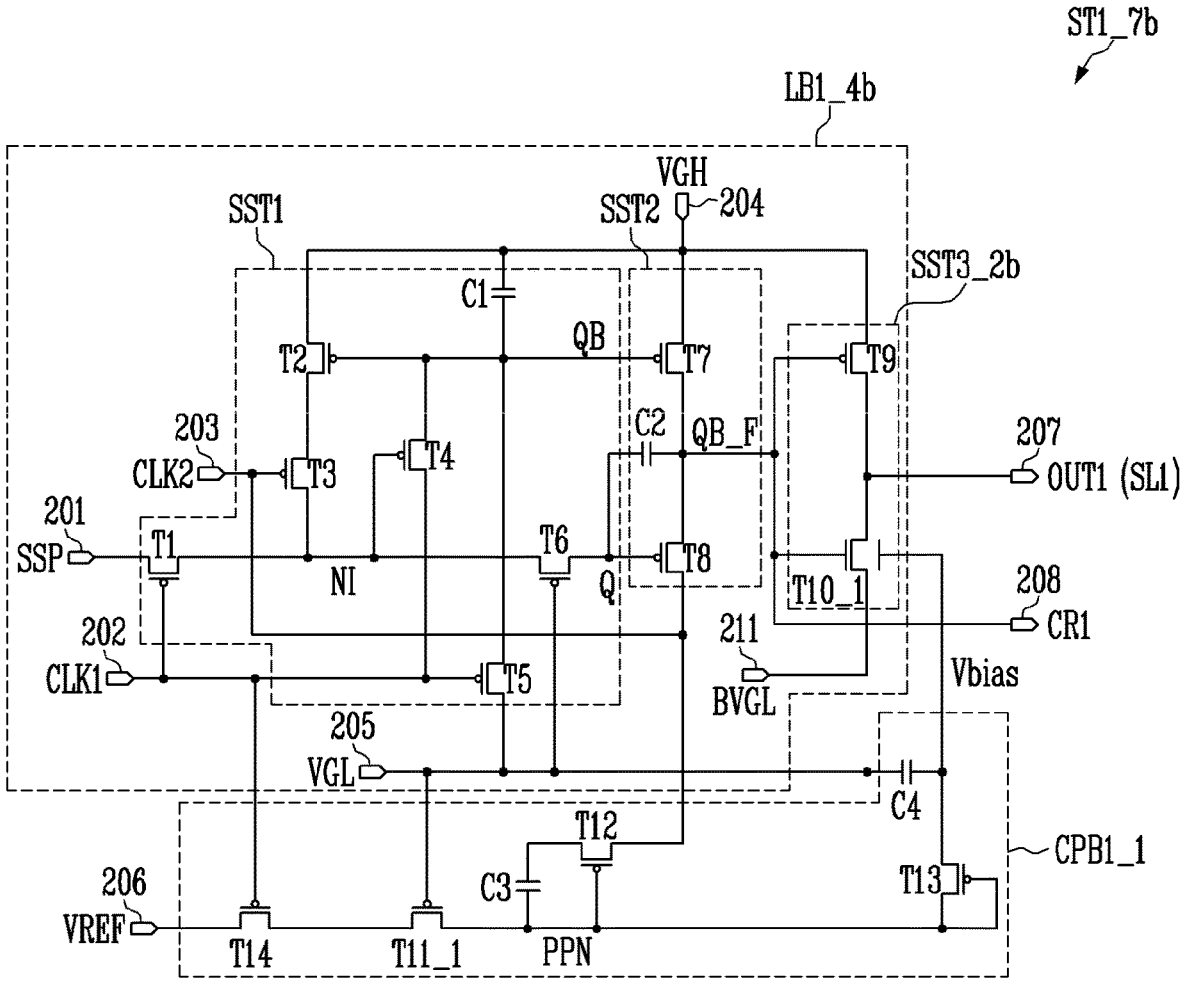

FIG. 18 is a circuit diagram illustrating an example of the first stage included in the scan driver shown in FIG. 15.

Figure 19:
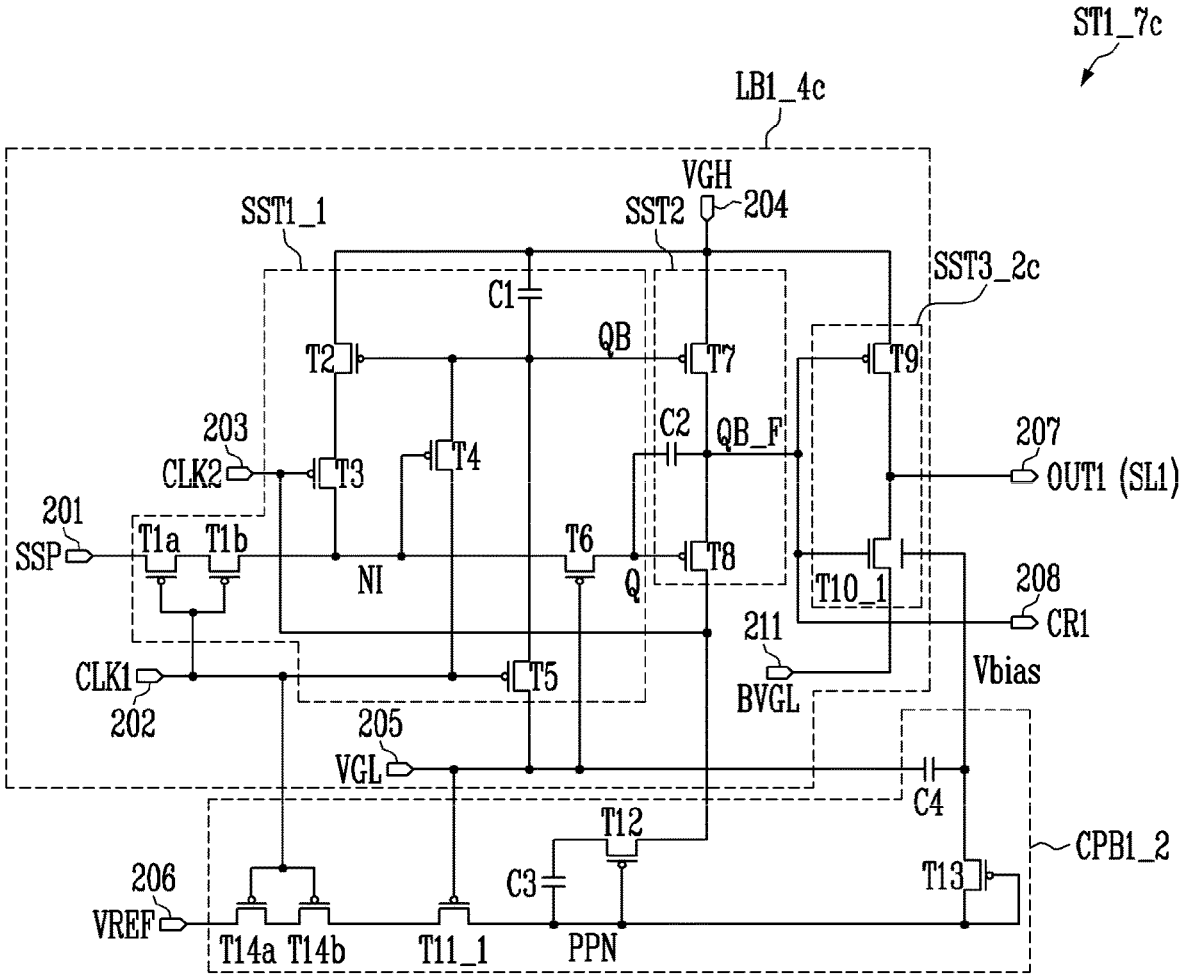

FIG. 19 is a circuit diagram illustrating an example of the first stage included in the scan driver shown in FIG. 15.

Figure 20:
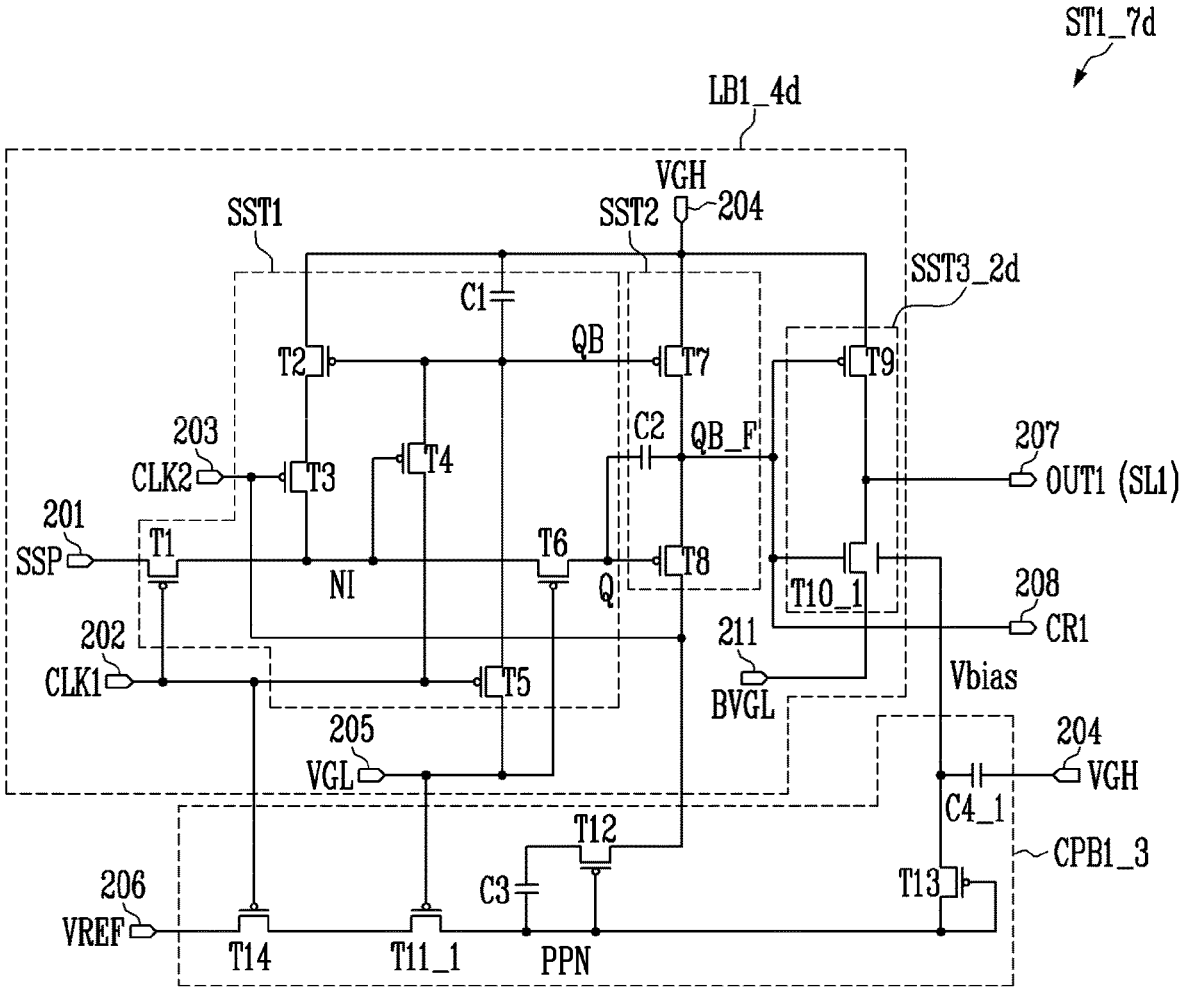

FIG. 20 is a circuit diagram illustrating an example of the first stage included in the scan driver shown in FIG. 15.

Figure 21:
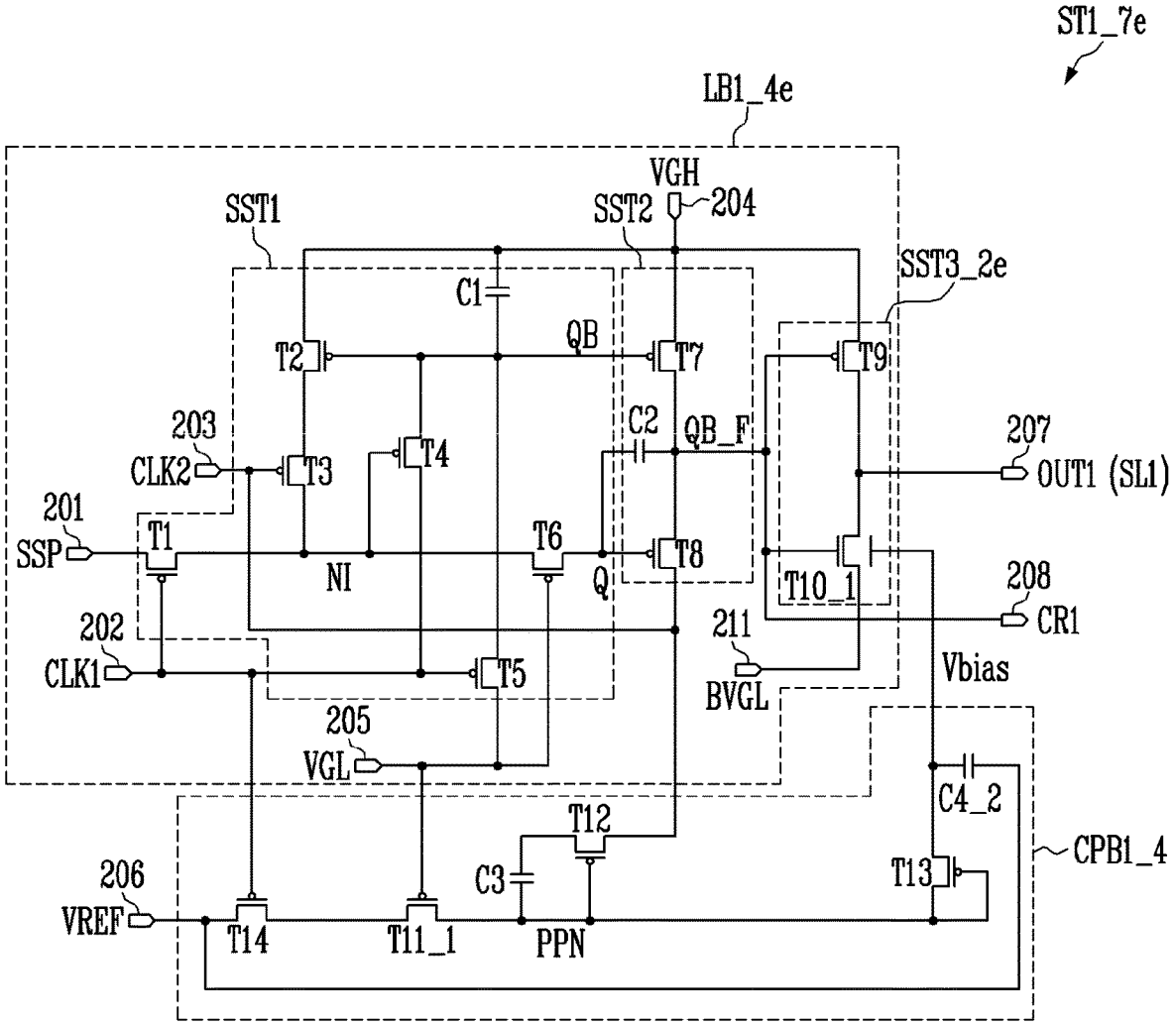

FIG. 21 is a circuit diagram illustrating an example of the first stage included in the scan driver shown in FIG. 15.

Figure 22:
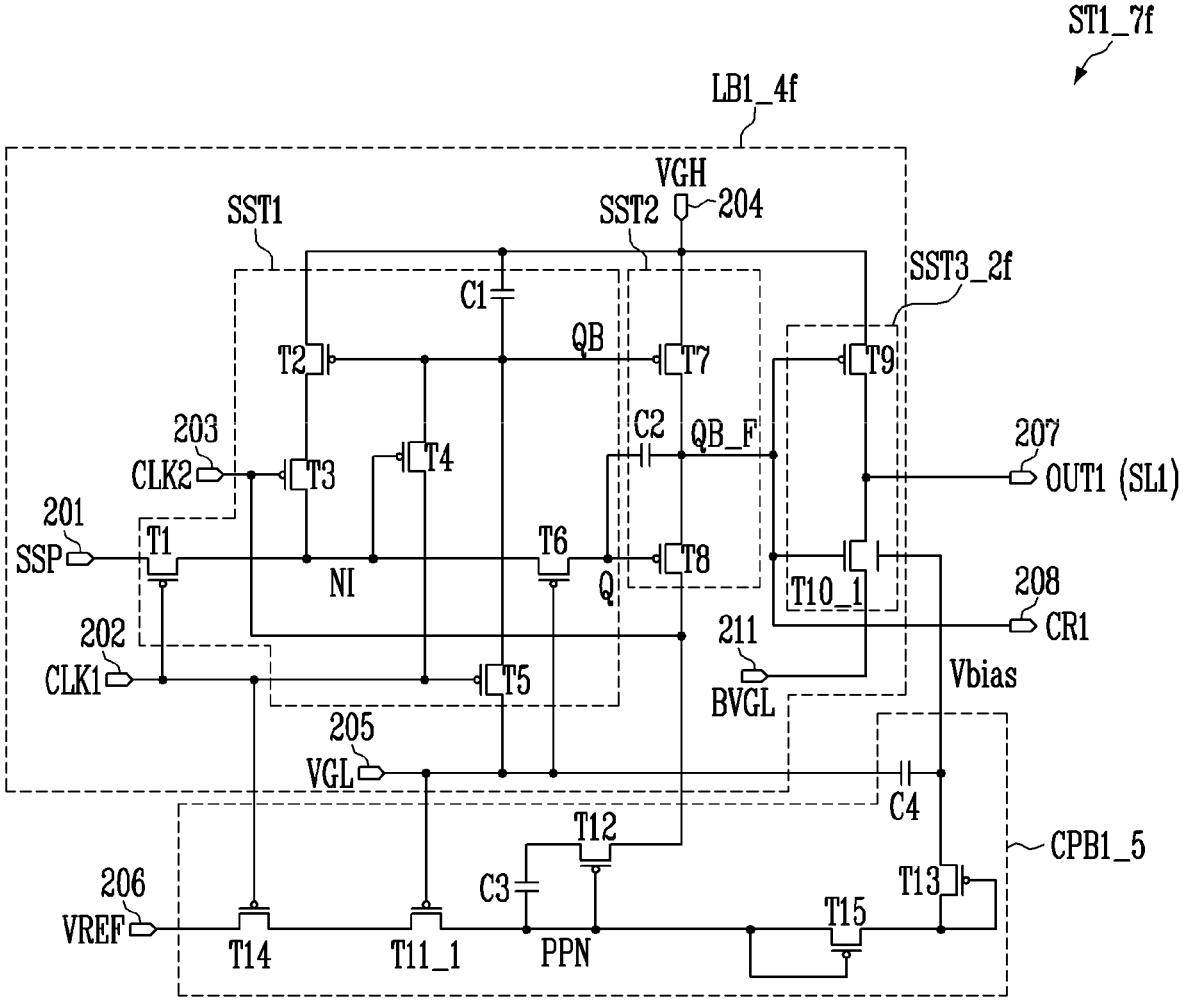

FIG. 22 is a circuit diagram illustrating an example of the first stage included in the scan driver shown in FIG. 15.

Figure 23:
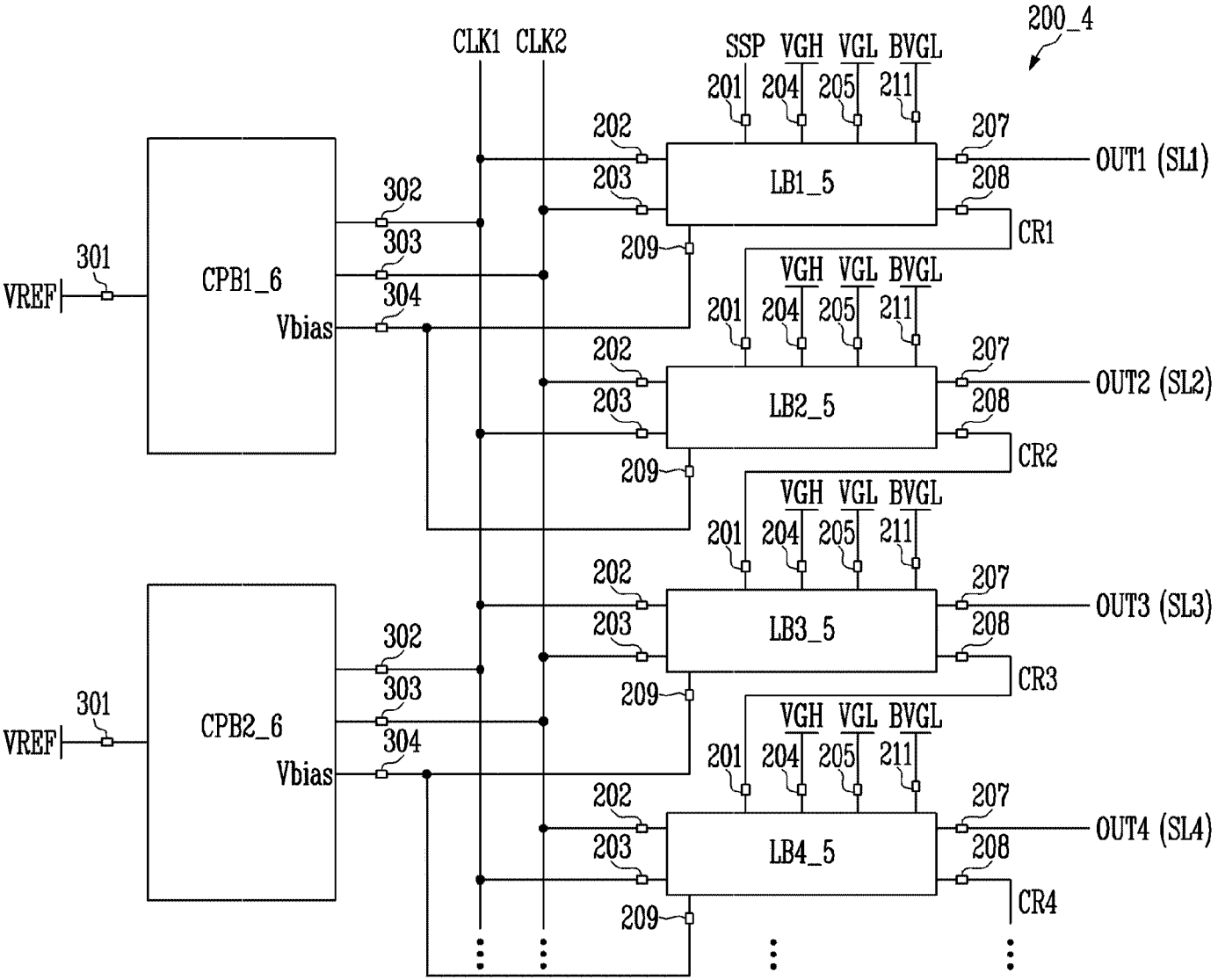

FIG. 23 is a block diagram illustrating a scan driver (gate driver) in accordance with embodiments of the present disclosure.

Figure 24:
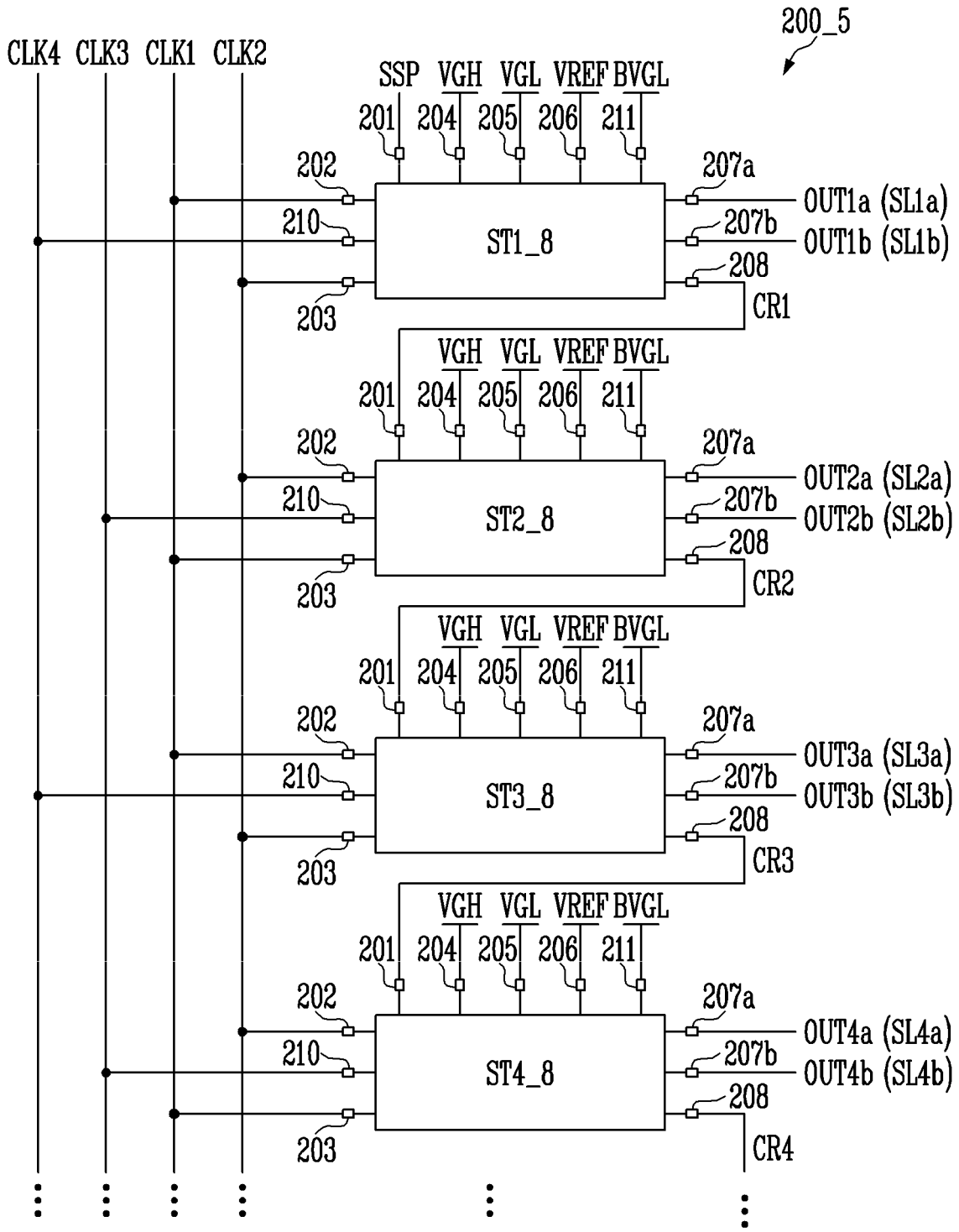

FIG. 24 is a block diagram illustrating a scan driver (gate driver) in accordance with embodiments of the present disclosure.

Figure 25:
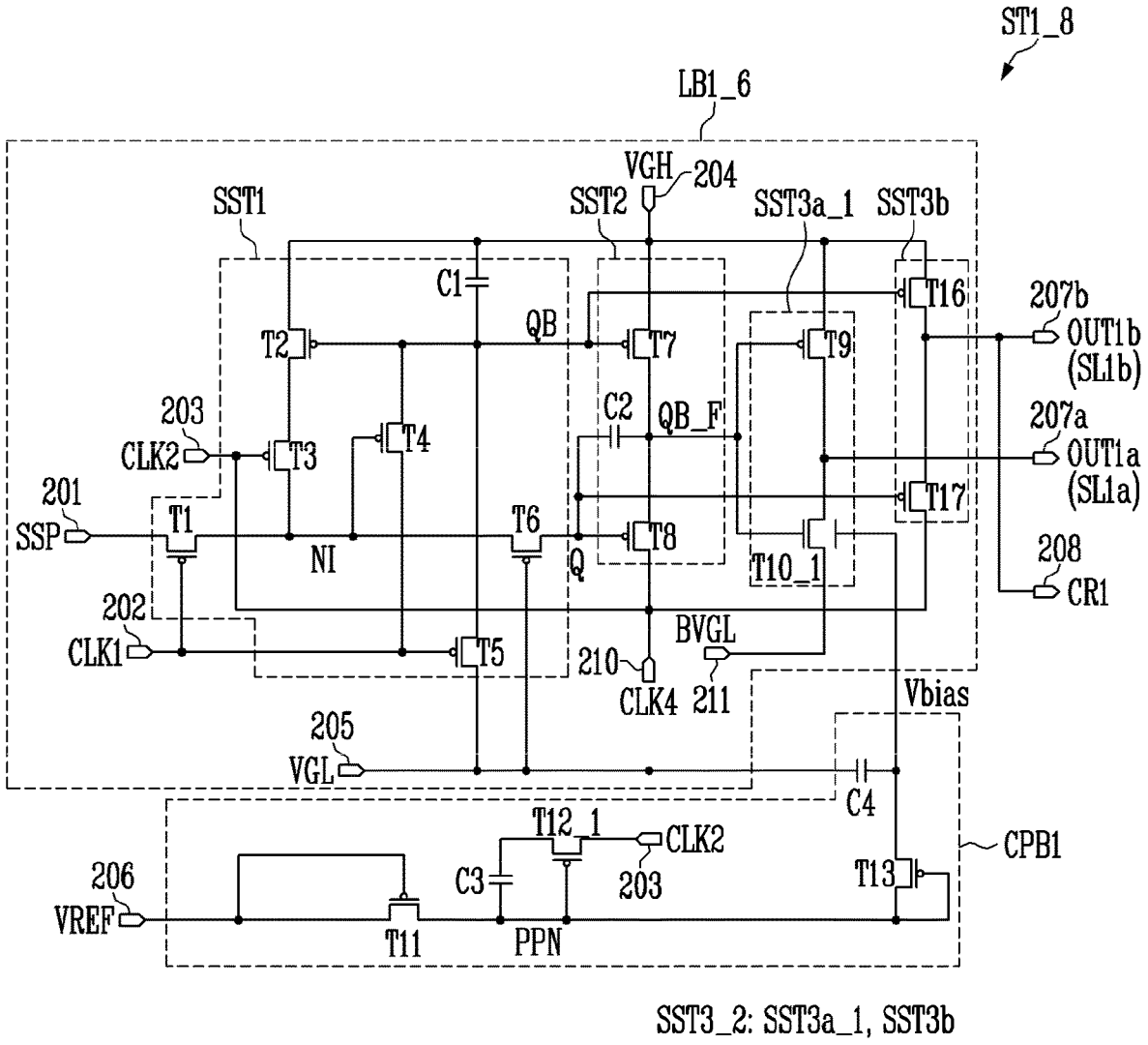

FIG. 25 is a circuit diagram illustrating an example of a first stage included in the scan driver shown in FIG. 24.

Figure 26:
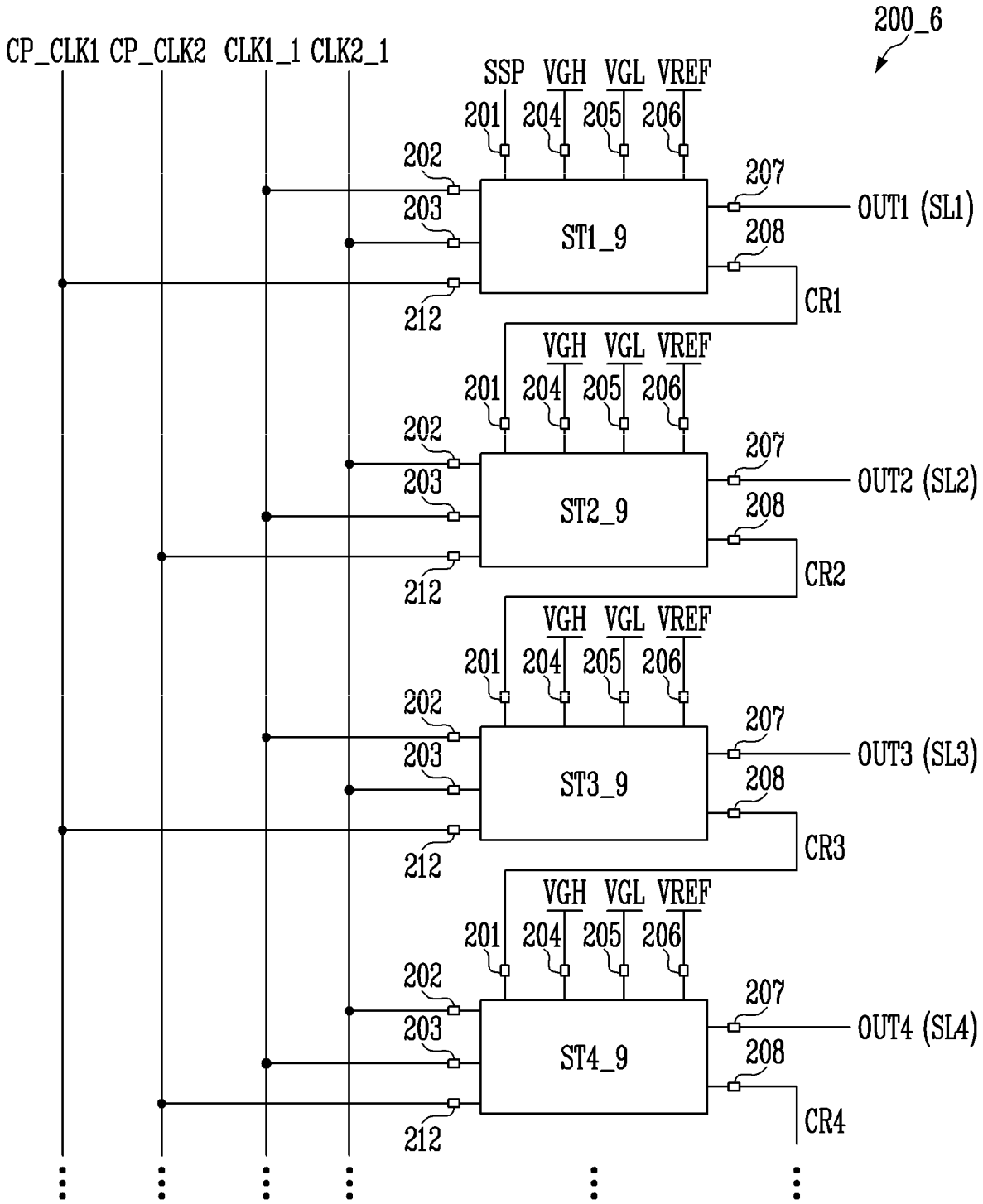

FIG. 26 is a block diagram illustrating a scan driver (gate driver) in accordance with embodiments of the present disclosure.

Figure 27:
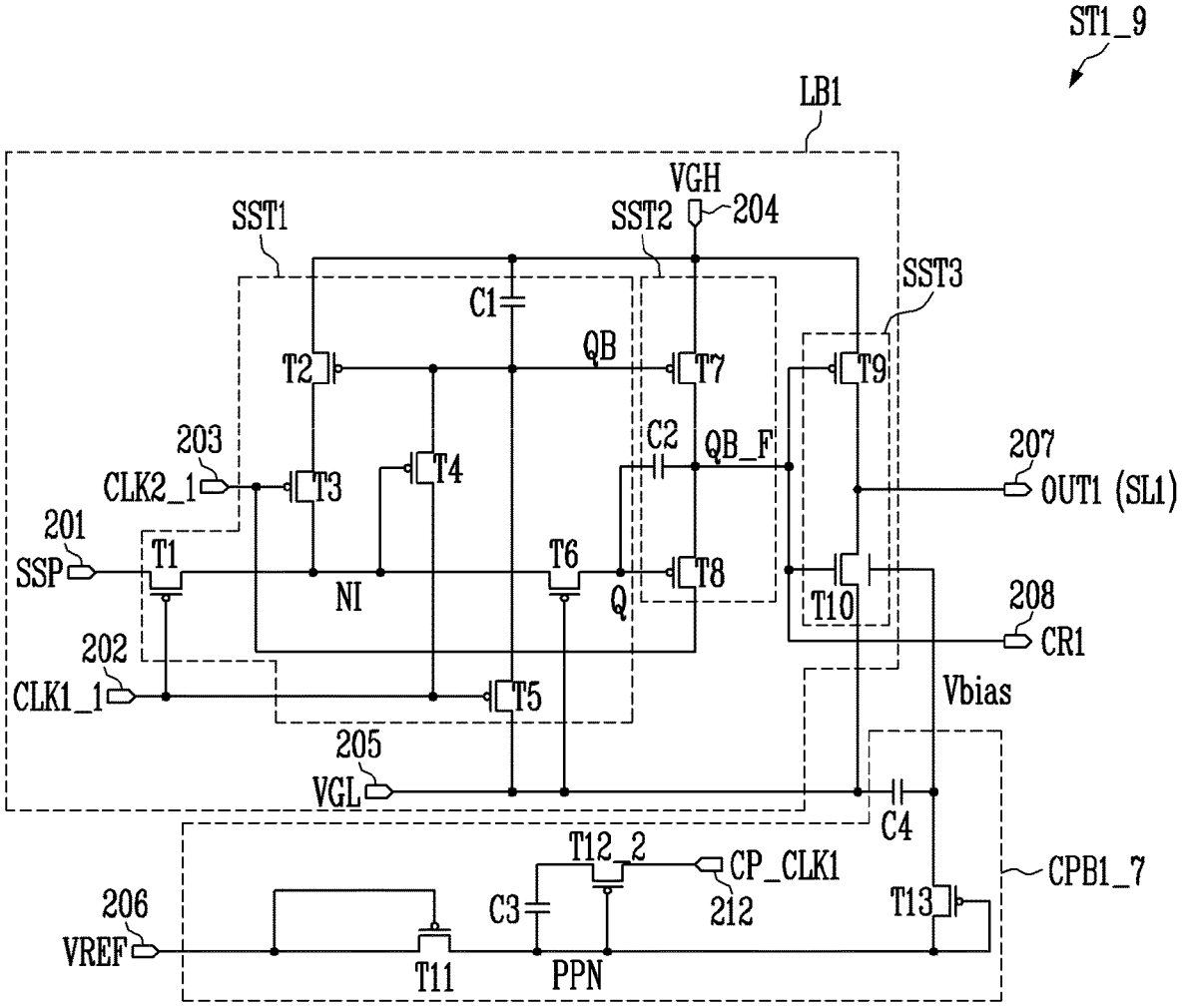

FIG. 27 is a circuit diagram illustrating an example of a first stage included in the scan driver shown in FIG. 26.

Figure 28:
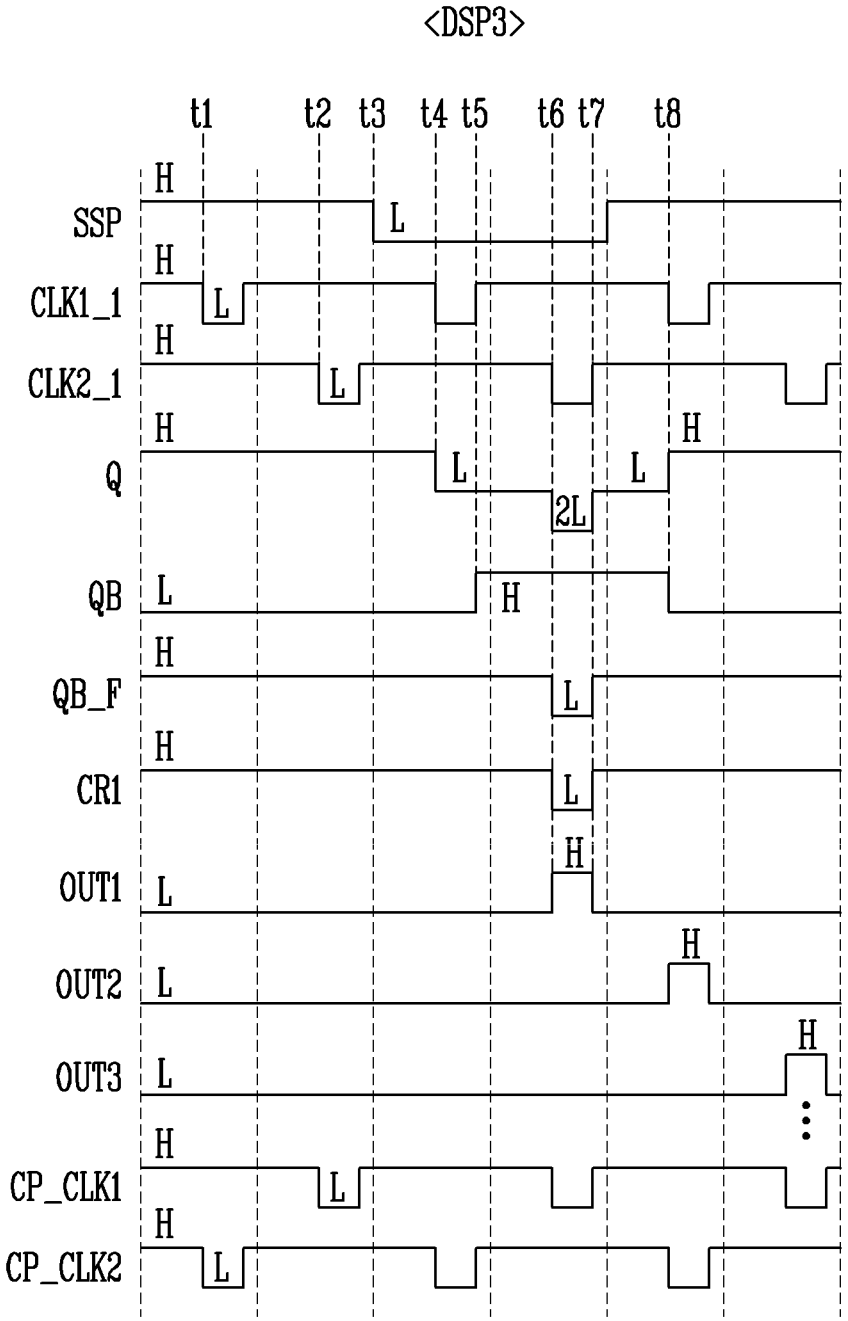

FIG. 28 is a timing diagram illustrating an example of driving of the first stage shown in FIG. 27.

Figure 29:
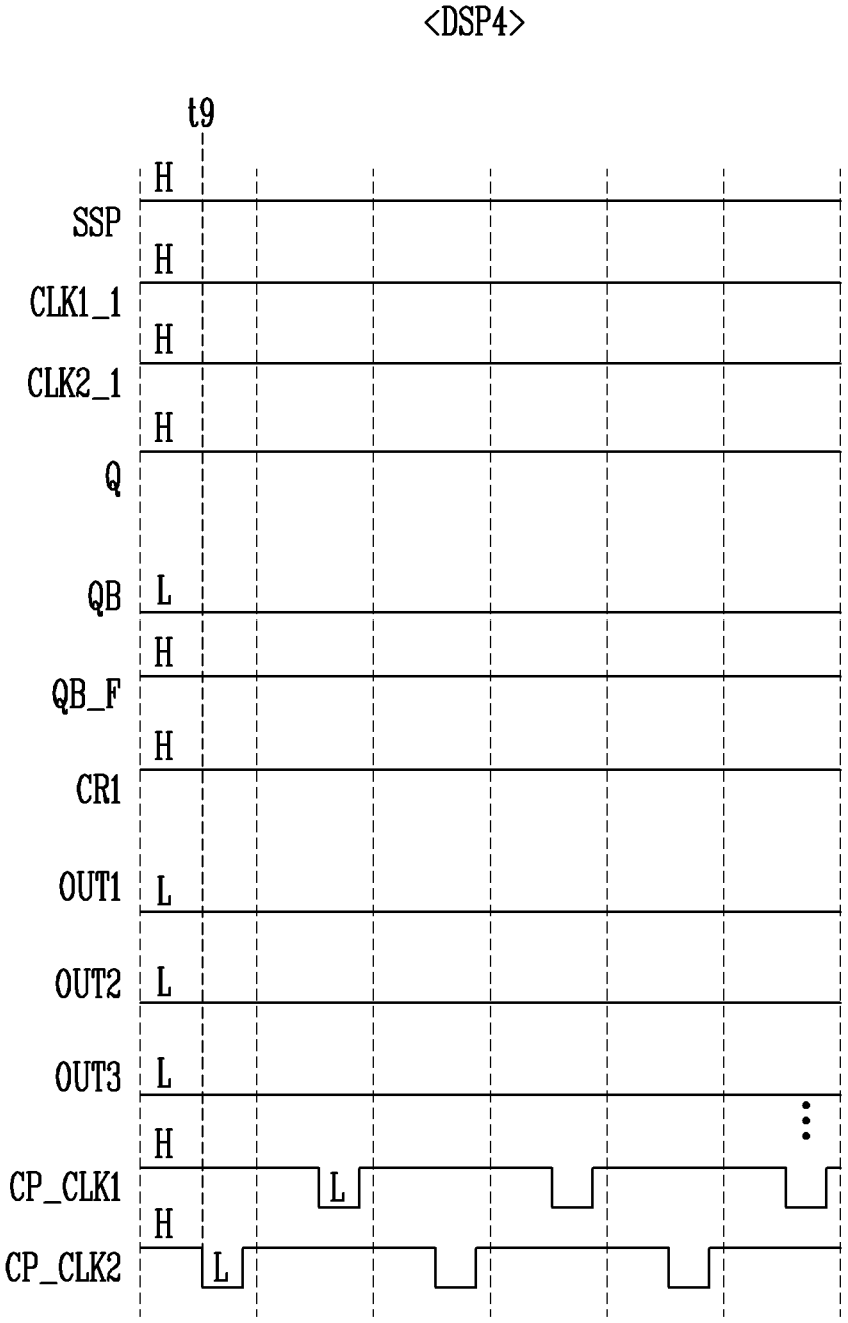

FIG. 29 is a timing diagram illustrating an example of the driving of the first stage shown in FIG. 27.

Figure 30:
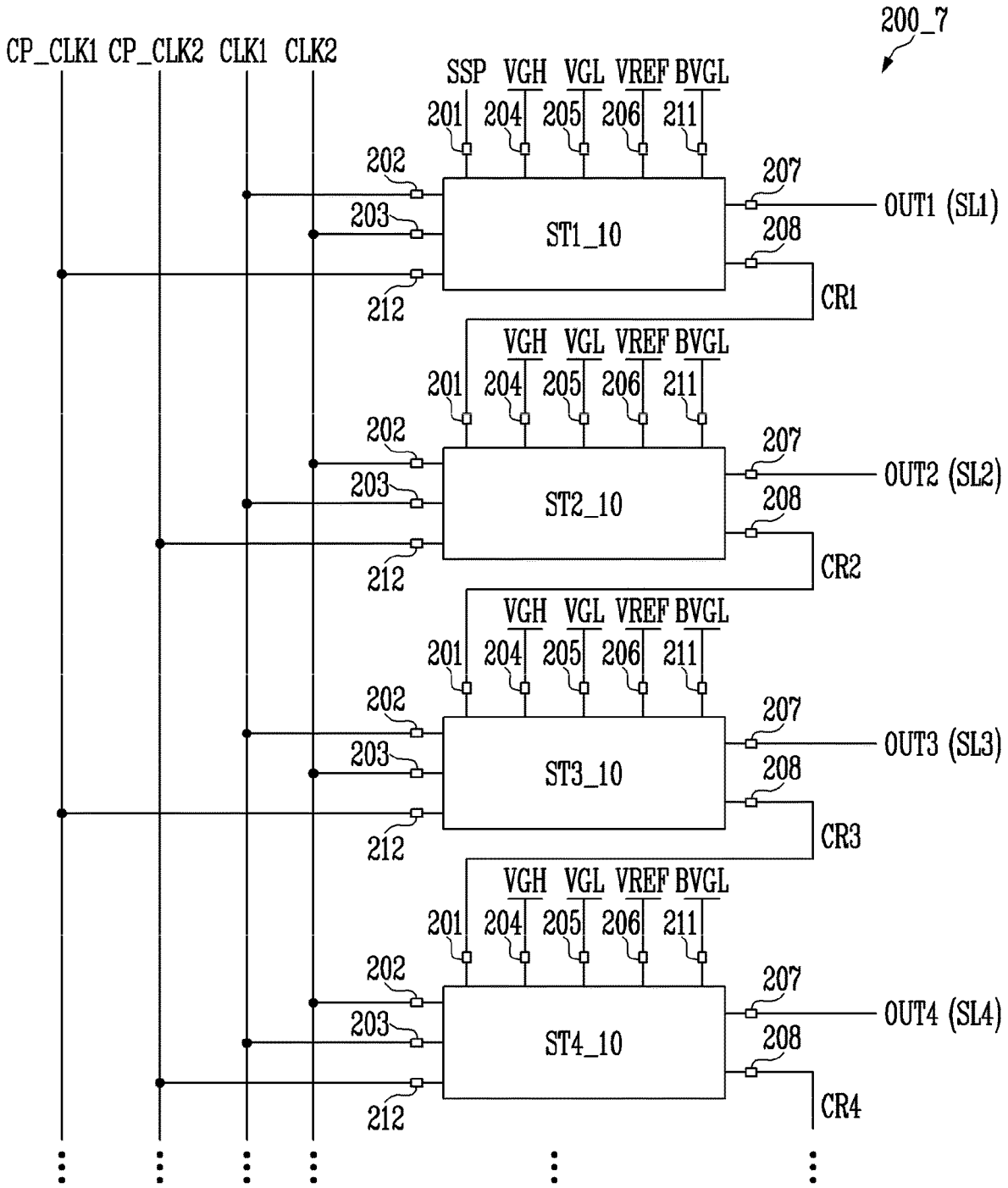

FIG. 30 is a block diagram illustrating a scan driver (gate driver) in accordance with embodiments of the present disclosure.

Figure 31:
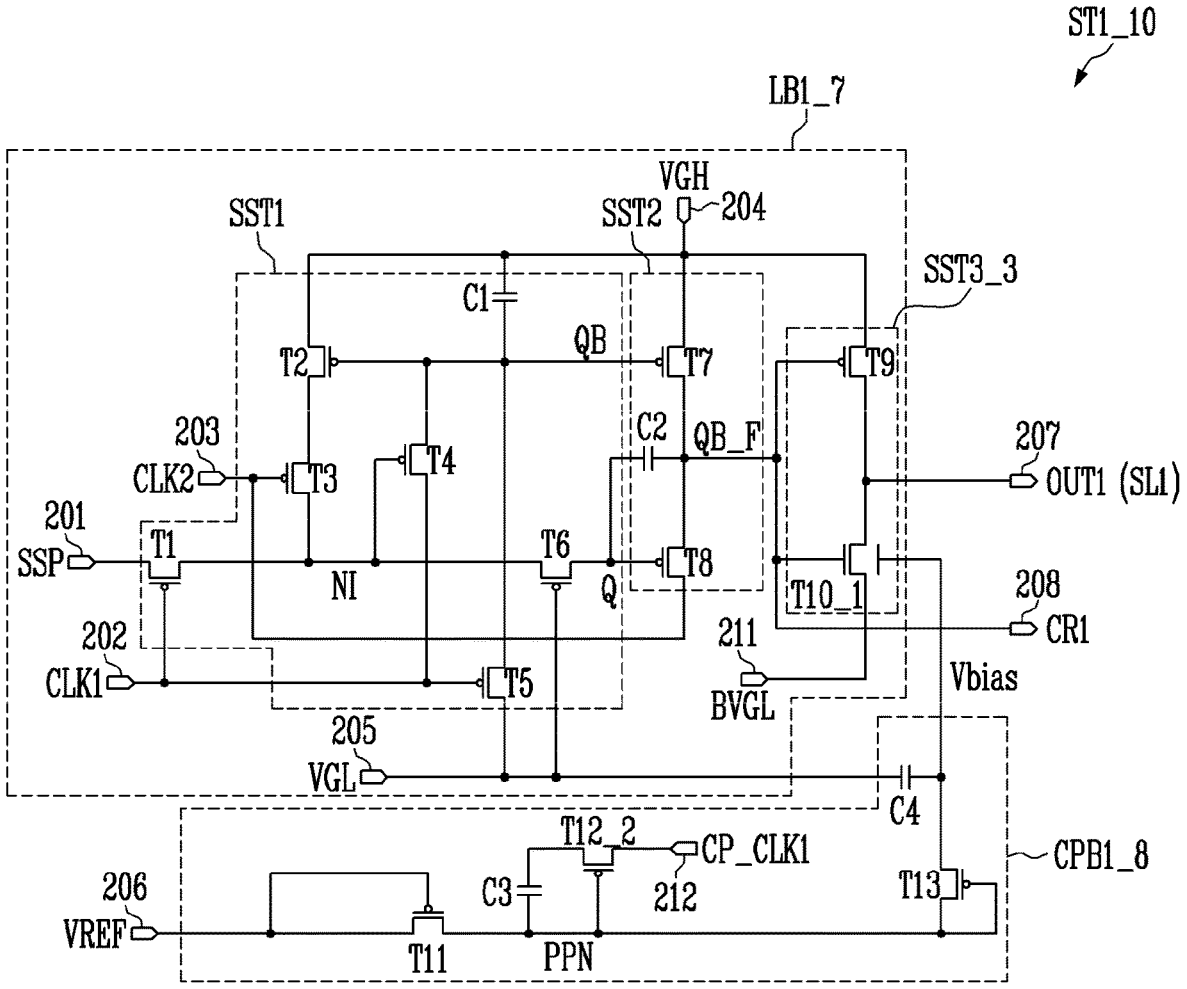

FIG. 31 is a circuit diagram illustrating an example of a first stage included in the scan driver shown in FIG. 30.

DETAILED DESCRIPTION

Hereinafter, exemplary embodiments of the present disclosure will be described in more detail with reference to the accompanying drawings. Throughout the drawings, the same reference numerals are given to the same elements, and their overlapping descriptions will be omitted.

FIG. 1 is a block diagram illustrating a display device in accordance with embodiments of the present disclosure.

Referring to FIG. 1, the display device 1000 may include a pixel unit 100 (or display panel), a scan driver 200 (or first gate driver), an emission driver 300 (or second gate driver), a data driver 400, and a timing controller 500.

Hereinafter, it may be understood that the scan driver 200 and the emission driver 300 are one configuration of a gate driver.

The display device 1000 may display an image at various driving frequencies (or image refresh rates, or screen refresh rates) according to driving conditions. The driving frequency is a frequency at which a data voltage is substantially written to a driving transistor of a pixel PX. For example, the driving frequency is also referred to as a screen scan rate or a screen refresh frequency, and represents a frequency at which a display screen is refreshed for one second. The display device 1000 may display an image, corresponding to various driving frequencies.

In an embodiment, an output frequency of the data driver 400 with respect to one horizontal line (or pixel row) or an output frequency of the scan driver 200 outputting a scan signal may be determined corresponding to an image refresh rate. For example, a refresh rate for moving image driving may be a frequency of about 60 Hz or higher (e.g., 80 Hz, 96 Hz, 120 Hz, 240 Hz, or the like).

In an embodiment, the display device 1000 may adjust an output frequency of the scan driver 200 with respect to one horizontal line (or pixel row) and an output frequency of the data driver 400, which corresponds to the output frequency of the scan driver 200, according to driving conditions. For example, the display device 1000 may display an image, corresponding to various image refresh rates of 1 Hz to 240 Hz. However, this is merely illustrative, and the display device 1000 may also display an image at an image refresh rate of 240 Hz or higher (e.g., 480 Hz).

The pixel unit 100 may display an image. The pixel unit 100 may include pixels PX located to be connected to data lines DL1 to DLm, scan lines SL1 to SLn, and emission control lines EL1 to ELn. The pixel PX may be supplied with voltages of a first driving power source VDD, a second driving power source VSS, and an initialization power source from the outside.

Additionally, each of the pixels PX may be connected to at least one scan line SLi and at least one emission control line ELi, corresponding to a pixel circuit structure. The pixel PX may include a driving transistor, a plurality of switching transistor implemented with at least one of an n-type transistor and a p-type transistor, and a light emitting element.

The timing controller 500 may receive an input control signal and an input image signal from an image source such as an external graphic device. The timing controller 500 may generate image data RGB suitable for an operation condition of the pixel unit 100, based on the input image signal, and provide the image data RGB to the data driver 400. The timing controller 500 may generate a first control signal SCS for controlling a driving timing of the scan driver 200, a second control signal ECS for controlling a driving timing of the emission driver 300, and a third control signal DCS for controlling a driving timing of the data driver 400, based on the input control signal, and provide the first control signal SCS, the second control signal ECS, and the third control signal DCS respectively to the scan driver 200, the emission driver 300, and the data driver 400.

The scan driver 200 may receive the first control signal SCS from the timing controller 500. The scan driver 200 may supply a scan signal to the scan lines SL1 to SLn in response to the first control signal SCS. The first control signal SCS may include a start pulse for the scan signal and a plurality of clock signals.

In an embodiment, the scan driver 200 may supply a scan signal to the scan lines SL1 to SLn at the same frequency (e.g., a second frequency) as an image refresh rate of the display device 1000. The scan signal may be a scan signal for writing a data signal to the driving transistor of the pixel PX. The second frequency may be set to an aliquot of a first frequency at which the emission driver 300 is driven.

The scan driver 200 may supply a scan signal having a pulse of a gate-on level to the scan lines SL1 to SLn in a display scan period of one frame. In an example, the scan driver 200 may supply at least one scan signal to each of the scan lines SL1 to SLn during the display scan period.

Also, the scan driver 200 may supply a scan signal maintained at a gate-off level to the scan lines SL1 to SLn in a self-scan period of the one frame.

Meanwhile, the present disclosure is not limited thereto. For example, the scan driver 200 may additionally supply a scan signal for initialization or compensation to the pixels PX.

The emission driver 300 may receive the second control signal ECS from the timing controller 500. The emission driver 300 an emission control signal to the emission control lines EL1 to ELn in response to the second control signal ECS. The second control signal ECS may include a start pulse for the emission control signal and a plurality of clock signals.

In an embodiment, the emission driver 300 may supply the emission control signal to the emission control lines EL1 to ELn at the first frequency. For example, the emission driver 300 may always supply an emission control signal to the emission control lines EL1 to ELn at a constant frequency (e.g., the first frequency), regardless of the frequency of an image refresh rate. Therefore, in the one frame, emission control signals supplied to the emission control lines EL1 to ELn may be repeatedly supplied for every predetermined cycle.

In addition, the first frequency may be set higher than the second frequency. In an embodiment, the frequency (or the second frequency) of the image refresh rate may be set to an aliquot of the first frequency.

For example, at all driving frequencies at which the display device 1000 can be driven, the emission driver 300 may perform scanning once during the display scan period, and perform scanning at least once according to the image refresh rate during the self-scan period.

That is, during the display scan period, an emission control signal may be sequentially output once to each of the emission control signals EL1 to ELn. During the self-scan period, an emission control signal may be sequentially output at least once to each of the emission control signals EL1 to ELn.

Accordingly, when the image refresh rate is decreased, a number of times the emission driver 300 repeatedly supplies an emission control signal to each of the emission control lines EL1 to ELn in the one frame may be increased.

The data driver 400 may receive the third control signal DCS from the timing controller 500. The data driver 400 may convert the image data RGB into an analog data signal (e.g., a data voltage) in response to the third control signal DCS, and supply the data signal to the data lines DL1 to DLm.

Meanwhile, for convenience of description, a case where each of the scan driver 200 and the emission driver 300 is a single component has been illustrated in FIG. 1, but the present disclosure is not limited thereto. The scan driver 200 may include a plurality of scan drivers each of which supplies at least one of scan signals having different waveforms according to a design. In addition, at least a portion of the scan driver 200 and the emission driver 300 may be integrated as one driving circuit, one module, or the like.

In an embodiment, the display device 1000 may further include a power supply. The power supply may supply, to the pixel unit 100, the voltage of the first power source VDD and the supply of the second driving power source VSS, which are used for driving of the pixel PX.

FIG. 2 is a block diagram illustrating a scan driver (gate driver) in accordance with embodiments of the present disclosure.

Meanwhile, for convenience of description, four stages ST1 to ST4 included in the scan driver 200 and scan signals (or output signals OUT1 to OUT4) output therefrom.

In addition, the scan driver 200 is an example of a gate driver, and may be replaced with the emission driver 300 shown in FIG. 1.

Referring to FIG. 2, the scan driver 200 may include a plurality of stages ST1 to ST4. The stages ST1 to ST4 may be respectively connected to corresponding scan lines SL1 to SL4, and output a scan signal, corresponding to clock signals CLK1 and CLK2.

A second stage ST2 may be dependently connected to a first stage ST1, a third stage ST3 may be dependently connected to the second stage ST2, and a fourth stage ST4 may be dependently connected to the third stage ST3. The first to fourth stages ST1 to ST4 may have the substantially same configuration.

Each of the stages ST1 to ST4 may include a first input terminal 201, a second input terminal 202, a third input terminal 203, a first power input terminal 204, a second power input terminal 205, a third power input terminal 206, a first output terminal 207, and a second output terminal 208.

A first input terminal 201 of the first stage ST1 may receive a start pulse SSP. In addition, each of first input terminals 201 of the second to fourth stages ST2 to ST4 may receive a carry signal (i.e., one of first to third carry signals CR1 to CR3) output from a second output terminal 208 of a previous stage. For example, the first input terminal 201 of the second stage ST2 may receive the first carry signal CR1 output from a second output terminal 208 of the first stage ST1, the first input terminal 201 of the third stage ST3 may receive the second carry signal CR2 output from a second output terminal 208 of the second stage ST2, and the first input terminal 201 of the fourth stage ST4 may receive the third carry signal CR3 output from a second output terminal 208 of the third stage ST3.

The first clock signal CLK1 and the second clock signal CLK2 may be alternately provided to second input terminals 202 and third input terminals 203 of the stages ST1 to ST4.

In an embodiment, a second input terminal 202 of a kth (k is an integer greater than 0) stage may receive the first clock signal CLK1, and a third input terminal 203 of the kth stage may receive the second clock signal CLK2. On the other hand, a second input terminal 202 of a (k+1)th stage may receive the second clock signal CLK2, and a third input terminal 203 of the (k+1)th stage may receive the first clock signal CLK1.

For example, each of the second input terminals 202 of the first stage ST1 and the third stage ST3 may receive the first clock signal CLK1, and each of the third input terminals 203 of the first stage ST1 and the third stage ST3 may receive the second clock signal CLK2. In addition, each of the second input terminals of the second stage ST2 and the fourth stage ST4 may receive the second clock signal CLK2, and each of the third input terminals 203 of the second stage ST2 and the fourth stage ST4 may receive the first clock signal CLK1.

The first clock signal CLK1 and the second clock signal CLK2 may have the same cycle, and have waveforms of which phases do not overlap with each other. In an example, the second clock signal CLK2 may be set as a signal shifted by about a half cycle from the first clock signal CLK1.

Voltages of power sources necessary for driving of the stages ST1 to ST4 may be applied to first to third power input terminals 204, 205, and 206 of the stages ST1 to ST4.

For example, a voltage of a first power source VGH may be applied to a first power input terminal 204 of each of the stages ST1 to ST4, and a voltage of a second power source VGL may be applied to a second power input terminal 205 of each of the stages ST1 to ST4. Each of the voltage of the first power source VGH and the voltage of the second power source VGL may have a DC voltage level. A voltage level of the first power source VGH may be set higher than a voltage level of the second power source VGL.

In addition, a voltage of a third power source VREF may be applied to a third power input terminal 206 of each of the stages ST1 to ST4. A voltage level of the third power source VREF may be lower than the voltage level of the first power source VGH and be higher than the voltage level of the second power source VGL. That is, the third power source VREF may have a voltage level between the first power source VGH and the second power source VGL.

Output signals OUT1 to OUT4 may be output to first output terminals 207 of the respective stages ST1 to ST4. In an embodiment, the output signals OUT1 to OUT4 output to the first output terminals 207 are scan signals, and may be provided to corresponding scan lines SL1 to SL4.

Carry signals CR1 to CR4 may be output to second output terminals 208 of the respective stages ST1 to ST4. As described above, each of the carry signals CR1 to CR4 output to the second output terminals 208 may be provided to an input terminal 201 of a next stage. For example, the first carry signal CR1 output from a second output terminal 208 of the first stage ST1 may be provided to the first input terminal 201 of the second stage ST2, the second carry signal CR2 output from a second output terminal 208 of the second stage ST2 may be provided to the first input terminal 201 of the third stage ST3, the third carry signal CR3 output from a second output terminal 208 of the third stage ST3 may be provided to the first input terminal 201 of the fourth stage ST4, and a fourth carry signal CR2 output from a second output terminal 208 of the fourth stage ST4 may be provided to a first input terminal of a fifth stage.

In an embodiment, the stages ST1 to ST4 included in the scan driver 200 may have the substantially same configuration, except kinds of signals received through the first input terminals 201 of the stages ST1 to ST4. For example, the first stage as an initial stage, which receives the start pulse SSP through the first input terminal 201, and the other stages (e.g., the second to fourth stages ST2 to ST4), each of which receives a carry signal of a previous stage through the first input terminal 201, may have the substantially same circuit configuration, except an input signal (i.e., the start pulse SSP or a carry signal of a previous stage) received through the first input terminal 201, and operate substantially identical to each other.

Accordingly, hereinafter, for convenience description, the stages included in the scan driver 200 will be described based on the first stage ST1.

FIG. 3 is a circuit diagram illustrating an example of the first stage included in the scan driver shown in FIG. 2.

Referring to FIGS. 2 and 3, the first stage ST1 may include a first sub-stage circuit LB1.

The first sub-stage circuit LB1 may generate and output a first output signal OUT1 and the first carry signal CR1, based on an input signal (e.g., the start pulse SSP), the first clock signal CLK1, the second clock signal CLK2, the voltage of the first power source VGH, and the voltage of the second power source VGL.

In an embodiment, the first sub-stage circuit LB1 may include a first driver SST1, a second driver SST2, and an output unit SST3.

The first driver SST1 may receive the input signal (e.g., the start pulse SSP) through the first input terminal 201, receive the first clock signal CLK1 through the second input terminal 202, and receive the second clock signal CLK2 through a third input terminal 203. Also, the first driver SST1 may be connected to the first power source VGH through a first power input terminal 204, and be connected to the second power source VGL through a second power input terminal 205.

The first driver SST1 may control voltages of a first node Q and a second node QB, based on the start pulse SSP, the first clock signal CLK1, the second clock signal CLK2, the first power source VGH, and the second power source VGL.

To this end, the first driver SST1 may include first to sixth transistors T1 to T6 and a first capacitor C1.

The first transistor T1 may be connected between the first input terminal 201 and an input node NI, and include a gate electrode connected to the second input terminal 202. The first transistor T1 may be turned on when the first clock signal CLK1 supplied through the second input terminal 202 has a gate-on level (e.g., a low level), to electrically connect the first input terminal 201 and the input node NI to each other.

In an embodiment, the first transistor T1 may include a plurality of sub-transistors connected in series to each other. This will be described in detail with reference to FIG. 5.

The second transistor T2 may include a first electrode connected to the first power input terminal 204 and a gate electrode connected to the second node QB. The second transistor T2 may be turned on or turned off based on the voltage of the second node QB.

The third transistor T3 may be connected between a second electrode of the second transistor T2 and the input node NI, and include a gate electrode connected to the third input terminal 203. The third transistor T3 may be turned on when the second clock signal CLK2 supplied through the third input terminal 203 has the gate-on level (e.g., the low level), to electrically connect the second transistor T2 (e.g., the second electrode of the second transistor T2) and the input node NI to each other.

The fourth transistor T4 may be connected between the second node QB and the second input terminal 202, and include a gate electrode connected to the input node NI. The fourth transistor T4 may be turned on or turned off based on a voltage of the input node NI.

The fifth transistor T5 may be connected between the second node QB and the second power input terminal 205, and include a gate electrode connected to the second input terminal 202. The fifth transistor T5 may be turned on when the first clock signal CLK1 supplied through the second input terminal 202 has the gate-on level (e.g., the low level), to electrically connect the second node QB and the second power input terminal 205 to each other.

The sixth transistor T6 may be connected between the input node NI and the first node Q, and include a gate electrode connected to the second power input terminal 205. Since the voltage of the second power source VGL, which have the low level (or the gate-on level), is supplied to the gate electrode of the sixth transistor T6 through the second power input terminal 205, the sixth transistor T6 can always maintain a turn-on state. Thus, the voltage of the input node NI does not become lower than the voltage of the second power source VGL, so that bias stress which may be applied to the first transistor T1 can be reduced. For example, the voltage of the input node N1 may be equal to or greater than a sum of absolute values of the voltage of the second power source VGL and a threshold voltage of the sixth transistor T6.

The first capacitor C1 may be connected between the first power input terminal 204 and the second node QB. For example, the first capacitor C1 may include a first electrode connected to the first power input terminal 204 and a second electrode connected to the second node QB. Since one electrode of the first capacitor C1 is connected to the first power input terminal 204 to which the voltage of the first power source VGH is supplied, the first capacitor C1 charges a voltage applied to the second node QB, and stably maintains the voltage of the second node QB.

The second driver SST2 may be connected to the first node Q and the second node QB, receive the voltage of the first power source VGH through the first power input terminal 204, and receive the second clock signal CLK2 through the third input terminal 203.

The second driver SST2 may control a voltage of an output node QB_F, based on the voltage of the first node Q, the voltage of the second node QB, the voltage of the first power source VGH, and a signal level of the second clock signal CLK2. Also, the second driver SST2 may out the first carry signal CR1 through the second output terminal 208, based on the voltage of the first node Q, the voltage of the second node QB, the voltage of the first power source VGH, and the signal level of the second clock signal CLK2. The first carry signal CR1 may correspond to the voltage of the output node QB_F, and a signal corresponding to a voltage level of the output node QB_F may be output as the first carry signal. For example, the voltage of the first power source VGH may correspond to a high level of the first carry signal CR1, and a low level of the second clock signal CLK2 may correspond to a low level of the first carry signal CR1. Meanwhile, as described with reference to FIG. 2, the first carry signal CR1 may be provided to a next stage (e.g., the second stage ST2 shown in FIG. 2).

To this end, the second driver SST2 may include a seventh transistor T7, an eighth transistor T8, and a second capacitor C2.

The seventh transistor T7 may be connected between the first power input terminal 204 and the output node QB_F, and include a gate electrode connected to the second node QB. The seventh transistor T7 may be turned on or turned off based on the voltage of the second node QB. When the seventh transistor T7 is turned on, the voltage of the first power source VGH, which has a high level, may be supplied to the output node QB_F.

The eighth transistor T8 may be connected between the third input terminal 203 and the output node QB_F, and include a gate electrode connected to the first node Q. The eighth transistor T8 may be turned on or turned off based on the voltage of the first node Q. When the eighth transistor T8 is turned on, the second clock signal CLK2 may be supplied to the output node QB_F.

As described above, the voltage of the output node QB_F may be controlled according to the turn-on or turn-off of the seventh and eighth transistors T7 and T8.

The second capacitor C2 may be connected between the first node Q1 and the output node QB_F. For example, the second capacitor C2 may include a first electrode connected to the first node Q and a second electrode connected to the output node QB_F.

The output unit SST3 may be connected to the output node QB_F. The output unit SST3 may receive the voltage of the first power source VGH through the first power input terminal 204 and receive the voltage of the second power source VGL through the second power input terminal 205.

The output unit SST3 may output the first output signal OUT1, based on the voltage of the output node QB_F, the voltage of the first power source VGH, and the voltage of the second power source VGL. For example, the voltage of the first power source VGH may correspond to a high level of the first output signal OUT1, and the voltage of the second power source VGL may correspond to a low level of the first output signal OUT1. The first output signal OUT1 is a scan signal, and may be provided to a first scan line SL1 through a first output terminal 207.

To this end, the output unit SST3 may include a ninth transistor T9 and a tenth transistor T10.

The ninth transistor T9 may be connected between the first power input terminal 204 and the first output terminal 207, and include a gate electrode connected to the output node QB_F. The ninth transistor T9 may be turned on or turned off based on the voltage of the output node QB_F. When the ninth transistor T9 is turned on, the first output signal OUT1 supplied to the first output terminal 207 may have a high level (e.g., a gate-on voltage level of an n-type transistor).

The tenth transistor T10 may be connected between the second power input terminal 205 and the first output terminal 207, and include a gate electrode connected to the output node QB_F. The tenth transistor T10 may be turned on or turned off based on the voltage of the output node QB_F. When the tenth transistor T10 is turned on, the first output signal OUT1 supplied to the first output terminal 207 may have a low level (e.g., a gate-off voltage level of the n-type transistor).

In an embodiment, the output unit SST3 of the first sub-stage circuit LB1 may be implemented as a complementary metal oxide silicon (COMS) circuit (hereinafter, referred to as a CMOS circuit).

For example, the ninth transistor T9 of the output unit SST3 may be implemented as a p-type transistor, and the tenth transistor T10 of the output unit SST3 may be implemented as an n-type transistor. Since the gate electrode of the ninth transistor T9 and the gate electrode of the tenth transistor T10 are commonly connected to the output node QB_F, the tenth transistor T10 may be turned off when the ninth transistor T9 is turned on corresponding to the voltage of the output node QB_F, and be turned on when the ninth transistor T9 is turned off corresponding to the voltage of the output node QB_F. Accordingly, the first output signal OUT1 output through the first output terminal 207 may have a voltage level of the first power source VGH, which is the high level, or a voltage level of the second power source VGL, which is the low level.

The output unit SST3 of the first sub-stage circuit LB1 is implemented as the CMOS circuit, so that the p-type transistor (e.g., the ninth transistor T9) takes charge of and performs a pull-up function and the n-type transistor (e.g., the tenth transistor T1) takes charge of and performs a pull-down function. Thus, the current driving ability of the first sub-stage circuit LB1 (or the first stage ST1) in accordance with the embodiments of the present disclosure can be relatively improved as compared with the existing stage circuit configured with only p-type transistors or n-type transistors.

As described above, the first sub-stage circuit LB1 includes the first driver SST1, the second driver SST2, and the output unit SST3, so that the first stage ST1 takes charge of and performs a function of outputting the first output signal OUT1 (or a first scan signal) through the first scan line SL1. An operation and an effect of the first sub-stage circuit LB1 will be described in detail with reference to FIG. 4.

Meanwhile, as described with reference to FIG. 2, stages (e.g., the stages ST1 to ST4 shown in FIG. 2) of a scan driver (e.g., the scan driver 200 shown in FIG. 2) are substantially identical or similar to one another, except a signal received through a first input terminal 201 of each of the stages. Therefore, the other stages (e.g., the second to fourth stages ST2 to ST4 shown in FIG. 2) of the scan driver (e.g., the scan driver 200 shown in FIG. 2) except the first stage ST1 may have the substantially same circuit configuration as the first stage ST1 and operate substantially identical to the first stage ST1, except that each of the other stages receives a carry signal of a previous stage through the first input terminal 201.

Meanwhile, as described above, since the output unit SST3 of the first sub-stage circuit LB1 is implemented as the CMOS circuit, the output unit SST3 includes an n-type transistor (e.g., the tenth transistor T10). A channel of the tenth transistor T10 implemented as the n-type transistor may be implemented with an oxide semiconductor. The oxide semiconductor may have a negative threshold voltage according to the kind thereof. Therefore, it is necessary to set the tenth transistor T10 to have a positive threshold voltage by applying a voltage (e.g., a bias voltage Vbias) lower than the voltage of the second power source VGL to the tenth transistor T10 (e.g., a back-gate electrode of the tenth transistor T10).

To this end, the first stage ST1 in accordance with the embodiments of the present disclosure may further include a first charge pump circuit CPB1 for applying the bias voltage Vbias to the n-type transistor included in the output unit SST3 implemented as the CMOS circuit.

The first charge pump circuit CPB1 may receive the second clock signal CLK2 through the third input terminal 203. Also, the first charge pump circuit CPB1 may be connected to the second power source VGL through the second power input terminal 205, and be connected to the third power source VREF through a third power input terminal 206.

In an embodiment, the first charge pump circuit CPB1 may generate the bias voltage Vbias, based on the second clock signal CLK2, the voltage of the second power source VGL, and the voltage of the third power source VREF, and supply the bias voltage Vbias to the output unit SST3 (or the tenth transistor T10 of the output unit SST3).

To this end, the first charge pump circuit CPB1 may include eleventh to thirteenth transistors T11 to T13, a third capacitor C3, and a fourth capacitor C4.

The eleventh transistor T11 may be connected between the third power input terminal 206 and a third node PPN, and include a gate electrode connected to the third power input terminal 206. By the voltage of the third power source VREF supplied through the third power input terminal 206, the eleventh transistor T11 may be turned, to supply the voltage of the third power source VREF to the third node PPN.

The twelfth transistor T12 may include a first electrode connected to the third input terminal 203 and a gate electrode connected to the third node PPN. The twelfth transistor T12 may be turned on or turned off based on a voltage of the third node PPN. For example, the twelfth transistor T12 may be turned on based on the voltage of the third node PPN, which has a voltage level lower equal to or lower than the voltage level of the third power source VREF.

The third capacitor C3 may be connected between a second electrode of the twelfth transistor T12 and the third node PPN. For example, the third capacitor C3 may include a first electrode connected to the second electrode of the twelfth transistor T12 and a second electrode connected to the third node PPN. The third capacitor C3 may store a voltage difference between the second electrode of the twelfth transistor T12 and the third node PPN. Accordingly, a change in voltage supplied to the second electrode of the twelfth transistor T12 (or the first electrode of the third capacitor C3) can be reflected to the third node PPN (or the second electrode of the third capacitor C3).

The thirteenth transistor T13 may be connected between the third node PPN and the output unit SST3 (e.g., the back-gate electrode of the tenth transistor T10). For example, the thirteenth transistor T13 may include a first electrode connected to the third node PPN and a second electrode connected to the back-gate electrode of the tenth transistor T10. The thirteenth transistor T13 may include a gate electrode connected to the third node PPN. The thirteenth transistor T13 may be turned on or turned off based on the voltage of the third node PPN.

The fourth capacitor C4 may be connected between the second power input terminal 205 and the second electrode of the thirteenth transistor T13. For example, the fourth capacitor C4 may include a first electrode connected to the second power input terminal 205 and a second electrode connected to the second electrode of the thirteenth transistor T13.

In an embodiment, the fourth capacitor C4 may store a voltage difference between the second power input terminal 205 and the second electrode of the thirteenth transistor T13. Since the voltage of the second power source VGL as a constant voltage is supplied to the second power input terminal 205, a voltage, i.e., the bias voltage Vbias of the second electrode of the thirteenth transistor T13 can be stably maintained by the fourth capacitor C4.

Meanwhile, when a parasitic capacitance with respect to the bias voltage Vbias is sufficient according to a circuit layout of the first stage ST1, the fourth capacitor C4 may be omitted from the first charge pump circuit CPB1.

In an embodiment, by using the voltage of the third power source VREF, which has a voltage level between the first power source VGH and the second power source VGL, the first charge pump circuit CPB1 may generate the bias voltage Vbias lower than the voltage level of the second power source VGL and supply the bias voltage Vbias to the back-gate electrode of the tenth transistor T10 included in the output unit SST3.

For example, when the signal level of the second clock signal CLK2 is changed from a high level to a low level, the voltage of the third node PPN becomes lower by a difference between the high level and the low level of the second clock signal CLK2 from the existing voltage level (e.g., the voltage of the third power source VREF) due to coupling of the third capacitor C3. Accordingly, the voltage of the third node PPN has a voltage level lower than the voltage level of the second power source VGL, which is the low level. Thus, the voltage of the third node PPN, which is lower than the voltage level of the second power source VGL, is supplied as the bias voltage Vbias to the tenth transistor T10 of the output unit SST3 through the thirteenth transistor T13.

Meanwhile, as described above, in order to change a threshold voltage of the tenth transistor T10 by supplying the bias voltage Vbias to the back-gate electrode of the tenth transistor T10 as the n-type transistor included in the output unit SST3 implemented as the CMOS circuit, it is necessary for the bias voltage Vbias to have a voltage level lower than the voltage level of the second power source VGL. When the scan driver 200 (or the display device 1000) includes a separate voltage source for supplying the bias voltage Vbias, a separate voltage source in addition to the first power source VGH and the second power source VGL, which are necessary for driving of the stages of the scan driver 200, is added, and therefore, it can be disadvantageous in terms of power consumption.

On the other hand, the scan driver 200 (or the first stage ST1) in accordance with the embodiments of the present disclosure includes a charge pump circuit (e.g., the first charge pump circuit CPB1), so that the bias voltage Vbias having a voltage level lower than the voltage level of the second power source VGL can be generated by using the third power source VREF. Since the third power source VREF has a voltage level between the first power source VGH and the second power source VGL, the display device (1000 shown in FIG. 1) (or the power supply included in the display device 1000) can generate the voltage of the third power source VREF by changing the voltages of the first power source VGH and the second power source VGL through a voltage regulator circuit. Since the voltage regulator circuit is configured as a relatively simple circuit, the display device (1000 shown in FIG. 1) can be simplified and be advantageous in terms of power consumption, as compared with the case where the display device (1000 shown in FIG. 1) includes the separate voltage source.

Hereinafter, operations of the first sub-stage circuit LB1 and the first charge pump circuit CPB1 of the first stage ST1 will be described in detail with reference to FIG. 4.

FIG. 4 is a timing diagram illustrating an example of driving of the first stage shown in FIG. 3.

Referring to FIGS. 1 to 4, the first clock signal CLK1 and the second clock signal CLK2 may be supplied at different timings. For example, the second clock signal CLK2 may be set as a signal shifted by a half cycle (e.g., one horizontal period) from the first clock signal CLK1. In an example, the first clock signal CLK1 having a low level L may be supplied through the second input terminal 202 at a first time t1, and the second clock signal CLK2 having the low level L may be supplied through the third input terminal 203 at a second time t2 after the first time t1.

Meanwhile, a high level H (or high voltage) shown in FIG. 4 may correspond to the voltage of the first power source VGH, and the low level L (or low voltage) shown in FIG. 4 may correspond to the voltage of the second power source VGL. For example, the voltage of the first power source VGH may be a positive voltage, and the voltage of the second power source VGL may be a negative voltage. However, this is merely illustrative, and the high level H and the low level L are not limited thereto. For example, a voltage having the high level H and a voltage having the low level L may be set according to a kind of transistor, a use environment of the display device, and the like.

Meanwhile, a 2-low level 2L may correspond to a voltage level corresponding to two times of the low level L.

The start pulse SSP may have the high level H at the first time t1, the second time t2, and an eighth time t8. The start pulse SSP may have the low level L at third to seventh times t3 to t7.

As described with reference to FIG. 3, the eleventh transistor T11 is turned on by the voltage of the third power source VREF supplied through the third power input terminal 206, and therefore, the voltage of the third power source VREF may be supplied to the third node PPN.

Meanwhile, the second clock signal CLK2 supplied through the third input terminal 203 at the first time t1 may have the high level H. As the twelfth transistor T12 is turned on by the voltage of the third node PPN, a voltage having the high level H may be supplied to the second electrode of the twelfth transistor T12 (or the first electrode of the third capacitor C3). Accordingly, the third capacitor C3 may store a voltage corresponding to a difference between the voltage having the high level H and the voltage of the third power source VREF.

Subsequently, at the second time t2, the second clock signal CLK2 having the low level L may be applied through the third input terminal 203. Accordingly, the voltage of the second electrode of the twelfth transistor T12 (or the first electrode of the third capacitor C3) is changed from the existing voltage having the high level H to a voltage having the low level L, and the voltage of the third node PPN becomes lower by a voltage variation of the first electrode of the third capacitor C3 (i.e., a difference between the voltage having the high level H and the voltage having the low level L) from the existing voltage level of the third power source VREF due to coupling of the third capacitor C3. The bias voltage Vbias having a voltage level lower than the voltage of the second power source VGL may be supplied to the output unit SST3 (e.g., the tenth transistor T10) of the first sub-stage circuit LB1 by the thirteenth transistor T13 turned on by the voltage of the third node PPN. Charges existing in the back-gate electrode of the tenth transistor T10 come out through the turned-on thirteenth transistor T13, and accordingly, the tenth transistor T10 implemented as the n-type transistor may be set to have a positive threshold voltage.

Meanwhile, since the first electrode of the fourth capacitor C4 is connected to the second power input terminal 205 to which the voltage of the second power source VGL as a constant voltage is supplied, the bias voltage Vbias corresponding to the second electrode of the fourth capacitor C4 can be stably maintained.

While such a process (e.g., a charge pumping process) is repeated, the stabilized bias voltage Vbias becomes lower than the voltage having the low level L (e.g., the voltage of the second power source VGL). Thus, in accordance with the embodiments of the present disclosure, it is unnecessary for the display device (1000 shown in FIG. 1) to include a separate voltage source. Hence, the display device (1000 shown in FIG. 1) is simplified, and it can be disadvantageous in terms of power consumption.

Hereinafter, a configuration in which the first stage ST1 supplies the first output signal OUT1 (or the first scan signal) through the first scan line SL1 will be described through an operation of the first sub-stage circuit LB1 at the third to eighth times t3 to t8.

At the third time t3, the start pulse SSP having the low level L may be supplied through the first input terminal 201. The start pulse SSP supplied to the first input terminal 201 may have the low level L until before the eighth time t8 (e.g., until an arbitrary time between the seventh time t7 and the eighth time t8) from the third time t3.

Subsequently, at the fourth time t4, the first clock signal CLK1 having the low level L (or gate-on level) may be supplied through the second input terminal 202, so that the first transistor T1 and the fifth transistor T5 are turned on.

When the first transistor T1 is turned on, the low level L of the start pulse SSP may be supplied to the input node NI. Meanwhile, since the gate electrode of the sixth transistor T6 is connected to the second power input terminal 205 to always maintain the turn-on state, the low level L of the start pulse SSP may be supplied to the first node Q. Accordingly, the voltage of the first node Q may be changed to the low level L.

In addition, when the fifth transistor T5 is turned on, the second power source VGL having the low level is supplied to the second node QB, and accordingly, the voltage of the second node QB maintains the low level L.

Subsequently, at the fifth time, the first clock signal CLK1 supplied to the second input terminal 202 may be changed from the low level L to the high level H. Accordingly, the first transistor T1 and the fifth transistor T5 may be turned off.

Meanwhile, since the voltage of the input node N1 is maintained at the low level L, the fourth transistor T4 may be in the turn-on state. Accordingly, the high level H of the first clock signal CLK1 may be supplied to the second node QB, so that the voltage of the second node QB is changed to the high level H.

Subsequently, at the sixth time t6, the second clock signal CLK2 having the low level L (or gate-on level) may be supplied through the third input terminal 203, so that the third transistor T3 is turned on.

Meanwhile, the eighth transistor T8 may maintain the turn-on state, based on the voltage of the first node Q, which has the low level L (or gate-on level). The low level L of the second clock signal CLK2 may be supplied to the output node QB_F through the eighth transistor T8, so that the voltage of the output node QB_F is changed from the existing high level H to the low level L. The voltage of the first node Q decreases from the low level L to the 2-low level 2L due to coupling of the second capacitor C2, and the eighth transistor T8 stably maintains the turn-on state.

In addition, based on the voltage of the output node QB_F, which has the low level L, the ninth transistor T9 of the output unit SST3 may be turned on and the tenth transistor T10 of the output unit SST3 may be turned off. Accordingly, the voltage of the first power source VGH, which have the high level H, is supplied to the first output terminal 207, so that the first output signal OUT1 can be output at the high level H.

Meanwhile, the first carry signal CR1 may be output at the low level L, corresponding to the voltage of the output node QB_F, which has the low level L.

Subsequently, at the seventh time t7, the second clock signal CLK2 supplied to the third input terminal 203 may be changed from the low level L to the high level H. The high level H of the second clock signal CLK2 may be supplied to the output node QB_F through the eighth transistor T8 in the turn-on state. Accordingly, based on the voltage of the output node QB_F, which has the high level H, the ninth transistor T9 of the output unit SST3 may be turned off and the tenth transistor T10 of the output unit SST3 may be turned on, so that the first output signal OUT1 having the low level L is output.

Meanwhile, the first carry signal CR1 may be output at the high level H, corresponding to the voltage of the output node QB_F, which has the high level H.

After the seventh time t7, the start pulse SSP may be changed from the low level L to the high level H.

At the eighth time t8, the first clock signal CLK1 having the low level L (or gate-on level) may be supplied through the second input terminal 202, so that the first transistor T1 and the fifth transistor T5 are turned on.

However, unlike the start pulse SSP at the fourth time t4, the start pulse SSP has the high level H, and hence the high level H of the start pulse SSP may be supplied to the first node Q through the sixth transistor T6 in the turn-on state. Therefore, the voltage of the first node Q may be changed to the high level H.

In addition, the voltage of the second power source VGL, which has the low level, may be supplied to the second node QB through the fifth transistor T5 in the turn-on state, so that the second node QB is changed to the low level L.

Meanwhile, as described above, since the stages (ST1 to ST4 shown in FIG. 2) included in the scan driver (200 shown in FIG. 2) have the substantially same configuration, except input signals received through the first input terminals 201 thereof, the other stages (e.g., the second to fourth stages ST2 to ST4 shown in FIG. 2) except the first stage ST1 can output output signals (e.g., OUT2 and OUT3) to the scan lines through an operation substantially identical to an operation of the first stage ST1.

FIG. 5 is a circuit diagram illustrating an example of the first stage included in the scan driver shown in FIG. 2. In FIG. 5, portions different from those of the above-described embodiment will be mainly described to avoid redundancy. Portions not particularly described in the embodiment shown in FIG. 5 follow those of the above-described embodiment. In addition, identical reference numerals refer to identical components, and similar reference numerals refer to similar components.

A first stage ST1_1 shown in FIG. 5 represents a modified embodiment of the first stage ST1 described with reference to FIG. 3.

Referring to FIGS. 3 and 5, the first stage ST1_1 shown in FIG. 5 may include the first sub-stage circuit LB1 and a first charge pump circuit CPB1_1. Meanwhile, the first state ST1_1 shown in FIG. 5 and the first stage ST1 shown in FIG. 3 are substantially identical or similar to each other, except a connection configuration of the eleventh transistor T11 and that the first stage ST1_1 further includes a fourteenth transistor T14, and therefore, overlapping descriptions will not be repeated.

The first charge pump circuit CPB1_1 of the first stage ST1_1 may receive the first clock signal CLK1 through the second input terminal 202, and receive the second clock signal CLK2 through the third input terminal 203. Also, the first charge pump circuit CPB_1 may be connected to the second power source VGL through the second power input terminal 205, and be connected to the third power source VREF through the third power input terminal 206.

In an embodiment, the first charge pump circuit CPB1_1 may generate a bias voltage Vbias, based on the first clock signal CLK1, the second clock signal CLK2, the voltage of the second power source VGL, and the voltage of the third power source VREF, and supply the bias voltage Vbias to the output unit SST3 (or the tenth transistor T10 of the output unit SST3).

To this end, the first charge pump circuit CPB1_1 may include eleventh to fourteenth transistors T11_1, T12, T13, and T14, the third capacitor C3, and the fourth capacitor C4.

The fourteenth transistor T14 may be connected between the third power input terminal 206 and the eleventh transistor T11_1. For example, the fourteenth transistor T14 may include a first electrode connected to the third power input terminal 206 and a second electrode connected to the eleventh transistor T11_1. Also, the fourteenth transistor T14 may include a gate electrode connected to the second input terminal 202. The fourteenth transistor T14 may be turned on or turned off based on a signal level of the first clock signal CLK1.

The eleventh transistor T11_1 may be connected between the second electrode of the fourteenth transistor T14 and the third node PPN. The eleventh transistor T11_1 may include a gate electrode connected to the second power input terminal 205. Since the voltage of the second power source VGL, which has the low level (or gate-on level), is supplied to the gate electrode of the eleventh transistor T11_1 through the second power input terminal 205, the eleventh transistor T11_1 may always maintain the turn-on state. Accordingly, when the fourteenth transistor T14 is turned on by receiving the first clock signal CLK1 have the gate-on level (e.g., the low level), the voltage of the third power source VREF may be supplied to the third node PPN.

For example, further referring to FIG. 4, when the first clock signal CLK1 having the low level L is supplied through the second input terminal 202 at the first time t1, the fourth transistor T14 may be turned on based to the first clock signal CLK1.

The eleventh transistor T11_1 always maintains the turn-on state by the voltage of the second power source VGL supplied through the second power input terminal 205, and therefore, the voltage of the third power source VREF may be supplied to the third node PPN at the first time t1.

FIG. 6 is a circuit diagram illustrating an example of the first stage included in the scan driver shown in FIG. 2. In FIG. 6, portions different from those of the above-described embodiment will be mainly described to avoid redundancy. Portions not particularly described in the embodiment shown in FIG. 6 follow those of the above-described embodiment. In addition, identical reference numerals refer to identical components, and similar reference numerals refer to similar components.

A first stage ST1_2 shown in FIG. 6 represents a modified embodiment of the first stage ST1_1 described with reference to FIG. 6.

Referring to FIGS. 5 and 6, the first stage ST1_2 shown in FIG. 6 may include a first sub-stage circuit LB1_1 and a first charge pump circuit CPB1_2.

In an embodiment, a first transistor T1_1 included in the first sub-stage circuit LB1_1 or a fourteenth transistor T14_1 included in the first charge pump circuit CPB1_2 may include a plurality of sub-transistors connected in series to each other.

For example, the first transistor T1_1 may include first and second sub-transistors T1*a* and T1*b* connected in series to each other. Each of the first and second sub-transistors T1*a* and T1*b* may include a gate electrode commonly connected to the second input terminal 202 (e.g., referred to as a dual gate structure). Accordingly, current leakage caused by the first transistor T1_1 can be minimized.

In another example, the fourteenth transistor T14_1 may include third and fourth sub-transistors T14*a* and T14*b* connected in series to each other. Each of the third and fourth sub-transistors T14*a* and T14*b* may include a gate electrode commonly connected to the second input terminal 202. Accordingly, current leakage caused by the fourteenth transistor T14_1 can be minimized.

However, this is merely illustrative, and at least one of the other transistors in addition to the first transistor T1_1 and the fourteenth transistor T14_1 may have a dual gate structure.

FIG. 7 is a circuit diagram illustrating an example of the first stage included in the scan driver shown in FIG. 2. FIG. 8 is a circuit diagram illustrating an example of the first stage included in the scan driver shown in FIG. 2. In FIGS. 7 and 8, portions different from those of the above-described embodiment will be mainly described to avoid redundancy. Portions not particularly described in the embodiment shown in FIGS. 7 and 8 follow those of the above-described embodiment. In addition, identical reference numerals refer to identical components, and similar reference numerals refer to similar components.

Each of first stages ST1_3 and ST1_4 shown in FIGS. 7 and 8 represents a modified embodiment of the first stage ST1_1 described with reference to FIG. 5.

Referring to FIGS. 5, 7, and 8, the first stage ST1_3 shown in FIG. 7 may include the first sub-stage circuit LB1 and a first charge pump circuit CPB1_3, and the first stage ST1_4 shown in FIG. 8 may include the first sub-stage circuit LB1 and a first charge pump circuit CPB1_4.

As described with reference to FIGS. 3 to 5, it is necessary for the first electrode of the fourth capacitor C4 to be connected to a constant voltage such that the fourth capacitor C4 included in the first charge pump circuit CPB1 allows the bias voltage Vbias to be stably maintained.

For example, as shown in FIG. 7, a fourth capacitor C4_1 may be connected between the first power input terminal 204 and the second electrode of the thirteenth transistor T13. That is, a first electrode of the fourth capacitor C4_1 may be connected to the first power input terminal 204 to which the first power source VGH as a constant voltage is supplied.

In another example, as shown in FIG. 8, a fourth capacitor C4_2 may be connected between the third power input terminal 206 and the second electrode of the thirteenth transistor T13. That is, a first electrode of the fourth capacitor C4_2 may be connected to the third power input terminal 206 to which the third power source VREF as a constant voltage is supplied.

FIG. 9 is a circuit diagram illustrating an example of the first stage included in the scan driver shown in FIG. 2. In FIG. 9, portions different from those of the above-described embodiment will be mainly described to avoid redundancy. Portions not particularly described in the embodiment shown in FIG. 9 follow those of the above-described embodiment. In addition, identical reference numerals refer to identical components, and similar reference numerals refer to similar components.

A first stage ST1_5 shown in FIG. 9 represents a modified embodiment of the first stage ST1_1 described with reference to FIG. 5.

Referring to FIGS. 5 and 9, the first stage ST1_5 shown in FIG. 9 may include the first sub-stage LB1 and a first charge pump circuit CPB1_5. Meanwhile, the first stage ST1_5 shown in FIG. 9 and the first stage ST1_1 shown in FIG. 5 are substantially identical or similar to each other, except that the first stage ST1_5 further includes a fifteenth transistor T15, and therefore, overlapping descriptions will not be repeated.

The first charge pump circuit CPB1_5 may include eleventh to fifteenth transistors T11_1 and T12 to T15, the third capacitor C3, and the fourth capacitor C4.

The fifteenth transistor T15 may be connected between the third node PPN and the thirteenth transistor T13 (e.g., the first electrode of the thirteenth transistor T13), and include a gate electrode connected to the third node PPN. Accordingly, the fifteenth transistor T15 may operate substantially identical to the thirteenth transistor T13 described with reference to FIGS. 4 and 5.

FIG. 10 is a block diagram illustrating a scan driver (gate driver) in accordance with embodiments of the present disclosure. In FIG. 10, portions different from those of the above-described embodiment will be mainly described to avoid redundancy. Portions not particularly described in the embodiment shown in FIG. 10 follow those of the above-described embodiment. In addition, identical reference numerals refer to identical components, and similar reference numerals refer to similar components.

A scan driver 200_1 shown in FIG. 10 represents a modified embodiment of the scan driver 200 described with reference to FIG. 2.

Referring to FIGS. 2 and 10, the scan driver 200_1 shown in FIG. 10 may include a plurality of sub-stage circuits LB1_2 to LB4_2. The sub-stage circuits LB1_2 to LB4_2 may be substantially identical to a sub-stage circuit (e.g., the first sub-stage circuit LB1) included in each of the stages ST1 to ST4 described with reference to FIGS. 2 and 3.

For example, the sub-stage circuits LB1_2 to LB4_2 shown in FIG. 10 may have the substantially same configuration, and be dependently connected to each other.

Also, each of the sub-stage circuits LB1_2 to LB4_2 may include a first input terminal 201 receiving an input signal (e.g., the start pulse SSP or a previous carry signal), a second input terminal 202 receiving the first clock signal CLK1, a third input terminal 203 receiving the second clock signal CLK2, a first power input terminal 204 to which the voltage of the first power source VGH is applied, and a second power input terminal 205 to which the voltage of the second power source VGL is applied.

Also, each of the sub-stage circuits LB1_2 to LB4_2 may include a first output terminal 207 and a second output terminal 208. The output signals OUT1 to OUT4 may be output to first output terminals 207 of the respective sub-stage circuits LB1_2 to LB4_2, and the carry signals CR1 to CR4 may be output to second output terminals 208 of the respective sub-stage circuits LB1_2 to LB4_2.

In some embodiments, each of the sub-stage circuits LB1_2 to LB4_2 may further include a fourth input terminal 209. Each of the sub-stage circuits LB1_2 to LB4_2 may be supplied with a bias voltage Vbias from a corresponding charge pump circuit through the fourth input terminal 209.

In addition, the scan driver 200_1 shown in FIG. 10 may include a plurality of charge pump circuits CPB1_6 and CPB2_6. The charge pump circuits CPB1_6 and CPB2_6 may be substantially identical to a charge pump circuit (e.g., the first charge pump circuit CPB1) included in each of the stages ST1 to ST4 described with reference to FIGS. 2 and 3.

For example, each of the charge pump circuits CPB1_6 and CPB2_6 may include a fourth power input terminal 301, a sixth input terminal 302, a seventh input terminal 303, and a third output terminal 304.

The voltage of the third power source VREF may be applied to the fourth power input terminal 301 of each of the charge pump circuits CPB1_6 and CPB2_6. In addition, the sixth input terminal 302 of each of the charge pump circuits CPB1_6 and CPB2_6 may receive the first clock signal CLK1, the seventh input terminal 303 of each of the charge pump circuits CPB1_6 and CPB2_6 may receive the second clock signal CLK2.

Each of the charge pump circuits CPB1_6 and CPB2_6 may generate the bias voltage Vbias, based on the first and second clock signals CLK1 and CLK2 and the third power source VREF.

In an embodiment, at least some of the sub-stage circuits LB1_2 to LB4_2 may share one charge pump circuit.

For example, first and second sub-stage circuits LB1_2 and LB2_2 may share a first charge pump circuit CPB1_6. A fourth input terminal 209 of each of the first and second sub-stage circuits LB1_2 and LB2_2 may be connected to a third output terminal 304 of the first charge pump circuit CPB1_6 to be supplied with the bias voltage Vbias.

In another example, third and fourth sub-stage circuits LB3_2 and LB4_2 may share a second charge pump circuit CPB2_6. A fourth input terminal 209 of each of the third and fourth sub-stage circuits LB3_2 and LB4_2 may be connected to a third output terminal 304 of the second charge pump circuit CPB2_6 to be supplied with the bias voltage Vbias.

Since the number of charge pump circuits CPB1_6 and CPB2_6 included in the scan driver 200_1 decreases, a circuit area decreases, and it can be advantageous in terms of power consumption.

Meanwhile, although a case where two sub-stage circuits share one charge pump circuit is illustrated in FIG. 10, this is merely illustrative, and the embodiment of the present disclosure is not limited thereto. For example, three or more sub-stage circuits may share one charge pump circuit.

FIG. 11 is a block diagram illustrating a scan driver (gate driver) in accordance with embodiments of the present disclosure. In FIG. 11, portions different from those of the above-described embodiment will be mainly described to avoid redundancy. Portions not particularly described in the embodiment shown in FIG. 11 follow those of the above-described embodiment. In addition, identical reference numerals refer to identical components, and similar reference numerals refer to similar components.

A scan driver 200_2 shown in FIG. 11 represents a modified embodiment of the scan driver 200 described with reference to FIG. 2.

Referring to FIGS. 2 and 11, the scan driver 200_2 may include a plurality of stages ST1_6 to ST4_6.

In an embodiment, each of the stages ST1_6 to ST4_6 may further a fifth input terminal 210. A third clock signal CLK3 and a fourth clock signal CLK4 may be alternately provided to fifth input terminals 210 of the stages ST1_6 to ST4_6.

For example, a fifth input terminal 210 of a kth (k is an integer greater than 0) may receive the fourth clock signal CLK4, and a fifth input terminal 210 of a (k+1)th stage may receive the third clock signal CLK3.

In an example, each of fifth input terminals 210 of a first stage ST1_6 and a third stage ST3_6 may receive the fourth clock signal CLK4, and each of fifth input terminals 210 of a second stage ST2_6 and a fourth stage ST4_6 may receive the third clock signal CLK3.

The third clock signal CLK3 and the fourth clock signal CLK4 may have the same cycle, and have waveforms of which phases do not overlap with each other. In an example, the fourth clock signal CLK4 may be set as a signal shifted by about a half cycle from the third clock signal CLK3.

In an embodiment, each of the stages ST1_6 to ST4_6 may include a first sub-output terminal 207*a* and a second sub-output terminal 207*b*.

First sub-output signals OUT1*a* to OUT4*a* may be output to first sub-output terminals 207*a* of the respective stages ST1_6 to ST4_6. The first sub-output signals OUT1*a* to OUT4*a* output to the first sub-output terminals 207*a* may have the substantially same configuration as the output signals OUT1 to OUT4 output to the first output terminals 207 described with reference to FIGS. 2 to 4.

Second sub-output signals OUT1*b* to OUT4*b* may be output to second sub-output terminals 207*b* of the respective stages ST1_6 to ST4_6.

In some embodiments, the first sub-output signals OUT1*a* to OUT4*a* and the second sub-output signals OUT1*b* to OUT4*b* may have different pulses. For example, each of the first sub-output signals OUT1*a* to OUT4*a* substantially identical or similar to the output signals OUT1 to OUT4 described with reference to FIGS. 2 to 4 may correspond to a signal (i.e., a scan signal) having a pulse of a high level, and each of the second sub-output signals OUT1*b* to OUT4*b* may correspond to a signal (i.e., a scan signal) having a pulse of a low level.

That is, each of the stages ST1_6 to ST4_6 included in the scan driver 200_2 may output both the scan signal having the pulse of the high level (e.g., the first sub-output signals OUT1*a* to OUT4*a*) and the scan signal having the pulse of the low level (e.g., the second sub-output signals OUT1*b* to OUT4*b*).

Meanwhile, it is necessary for switching transistors which are included in the pixel PX (see FIG. 1) and receive a scan signal to receive the scan signal having the pulse of the high level or the scan signal having the pulse of the low level according to types thereof. It is necessary for a plurality of switching transistors included in one pixel PX (see FIG. 1) to receive scan signals having different pulses according to a circuit structure of the pixel PX (see FIG. 1).

The scan driver 200_2 in accordance with the embodiments of the present disclosure may include the stages ST1_6 to ST4_6, each of which outputs both the scan signal having the pulse of the high level (e.g., the first sub-output signals OUT1*a* to OUT4*a*) and the scan signal having the pulse of the low level (e.g., the second sub-output signals OUT1*b* to OUT4*b*). Thus, a circuit area in the scan driver can be decreased, as compared with a case where the scan driver includes stages for outputting the scan signal having the pulse of the high level and stages for outputting the scan signal having the pulse of the low level.

In an embodiment, the scan driver 200_2 (or the stages ST1_6 to ST4_6) may be driven in a first driving period and a second driving period according to driving conditions of the display device 1000 (see FIG. 1).

For example, the stages ST1_6 to ST4_6 may output the first sub-output signals OUT1*a* to OUT4*a* having the pulse of the high level in the first driving period, and output the first sub-output signals OUT1*a* to OUT4*a* which do not the pulse of the high level and are maintained at the low level in the second driving period.

As described with reference to FIG. 1, the display device 1000 (see FIG. 1) may display an image at various driving frequencies (image refresh rates, or screen refresh rates) according to driving conditions thereof. The pixel PX (see FIG. 1) included in the display device 1000 (see FIG. 1) may receive both the scan signal having the pulse of the high level and the scan signal have the pulse of the low level or receive only the scan signal having the pulse of the low level according to driving conditions thereof. For example, in the first driving period, the pixel PX (see FIG. 1) may receive both the scan signal having the pulse of the high level and the scan signal have the pulse of the low level. Also, in the second driving period, the pixel PX (see FIG. 1) may receive only the scan signal having the pulse of the low level.

A configuration of the stages ST1_6 to ST4_6 included in the scan driver 200_2 and an operation of the stages ST1_6 to ST4_6 in the first driving period and the second driving period will be described with reference to FIGS. 12 to 14.

FIG. 12 is a circuit diagram illustrating an example of the first stage included in the scan driver shown in FIG. 11. In FIG. 12, portions different from those of the above-described embodiment will be mainly described to avoid redundancy. Portions not particularly described in the embodiment shown in FIG. 12 follow those of the above-described embodiment. In addition, identical reference numerals refer to identical components, and similar reference numerals refer to similar components.

Meanwhile, the first stage ST1_6 shown in FIG. 12 is substantially identical or similar to the first stage ST1 shown in FIG. 3, except that the first stage ST1_6 receives the fourth clock signal CLK4 through a fifth input terminal 210, further includes sixteenth and seventeenth transistors T16 and T17, and outputs a (2-1)th sub-output signal OUT1*b* through a (2-1)th sub-output terminal 207*b* and that the second output terminal 208 is connected to the same node as a node to which the (2-1)th output terminal 207*b* is connected. Therefore, overlapping descriptions will not be repeated.

Referring to FIGS. 3, 11, and 12, the first stage ST1_6 may include a first sub-stage circuit LB1_3 and the first charge pump circuit CPB1.

The first sub-stage circuit LB1_3 may receive the fourth clock signal CLK4 through the fifth input terminal 210.

The first sub-stage circuit LB1_3 may include the first driver SST1, the second driver SST2, and an output unit SST3_1. The output unit SST3_1 may include a first sub-output unit SST3*a* and a second sub-output unit SST3*b*.

Meanwhile, the first sub-output unit SST3*a* may have the substantially same configuration as the output unit SST3 described with reference to FIG. 3, except that the first sub-output unit SST3*a* outputs a (1-1)th sub-output signal OUT1*a* as a scan signal to a (1-1)th sub-scan line SL1*a* through a (1-1)th sub-output terminal 207*a*.

The second sub-output unit SST3*b* may be connected to the first node Q and the second node QB, receive the voltage of the first power source VGH through the first power input terminal 204, and receive the second clock signal CLK2 through the third input terminal 203.

The second sub-output unit SST3*b* may output the (2-1)th sub-output signal OUT1*b*, based on the voltages of the first node Q1 and the second node QB. For example, the voltage of the first power source VGH may correspond to a high level of the (2-1)th sub-output signal OUT1*b*, and the low level of the second clock signal CLK2 may correspond to a low level of the (2-1)th sub-output signal OUT1*b*. The (2-1)th sub-output signal OUT1*b* may be provided as a scan signal to a (2-1)th sub-scan line SL1*b* through the (2-1)th output terminal 207*b*.

To this end, the second sub-output unit SST3*b* may include the sixteenth transistor T16 and the seventeenth transistor T17.

The sixteenth transistor T16 may be connected between the first power input terminal 204 and the (2-1)th sub-output terminal 207*b*, and include a gate electrode connected to the second node QB. The sixteenth transistor T16 may be turned on or turned off based on the voltage of the second node QB. When the sixteenth transistor T16 are turned on, the (2-1)th sub-output signal OUT1*b* supplied to the (2-1)th sub-output terminal 207*b* may have a high level (e.g., a gate-off voltage level of a p-type transistor).

The seventeenth transistor T17 may be connected between the third input terminal 203 and the (2-1)th sub-output terminal 207*b*, and include a gate electrode connected to the first node Q. The seventeenth transistor T17 may be turned on or turned off based on the voltage of the first node Q.

In an embodiment, when the seventeenth transistor T17 is turned on, the (2-1)th sub-output signal OUT1*b* supplied to the (2-1)th sub-output terminal 207*b* may have a low level (e.g., a gate-on voltage level of the p-type transistor), based on the second clock signal CLK2 having the low level, which is supplied to the third input terminal 203.

Hereinafter, an operation of the first stage ST1_6 in the first driving period will be described in detail with reference to FIG. 13, and an operation of the first stage ST1_6 in the second driving period will be described in detail with reference to FIG. 14.

FIG. 13 is a timing diagram illustrating an example of driving of the first stage shown in FIG. 12. FIG. 14 is a timing diagram illustrating an example of the driving of the first stage shown in FIG. 12.

Meanwhile, a timing diagram for describing driving of the first stage ST1_6 in a first driving period DSP1 is illustrated in FIG. 13, and a timing diagram for describing driving of the first stage ST1_6 in a second driving period DSP2 is illustrated in FIG. 14.

First, the first driving period DSP1 will be described with reference to FIGS. 3, 4, and 11 to 13. In the first driving period DSP1, the third clock signal CLK3 and the fourth clock signal CLK4 may be supplied at different timings. For example, the fourth clock signal CLK4 may be set as a signal shifted by a half cycle (e.g., one horizontal period) from the third clock signal CLK3.

In some embodiments, in the first driving period DSP1, the third clock signal CLK3 may have the substantially same waveform as the first clock signal CLK1, and the fourth clock signal CLK4 may have the substantially same waveform as the second clock signal CLK2.

Meanwhile, the first driver SST1, the second driver SST2, and the first sub-output unit SST3*a* of the first stage ST1_6 are substantially identical to the first driver SST1, the second driver SST2, and the output unit SST3 of the first stage ST1 described with reference to FIG. 3, except that the first electrode of the eighth transistor T8 is connected to the fifth input terminal 210 to which the fourth clock signal CLK4 is supplied. As described above, the fourth clock signal CLK4 and the second clock signal CLK2 have the substantially same waveform in the first driving period DSP1. Hence, in (1-1)th to (1-8)th times t1*a* to t8*a* of the first driving period DSP1, operations of the first driver SST1, the second driver SST2, and the first sub-output unit SST3*a* of the first stage ST1_6 are substantially identical or similar to operations of the first driver SST1, the second driver SST2, and the output unit SST3 of the first stage ST1 described with reference to FIGS. 3 and 4, and therefore, overlapping descriptions will not be repeated.

The seventeenth transistor T17 of the second sub-output unit SST3*b* may be turned on when the voltage of the first node Q has the low level L or the 2-low level 2L, and the sixteenth transistor T16 of the second sub-output unit SST3*b* may be turned on when the voltage of the second node QB has the low level L.

In a period in which the voltage of the second node QB has the low level L (e.g., a period from a time at which the first driving period DSP1 is started to a (1-5)th time t5*a* and a period from a (1-8)th time t8*a* to a time at which the first driving period DSP1 is ended), the sixteenth transistor T16 maintains the turn-on state. Therefore, the voltage of the first power source VGH, which has the high level, may be supplied to the (2-1)th sub-output terminal 207*b*, so that the (2-1)th sub-output signal OUT1*b* is output at the high level H.

Also, in a period in which the voltage of the first node Q has the low level L (e.g., a period from a (1-4)th time t4*a* to the (1-8)th time t8*a*), the seventeenth transistor T17 may maintain the turn-on state. A first electrode of the seventeenth transistor T17 is supplied to the third input terminal 203 to which the second clock signal CLK2 is supplied. Therefore, in a period in which the second clock signal CLK2 has the low level L during the period in which the seventeenth transistor T17 is turned on, the low level L of the second clock signal CLK2 may be supplied to the (2-1)th sub-output terminal 207*b*, so that the (2-1)th sub-output signal OUT1*b* is output at the low level L. For example, in a period from a (1-6)th time t6*a* to a (1-7)th time t7*a*, the (2-1)th sub-output signal OUT1*b* having the low level L may be output.

Meanwhile, the first carry signal CR1 may be output at the low level L, corresponding to the (2-1)th sub-output signal OUT1*b* having the low level L. That is, the second output terminal 208 is connected to the same node as the (2-1)th sub-output terminal 207*b*, and therefore, the first carry signal CR1 may have a pulse of the low level L at the same time (or period) as the (2-1)th sub-output signal OUT1*b*.

Next, the second driving period DSP2 will be described with reference to FIGS. 3, 4, 11, 12, and 14. In the second driving period DSP2, the third clock signal CLK3 and the fourth clock signal CLK4 may be maintained at the high level H.

Although the eighth transistor T8 is turned on in a period in which the voltage of the first node Q has the low level L or the 2-low level 2L, the first electrode of the eighth transistor T8 is connected to the fifth input terminal 210 to which the fourth clock signal CLK4 maintained at the high level H is supplied, and hence the voltage of the output node QB_F may be always maintained at the high level H. Therefore, in the second driving period DSP2, the ninth transistor T9 maintains a turn-off state and the tenth transistor T10 maintains the turn-on state. Accordingly, in the second driving period DSP2, the (1-1)th sub-output signal OUT1*a* output to the (1-1)th sub-output terminal 207*a* does not any pulse of the high level, and may have a waveform maintained at the low level.

Meanwhile, an operation in which the second sub-output unit SST3*b* outputs the (2-1)th sub-output signal OUT1*b* in the second driving period DSP2 is substantially identical or similar to the operation in which the second sub-output unit SST3*b* outputs the (2-1)th sub-output signal OUT1*b*, and therefore, overlapping descriptions will not be repeated.

FIG. 15 is a block diagram illustrating a scan driver (gate driver) in accordance with embodiments of the present disclosure. FIGS. 16A and 16B are diagrams illustrating a voltage level of a fourth power source applied to stages included in the scan driver shown in FIG. 15.

In FIG. 15, portions different from those of the above-described embodiment will be mainly described to avoid redundancy. Portions not particularly described in the embodiment shown in FIG. 15 follow those of the above-described embodiment. In addition, identical reference numerals refer to identical components, and similar reference numerals refer to similar components.

A scan driver 200_3 shown in FIG. 15 represents a modified embodiment of the scan driver 200 described with reference to FIG. 2.

Referring to FIGS. 2 and 15, the scan driver 200_3 may include a plurality of stages ST1_7 to ST4_7.

In an embodiment, each of the stages ST1_7 to ST4_7 may further include a fifth power input terminal 211. A voltage of a fourth power source BVGL may be applied to fifth power input terminals 211 of the stages ST1_7 to ST4_7.

In an embodiment, a voltage level of the fourth power source BVGL may vary according to a mode of the scan driver 200_3. For example, the fourth power source BVGL may have the same voltage level as the second power source VGL in a first mode of the scan driver 200_3, and have the same voltage level as the first power source VGH in a second mode of the scan driver 200_3.

For example, further referring to FIGS. 16A and 16B, the fourth power source BVGL may have a voltage level as the low level L in the first mode of the scan driver 200_3, and have a voltage level as the high level H in the second mode of the scan driver 200_3.

Meanwhile, the first mode of the scan driver 200_3 may be a driving mode in which the scan driver 200_3 normally outputs output signals OUT1 to OUT4 (or scan signals). That is, in the first mode, the scan driver 200_3 may sequentially output the output signals OUT1 to OUT4 (or scan signals) having a pulse of the high level to the scan lines SL1 to SLn, based on the voltage of the fourth power source BVGL, which has a voltage level as the low level L.

In addition, the second mode of the scan driver 200_3 may be a mode for evaluating whether the scan driver 200_3 normally outputs the output signals OUT1 to OUT4 (or scan signals) having a pulse of the high level H. For example, in order to evaluate whether the pulse of the high level H of the output signals OUT1 to OUT4 output by the scan driver 200_3 is normally output, it is necessary to control the scan driver 200_3 to output the output signals OUT1 to OUT4 (or scan signals) maintained at the high level H in the second mode. To this end, the fourth power source BVGL may have a voltage level as high level H in the second mode of the scan driver 200_3. A case where the stages ST1_7 to ST4_7 of the scan driver 200_3 output the output signals OUT1 to OUT4 (or scan signals) maintained at the high level H, based on the fourth power source BVGL having a voltage level as the high level H, will be described with reference to FIGS. 17 to 22.

FIG. 17 is a circuit diagram illustrating an example of a first stage included in the scan driver shown in FIG. 15. In FIG. 17, portions different from those of the above-described embodiment will be mainly described to avoid redundancy. Portions not particularly described in the embodiment shown in FIG. 17 follow those of the above-described embodiment. In addition, identical reference numerals refer to identical components, and similar reference numerals refer to similar components.

Referring to FIGS. 3, 15, 16A, 16B, and 17, a first stage ST1_7*a* shown in FIG. 17 is substantially identical or similar to the first stage ST1 shown in FIG. 3, except that a tenth transistor T10_1 included in an output unit SST3_2*a* of the first stage ST1_7*a* is connected between the first output terminal 207 and the fifth power input terminal 211, and therefore, overlapping descriptions will not be repeated.

In an embodiment, the first stage ST1_7*a* may include a first sub-stage circuit LB1_4*a* and the first charge pump circuit CPB1.

In an embodiment, the tenth transistor T10_1 included in the output unit SST3_2*a* of the first sub-stage circuit LB1_4*a* may be connected between the first output terminal 207 and the fifth power input terminal 211.

As described with reference to FIGS. 15, 16A, and 16B, the first stage ST1_7*a* may output the first output signal OUT1 having a pulse of the high level H to the first scan line SL1 through the first output terminal 207 in the first mode, and output the first output signal OUT1 maintained at the high level H to the first output terminal 207 in the second mode.

For example, since the voltage of the fourth power source BVGL, which has the low level L, is applied to the fifth power input terminal 211 in the first mode, an operation of the first stage ST1_7*a* (or the first sub-stage circuit LB1_4*a*) in the first mode may be substantially identical to the operation of the first stage ST1 (or the first sub-stage circuit LB1) described with reference to FIGS. 3 and 4. In an example, in the first mode, the first stage ST1_7*a* may output the first output signal OUT1 having a pulse of the high level H to the first scan line SL1 through the first output terminal 207.

In an example, in the second mode, the voltage of the fourth power source BVGL, which has the low level L, may be applied to the fifth power input terminal 211. One electrode of the tenth transistor T10_1 which performs a full-down function of the output unit SST3_2*a* is connected to the fifth power input terminal 211, and therefore, a voltage of a node to which the first output terminal 207 is connected may be maintained at the high level H in the second mode. Accordingly, in the second mode, the voltage level of the first output signal OUT1 output to the first scan line SL1 through the first output terminal 207 may be maintained at the high level H.

FIG. 18 is a circuit diagram illustrating an example of the first stage included in the scan driver shown in FIG. 15. In FIG. 18, portions different from those of the above-described embodiment will be mainly described to avoid redundancy. Portions not particularly described in the embodiment shown in FIG. 18 follow those of the above-described embodiment. In addition, identical reference numerals refer to identical components, and similar reference numerals refer to similar components.

Referring to FIGS. 5, 15, 16A, 16B, and 18, a first stage ST1_7*b* shown in FIG. 18 is substantially identical or similar to the first stage ST1_1 shown in FIG. 5, except that the tenth transistor T10_1 included in an output unit SST3_2*b* of the first stage ST1_7*b* is connected between the first output terminal 207 and the fifth power input terminal 211, and therefore, overlapping descriptions will not be repeated.

In an embodiment, the first stage ST1_7B may include a first sub-stage circuit LB1_4*b* and the first charge pump circuit CPB1_1.

In an embodiment, the tenth transistor T10_1 included in the output unit SST3_2*b* of the first sub-stage circuit LB1_4*b* may be connected between the first output terminal 207 and the fifth power input terminal 211.

As described with reference to FIGS. 15, 16A, 16B, and 17, the tenth transistor T10_1 is connected between the first output terminal 207 and the fifth power input terminal 211. Hence, the first stage ST1_7*b* shown in FIG. 18 may output the first output signal OUT1 having a pulse of the high level H to the first scan line SL1 through the first output terminal 207 in the first mode, and output the first output signal OUT1 maintained at the high level H to the first scan line SL1 through the first output terminal 207 in the second mode.

FIG. 19 is a circuit diagram illustrating an example of the first stage included in the scan driver shown in FIG. 15. In FIG. 19, portions different from those of the above-described embodiment will be mainly described to avoid redundancy. Portions not particularly described in the embodiment shown in FIG. 19 follow those of the above-described embodiment. In addition, identical reference numerals refer to identical components, and similar reference numerals refer to similar components.

Referring to FIGS. 6, 15, 16A, 16B, and 19, a first stage ST1_7*c* shown in FIG. 19 is substantially identical or similar to the first stage ST1_2 shown in FIG. 6, except that the tenth transistor T10_1 included in an output unit SST3_2*c* of the first stage ST1_7*c* is connected between the first output terminal 207 and the fifth power input terminal 211, and therefore, overlapping descriptions will not be repeated.

In an embodiment, the first stage ST1_7*c* may include a first sub-stage circuit LB1_4*c* and the charge pump circuit CPB1_2.

In an embodiment, the tenth transistor T10_1 included in the output unit SST3_2*c* of the first sub-stage circuit LB1_4*c* may be connected between the first output terminal 207 and the fifth power input terminal 211.

As described with reference to FIGS. 15, 16A, 16B, and 17, the tenth transistor T10_1 is connected between the first output terminal 207 and the fifth power input terminal 211. Hence, the first stage ST1_7*c* shown in FIG. 19 may output the first output signal OUT1 having a pulse of the high level H to the first scan line SL1 through the first output terminal 207 in the first mode, and output the first output signal OUT1 maintained at the high level H to the first scan line SL1 through the first output terminal 207 in the second mode.

FIG. 20 is a circuit diagram illustrating an example of the first stage included in the scan driver shown in FIG. 15. In FIG. 20, portions different from those of the above-described embodiment will be mainly described to avoid redundancy. Portions not particularly described in the embodiment shown in FIG. 20 follow those of the above-described embodiment. In addition, identical reference numerals refer to identical components, and similar reference numerals refer to similar components.

Referring to FIGS. 7, 15, 16A, 16B, and 20, a first stage ST1_7*d* shown in FIG. 20 is substantially identical or similar to the first stage ST1_3 shown in FIG. 7, except that the tenth transistor T10_1 included in an output unit SST3_2*d* of the first stage ST1_7*d* is connected between the first output terminal 207 and the fifth power input terminal 211, and therefore, overlapping descriptions will not be repeated.

In an embodiment, the first stage ST1_7*d* may include a first sub-stage circuit LB1_41 and the first charge pump circuit CPB1_3.

In an embodiment, the tenth transistor T10_1 included in the output unit SST3_2*d* of the first sub-stage circuit LB1_4*d* may be connected between the first output terminal 207 and the fifth power input terminal 211.

As described with reference to FIGS. 15, 16A, 16B, and 17, the tenth transistor T10_1 is connected between the first output terminal 207 and the fifth power input terminal 211. Hence, the first stage ST1_7*d* shown in FIG. 20 may output the first output signal OUT1 having a pulse of the high level H to the first scan line SL1 through the first output terminal 207 in the first mode, and output the first output signal OUT1 maintained at the high level H to the first scan line SL1 through the first output terminal 207 in the second mode.

FIG. 21 is a circuit diagram illustrating an example of the first stage included in the scan driver shown in FIG. 15. In FIG. 21, portions different from those of the above-described embodiment will be mainly described to avoid redundancy. Portions not particularly described in the embodiment shown in FIG. 21 follow those of the above-described embodiment. In addition, identical reference numerals refer to identical components, and similar reference numerals refer to similar components.

Referring to FIGS. 8, 15, 16A, 16B, and 21, a first stage ST1_7*e* shown in FIG. 21 is substantially identical or similar to the first stage ST1_4 shown in FIG. 8, except that the tenth transistor T10_1 included in an output unit SST3_2*e* of the first stage ST1_7*e* is connected between the first output terminal 207 and the fifth power input terminal 211, and therefore, overlapping descriptions will not be repeated.

In an embodiment, the first stage ST1_7*e* may include a first sub-stage circuit LB1_4*e* and the first charge pump circuit CPB1_4.

In an embodiment, the tenth transistor T10_1 included in the output unit SST3_2*e* of the first sub-stage circuit LB1_4*e* may be connected between the first output terminal 207 and the fifth power input terminal 211.

As described with reference to FIGS. 15, 16A, 16B, and 17, the tenth transistor T10_1 is connected between the first output terminal 207 and the fifth power input terminal 211. Hence, the first stage ST1_7*e* shown in FIG. 21 may output the first output signal OUT1 having a pulse of the high level H to the first scan line SL1 through the first output terminal 207 in the first mode, and output the first output signal OUT1 maintained at the high level H to the first scan line SL1 through the first output terminal 207 in the second mode.

FIG. 22 is a circuit diagram illustrating an example of the first stage included in the scan driver shown in FIG. 15. In FIG. 22, portions different from those of the above-described embodiment will be mainly described to avoid redundancy. Portions not particularly described in the embodiment shown in FIG. 22 follow those of the above-described embodiment. In addition, identical reference numerals refer to identical components, and similar reference numerals refer to similar components.

Referring to FIGS. 9 and 22, a first stage ST1_7*f* shown in FIG. 22 is substantially identical or similar to the first stage ST1_5 shown in FIG. 9, except the tenth transistor T10_1 included in an output unit SST3_2*f* of the first stage ST1_7*f* is connected between the first output terminal 207 and the fifth power input terminal 211, and therefore, overlapping descriptions will not be repeated.

In an embodiment, the first stage ST1_7*f* may include a first sub-stage circuit LB1_4*f* and the first charge pump circuit CPB1_5.

In an embodiment, the tenth transistor T10_1 included in the output unit SST3_2*f* of the first sub-stage circuit LB1_4*f* may be connected between the first output terminal 207 and the fifth power input terminal 211.

As described with reference to FIGS. 15, 16A, 16B, and 17, the tenth transistor T10_1 is connected between the first output terminal 207 and the fifth power input terminal 211. Hence, the first stage ST1_7*f* shown in FIG. 22 may output the first output signal OUT1 having a pulse of the high level H to the first scan line SL1 through the first output terminal 207 in the first mode, and output the first output signal OUT1 maintained at the high level H to the first scan line SL1 through the first output terminal 207 in the second mode.

FIG. 23 is a block diagram illustrating a scan driver (gate driver) in accordance with embodiments of the present disclosure. In FIG. 23, portions different from those of the above-described embodiment will be mainly described to avoid redundancy. Portions not particularly described in the embodiment shown in FIG. 23 follow those of the above-described embodiment. In addition, identical reference numerals refer to identical components, and similar reference numerals refer to similar components.

A scan driver 200_4 shown in FIG. 23 represents a modified embodiment of the scan driver 200_1 described with reference to FIG. 10.

Referring to FIGS. 10 and 23, the scan driver 200_4 shown in FIG. 23 may include a plurality of sub-stage circuits LB1_5 to LB4_5. In some embodiments, a circuit configuration of each of the sub-stage circuits LB1_5 to LB4_5 shown in FIG. 23 may be substantially identical or similar to the circuit configuration of each of the first sub-stage circuits ST1_7*a*, ST1_7*b*, ST1_7*c*, ST1_7*d*, ST1_7*e*, and ST1_7*f* described with reference to FIGS. 17 to 22.

In an embodiment, each of the sub-stage circuits LB1_5 to LB4_5 may further include a fifth power input terminal 211. The voltage of the fourth power source BVGL may be applied to fifth power input terminals 211 of the sub-stage circuits LB1_5 to LB4_5.

In an embodiment, a voltage level of the fourth power source BVGL may vary according to a mode of the scan driver 200_4. For example, the fourth power source BVGL may have the same voltage level as the second power source VGL in a first mode of the scan driver 200_4, and have the same voltage level as the first power source VGH in a second mode of the scan driver 200_4.

Accordingly, as described with reference to FIGS. 15 to 22, the scan driver 200_4 shown in FIG. 23 may sequentially output the output signals OUT1 to OUT4 having a pulse of the high level H to the scan lines SL1 to SL4 in the first mode, and sequentially output the output signals OUT1 to OUT4 maintained at the high level H to the scan lines SL1 to SL4 in the second mode.

FIG. 24 is a block diagram illustrating a scan driver (gate driver) in accordance with embodiments of the present disclosure. In FIG. 24, portions different from those of the above-described embodiment will be mainly described to avoid redundancy. Portions not particularly described in the embodiment shown in FIG. 24 follow those of the above-described embodiment. In addition, identical reference numerals refer to identical components, and similar reference numerals refer to similar components.

A scan driver 200_5 shown in FIG. 24 represents a modified embodiment of the scan driver 200_2 described with reference to FIG. 11.

Referring to FIGS. 11 and 24, the scan driver 200_5 shown in FIG. 24 may include a plurality of stages ST1_8 to ST4_8.

In an embodiment, each of the stages ST1_8 to ST4_8 may further include a fifth power input terminal 211. The voltage of the fourth power source BVGL may be applied to fifth power input terminals 211 of the stages ST1_8 to ST4_8.

In an embodiment, a voltage level of the fourth power source BVGL may vary according to a mode of the scan driver 200_5. For example, the fourth power source BVGL may have the same voltage level as the second power source VGL in a first mode of the scan driver 200_5, and have the same voltage level as the first power source VGH in a second mode of the scan driver 200_5.

Accordingly, as described with reference to FIGS. 15 to 22, the scan driver 200_5 shown in FIG. 24 may sequentially output the output signals OUT1 to OUT4 having a pulse of the high level H to first sub-scan lines SL1*a* to SL4*a* in the first mode, and sequentially output the output signals OUT1 to OUT4 maintained at the high level H to the first sub-scan lines SL1*a* to SL4*a* in the second mode.

FIG. 25 is a circuit diagram illustrating an example of a first stage included in the scan driver shown in FIG. 24. In FIG. 25, portions different from those of the above-described embodiment will be mainly described to avoid redundancy. Portions not particularly described in the embodiment shown in FIG. 25 follow those of the above-described embodiment. In addition, identical reference numerals refer to identical components, and similar reference numerals refer to similar components.

Referring to FIGS. 12, 15, 16A, 16B, 24, and 25, a first stage ST1_8 shown in FIG. 25 is substantially identical or similar to the first stage ST1_6 shown in FIG. 12, except that the tenth transistor T10_1 included in a first sub-output unit SST3*a*_1 of the first stage ST1_8 is connected between the (1-1)th sub-output terminal 207*a* and the fifth power input terminal 211, and therefore, overlapping descriptions will not be repeated.

In an embodiment, the first stage ST1_8 may include a first sub-stage circuit LB1_6 and the first charge pump circuit CPB1, and the first sub-stage circuit LB1_6 may include the first driver SST1, the second driver SST2, and an output unit SST3_2.

In an embodiment, the tenth transistor T10_1 included in the first sub-output unit SST3*a*_1 of the output unit SST3_2 may be connected between the first output terminal 207 and the fifth power input terminal 211.

As described with reference to FIG. 24, the first stage ST1_8 may output the (1-1)th sub-output signal OUT1*a* having a pulse of the high level H to the (1-1)th sub-scan line SL1*a* through the (1-1)th sub-output terminal 207*a* in the first mode. More specifically, as described with reference to FIGS. 11 and 12, the first stage ST1_8 may output the (1-1)th sub-output signal OUT1*a* having the pulse of the high level H to the (1-1)th sub-scan line SL1*a* through the (1-1)th sub-output terminal 207*a* in a first driving period of the first mode, and output the (1-1)th sub-output signal OUT1*a* which does not the pulse of the high level and is maintained at the low level to the (1-1)th sub-scan line SL1*a* through the (1-1)th sub-output terminal 207*a* in a second driving period of the first mode.

Also, the first stage ST1_8 may output the (1-1)th sub-output signal OUT1*a* maintained at the high level H to the (1-1)th sub-scan line SL1*a* through the (1-1)th sub-output terminal 207*a* in the second mode.

FIG. 26 is a block diagram illustrating a scan driver (gate driver) in accordance with embodiments of the present disclosure. In FIG. 26, portions different from those of the above-described embodiment will be mainly described to avoid redundancy. Portions not particularly described in the embodiment shown in FIG. 26 follow those of the above-described embodiment. In addition, identical reference numerals refer to identical components, and similar reference numerals refer to similar components.

A scan driver 200_6 shown in FIG. 26 represents a modified embodiment of the scan driver 200 described with reference to FIG. 2.

Referring to FIGS. 2 and 26, the scan driver 200_6 shown in FIG. 26 may include a plurality of stages ST1_9 to ST4_9.

In an embodiment, each of the stages ST1_9 to ST4_9 may further include an eighth input terminal 212. A first charge pump clock signal CP_CLK1 and a second charge pump clock signal CP_CLK2 may be alternately provided to eighth input terminals 212 of the stages ST1_9 to ST4_9.

For example, an eighth input terminal 212 of a kth (k is an integer greater than 0) stage may receive the first charge pump clock signal CP_CLK1, and an eighth input terminal 212 of a (k+1)th stage may receive the second charge pump clock signal CP_CLK2.

In an example, each of eighth input terminals 212 of a first stage ST1_9 and a third stage ST3_9 may receive the first charge pump clock signal CP_CLK1, and each of eighth input terminals 212 of a second stage ST2_9 and a fourth stage ST4_9 may receive the second charge pump clock signal CP_CLK2.

The first charge pump clock signal CP_CLK1 and the second charge pump clock signal CP_CLK2 may have the same cycle, and have waveforms of which phases do not overlap with each other. In an example, the second charge pump clock signal CP_CLK2 may be set as a signal shifted by about a half cycle from the first charge pump clock signal CP_CLK1.

In an embodiment, a first clock signal CLK1_1 and a second clock signal CLK1_2, which are alternately provided to second input terminals 202 and third input terminals 203 of the stages ST1_9 to ST4_9, may have the same cycle and have waveforms of which phases do not overlap with each other in a third driving period (or display scan period). In an example, the second clock signal CLK2_1 may be set as a signal shifted by about a half cycle from the first clock signal CLK1_1. Accordingly, in the third driving period, the stages ST1_9 to ST4_9 may output the output signals OUT1 to OUT4 having a pulse of the high level through the scan lines SL1 to SL4, based on the first and second clock signals CLK1_1 and CLK2_1 provided to the second input terminals 202 and the third input terminals 203. That is, driving of the scan driver 200_6 (or the stages ST1_9 to ST4_9) in the third driving period may be substantially identical or similar to the driving of the scan driver 200 (or the stages ST1 to ST4) described with reference to FIGS. 2 to 4.

In an embodiment, the first clock signal CLK1_1 and the second clock signal CLK2_1, which are alternately provided to the second input terminals 202 and the third input terminals 203 of the stages ST1_9 to ST4_9, may be maintained at a constant level in a fourth driving period (or self-scan period). For example, the first clock signal CLK1_1 and the second clock signal CLK2_1 may be maintained at the high level in the fourth driving period. Based on the first and second clock signals CLK1_1 and CLK2_1 maintained at the high level, the stages ST1_9 to ST4_9 may supply the output signals OUT1 to OUT4 maintained at the gate-off level (e.g., the low level to the scan lines SL1 to SL4 in the fourth driving period.

As described with reference to FIG. 1, the display device 1000 (see FIG. 1) may display an image at various driving frequencies (image refresh rates, or screen refresh rates) according to driving conditions thereof. The display device 1000 (see FIG. 1) (or the scan driver 200_6) maintains the first and second clock signals CLK1_1 and CLK2_1 used to generate a scan signal at the constant level (e.g., the high level) during the self-scan period (i.e., the fourth driving period) in which scan signals (or output signals) are maintained at the gate-off level (or the low level), so that power consumption for changing (or clocking) each of signal levels of the first and second clock signals CLK1_1 and CLK2_1 in a certain cycle can be reduced. This will be described in more detail with reference to FIGS. 27 to 29.

FIG. 27 is a circuit diagram illustrating an example of the first stage included in the scan driver shown in FIG. 26. In FIG. 27, portions different from those of the above-described embodiment will be mainly described to avoid redundancy. Portions not particularly described in the embodiment shown in FIG. 27 follow those of the above-described embodiment. In addition, identical reference numerals refer to identical components, and similar reference numerals refer to similar components.

Referring to FIGS. 3 to 27, the first stage ST1_9 may include the first sub-stage circuit LB1 and a first charge pump circuit CPB1_7. Meanwhile, a configuration and an operation of the first stage ST1_9 shown in FIG. 27 are substantially identical or similar to the configuration and the operation of the first stage ST1 described with reference to FIG. 3, except the first and second clock signals CLK1_1 and CLK2_1 provided to the second input terminal 202 and the third input terminal 203 and a connection configuration of a twelfth transistor T12_2 included in the first charge pump circuit CPB1_7, and therefore, overlapping descriptions will not be repeated.

The first sub-stage circuit LB1 may generate and output the first output signal OUT1 and the first carry signal CR1, based on an input signal (e.g., the start pulse SSP), the first clock signal CLK1_1, the second clock signal CLK2_1, the voltage of the first power source VGH, and the voltage of the second power source VGL.

In an embodiment, the first sub-stage circuit LB1 may output the first output signal OUT1 (or the first scan signal) having a pulse of the high level to the first scan line SL1 through the first output terminal 207, based on the first and second clock signals CLK1_1 and CLK2_1 of which signal levels are changed (or clocked) in a constant cycle in the third driving period.

In an embodiment, the first sub-stage circuit LB1 may output the first output signal OUT1 (or the first scan signal) maintained at the gate-off level (or low level) to the first scan line SL1 through the first output terminal 207, based on the first and second clock signals CLK1_1 and CLK2_1 maintained at a constant level in the fourth driving period.

The first charge pump circuit CPB1_7 may receive the first charge pump clock signal CP_CLK1 through the eighth input terminal 212.

In an embodiment, the first charge pump circuit CPB1_7 may generate a bias voltage Vbias, based on the first charge pump clock signal CP_CLK1, the voltage of the second power source VGL, and the voltage of the third power source VREF, and supply the bias voltage Vbias to the output unit SST3 (or the tenth transistor T10 of the output unit SST3).

To this end, the first charge pump circuit CPB1_7 may include the eleventh to thirteenth transistors T11, T12_2, and T13, the third capacitor C3, and the fourth capacitor C4.

In an embodiment, a first electrode of the twelfth transistor T12_2 may be connected to the eighth input terminal 212.

In an embodiment, the first charge pump circuit CPB1_7 may generate the bias voltage Vbias lower than the voltage level of the second power source VGL by using the voltage of the third power source VREF, which have a voltage level between the first power source VGH and the second power source VGL in a third driving period and a fourth driving period of one frame, and supply the bias voltage Vbias to the back-gate electrode of the tenth transistor T10 included in the output unit SST3.

For example, similarly to as described with reference to FIGS. 2 to 4, when the signal level of the first charge pump clock signal CP_CLK1 is changed from the high level to the low level, the voltage of the third node PPN becomes lower by a difference between the high level and the low level of the first charge pump clock signal CP_CLK1 from the existing voltage level (e.g., the voltage level of the third power source VREF) due to coupling of the third capacitor C3. Accordingly, the voltage of the third node PPN has a voltage level lower than the voltage level of the second power source VGL as the low level. The voltage of the third node PPN, which is lower than the voltage level of the second power source VGL, is supplied as the bias voltage Vbias to the tenth transistor T10 of the output unit SST3 through the thirteenth transistor T13.

FIG. 28 is a timing diagram illustrating an example of driving of the first stage shown in FIG. 27. FIG. 29 is a timing diagram illustrating an example of the driving of the first stage shown in FIG. 27.

Meanwhile, a timing diagram for describing driving of the first stage ST1_9 in a third driving period DSP3 (or display scan period) of one frame is illustrated in FIG. 28, and a timing diagram for describing driving of the first stage ST1_9 in a fourth driving period DSP4 (or self-scan period) of the one frame is illustrated in FIG. 29.

First, the third driving period DSP3 of the one frame will be described with reference to FIGS. 2, 3, 4, and 26 to 28. A waveform diagram of signals shown in FIG. 28 is substantially identical or similar to the waveform diagram of the signals with reference to FIG. 4, and therefore, overlapping descriptions will not be repeated.

The first charge pump clock signal CP_CLK1 and the second charge pump clock signal CP_CLK2 may be supplied at different timings. For example, the second charge pump clock signal CP_CLK2 may be set as a signal shifted by a half cycle (e.g., one horizontal period) from the first charge pump clock signal CP_CLK1.

In an embodiment, the first charge pump clock signal CP_CLK1 may have the substantially same waveform as the second clock signal CLK2_1, and the second charge pump clock signal CP_CLK2 may have the substantially same waveform as the first clock signal CLK1_1.

As described with reference to FIG. 27, in the first stage ST1_9 shown in FIG. 27, the first electrode of the twelfth transistor T12_2 may be connected to the eighth input terminal 212 to which the first charge pump clock signal CP_CLK1 is supplied, as compared with the first stage ST1 described with reference to FIG. 3. As described above, since the first charge pump clock signal CP_CLK1 has the substantially same waveform as the second clock signal CLK2_1 in the third driving period DSP3, the driving and operation of the first stage ST1_9 in the third driving period DSP3 are substantially identical or similar to the driving and operation of the first stage ST1 described with reference to FIGS. 2 to 4.

Next, the fourth driving period DSP4 of the one frame will be described with reference to FIGS. 26, 27, and 29. In the fourth driving period DSP4, the start pulse SSP, the first clock signal CLK1_1, and the second clock signal CLK2_1 may be maintained at the high level H.

For example, the first clock signal CLK1_1 and the second clock signal CLK2_1 may be maintained at the high level H during the fourth driving period DSP4 including a ninth time t9.

Since the first clock signal CLK1_1 and the second clock signal CLK2_1 is maintained at the high level H, the first, third, and fifth transistors T1, T3, and T5 maintain the turn-off state in the fourth driving period DSP4. Therefore, the voltage of the first node Q may be maintained at the high level H, and the voltage of the second node QB may be maintained at the low level L. Accordingly, the voltage of the output node QB_F is maintained at the high level H. Thus, in the fourth driving period DSP4, the ninth transistor T9 may maintain the turn-off state, and the tenth transistor T10 may maintain the turn-on state.

Accordingly, in the fourth driving period DSP4, the first output signal OUT1 (or the first scan signal) output to the first scan line SL1 through the first output terminal 207 is maintained at the gate-off level (or the low level L).

In an embodiment, the first charge pump clock signal CP_CLK1 and the second charge pump clock signal CP_CLK2 in the fourth driving period DSP4 may respective have the same signal waveforms as the first charge pump clock signal CP_CLK1 and the second charge pump clock signal CP_CLK2 in the third driving period DSP3, which are described with reference to FIG. 28. Accordingly, in the fourth driving period DSP4, the first charge pump circuit CPB1_7 generates a bias voltage Vbias lower than the voltage level of the second power source VGL, and cyclically supplies the bias voltage Vbias to the back-gate electrode of the tenth transistor T10 included in the output unit SST3.

FIG. 30 is a block diagram illustrating a scan driver (gate driver) in accordance with embodiments of the present disclosure. In FIG. 30, portions different from those of the above-described embodiment will be mainly described to avoid redundancy. Portions not particularly described in the embodiment shown in FIG. 30 follow those of the above-described embodiment. In addition, identical reference numerals refer to identical components, and similar reference numerals refer to similar components.

A scan driver 200_7 shown in FIG. 30 represents a modified embodiment of the scan driver 200_6 described with reference to FIG. 26.

Referring to FIGS. 26 and 30, the scan driver 200_7 may include a plurality of stages ST1_10 to ST4_10.

In an embodiment, each of the stages ST1_10 to ST4_10 may further include a fifth power input terminal 211. The voltage of the fourth power source BVGL may be applied to fifth power input terminals 211 of the stages ST1_10 to ST4_10.

In an embodiment, a voltage level of the fourth power source BVGL may vary according to a mode of the scan driver 200_7. For example, as described with reference to FIGS. 15, 16A, and 16B, the fourth power source BVGL may have the same voltage level as the second power source VGL in a first mode of the scan driver 200_7, and have the same voltage level as the first power source VGH in a second mode of the scan driver 200_7.

FIG. 31 is a circuit diagram illustrating an example of a first stage included in the scan driver shown in FIG. 30. In FIG. 31, portions different from those of the above-described embodiment will be mainly described to avoid redundancy. Portions not particularly described in the embodiment shown in FIG. 31 follow those of the above-described embodiment. In addition, identical reference numerals refer to identical components, and similar reference numerals refer to similar components.

Referring to FIGS. 15, 16A, 16B, 27, 28, 29, 30, and 31, a first stage ST1_10 shown in FIG. 31 is substantially identical or similar to the first stage ST1_9 shown in FIG. 27, except that the tenth transistor T10_1 included in an output unit SST3_3 of the first stage ST1_10 is connected between the first output terminal 207 and the fifth power input terminal 211, and therefore, overlapping descriptions will not be repeated.

In an embodiment, the first stage ST1_10 may include a first sub-stage circuit LB1_7 and a first charge pump circuit CPB1_8.

In an embodiment, the tenth transistor T10_1 included in the output unit SST3_3 of the first sub-stage circuit LB1_7 may be connected between the first output terminal 207 and the fifth power input terminal 211.

As described with reference to FIGS. 15, 16A, 16B, and 26 to 30, the first stage ST1_10 may output the first output signal OUT1 having a pulse of the high level H to the first scan line SL1 through the first output terminal 207 in the first mode, and output the first output signal OUT1 maintained at the high level H to the first scan line SL1 through the first output terminal 207 in the second mode.

For example, the voltage of the fourth power source BVGL, which has the low level L, is applied to the fifth power input terminal 211 in the first mode, and therefore, an operation of the first stage ST1_10 (or the first sub-stage circuit LB1_7) in the first mode may be substantially identical to the operation of the first stage ST1_9 in the third driving period DSP3, which is described with reference to FIGS. 26 to 28. In an example, in the first mode, the first stage ST1_10 may output the first output signal OUT1 having a pulse of the high level H to the first scan line SL1 through the first output terminal 207.

In another example, in the second mode, the voltage of the fourth power source BVGL, which has the low level L, may be applied to the fifth power input terminal 211. One electrode of the tenth transistor T10_1 which performs a full-down function of the output unit SST3_3 is connected to the fifth power input terminal 211, and therefore, a voltage of a node to which the first output terminal 207 is connected may be maintained at the high level H in the second mode. Accordingly, in the second mode, the voltage level of the first output signal OUT1 output to the first scan line SL1 through the first output terminal 207 may be maintained at the high level H.

In accordance with the present disclosure, the scan driver includes a plurality of stages, and each of the stages includes a sub-stage circuit for generating a scan signal and a charge pump circuit for supplying a bias voltage to the sub-stage circuit. The charge pump circuit generates the bias voltage lower than a voltage level of a second power source by using a third power source having a voltage level between a voltage of a first power source and a voltage of the second power source. Accordingly, power consumption can be reduced.

Also, in accordance with the present disclosure, in a fourth driving period (or self-scan period) in which scan signals are output at a gate-off level during one frame period, clock signals are maintained at a constant signal level. Accordingly, power consumption for changing each of signal levels of the clock signals in a certain cycle can be reduced.

While the present disclosure has been described with reference to embodiments thereof, it will be apparent to those of ordinary skill in the art that various changes and modifications may be made thereto without departing from the scope and spirit of the present disclosure as set forth in the following claims.

What is claimed is:

1. A scan driver comprising:

a plurality of stages configured to supply scan signals to scan lines, wherein a first stage among the stages includes:

a first sub-stage circuit configured to generate a first scan signal, based on an input signal, a first clock signal, a second clock signal, a first power source, and a second power source; and a first charge pump circuit configured to supply a bias voltage to the first sub-stage circuit, based on a third power source, and wherein the first sub-stage circuit includes:

a first driver configured to control voltages of a first node and a second node, based on the input signal, the first clock signal, the second clock signal, the first power source, and the second power source;

a second driver configured to control a voltage of an output node, based on the voltage of the first node, the voltage of the second node, the first power source, and the second power source; and an output unit configured to output the first scan signal through a first output terminal, based on the voltage of the output node, the first power source, and the second power source.

2. The scan driver of claim 1, wherein the output unit includes an n-type transistor and a p-type transistor, and wherein the first charge pump circuit supplies the bias voltage to a back-gate electrode of the n-type transistor included in the output unit.

3. The scan driver of claim 1, wherein a voltage level of the third power source is lower than a voltage level of the first power source and is higher than a voltage level of the second power source, and wherein a voltage level of the bias voltage is lower than the voltage level of the second power source.

4. The scan driver of claim 1, wherein the first driver includes:

a first transistor connected between a first input terminal to which the input signal is supplied and an input node, the first transistor including a gate electrode connected to a second input terminal to which the first clock signal is supplied;

a second transistor including a first electrode connected to a first power input terminal to which a voltage of the first power source is supplied and a gate electrode connected to the second node;

a third transistor connected between a second electrode of the second transistor and the input node, the third transistor including a gate electrode connected to a third input terminal to which the second clock signal is supplied;

a fourth transistor connected between the second node and the second input terminal, the fourth transistor including a gate electrode connected to the input node;

a fifth transistor connected between the second node and a second power input terminal to which a voltage of the second power source is supplied, the fifth transistor including a gate electrode connected to the second input terminal; and a sixth transistor connected between the input node and the first node, the sixth transistor including a gate electrode connected to the second power input terminal.

5. The scan driver of claim 4, wherein the first driver further includes a first capacitor connected between the first power input terminal and the second node.

6. The scan driver of claim 1, wherein the second driver includes:

a seventh transistor connected between a first power input terminal to which a voltage of the first power source is supplied and the output node, the seventh transistor including a gate electrode connected to the second node; and an eighth transistor connected between the output node and a third input terminal to which the second clock signal is supplied, the eighth transistor including a gate electrode connected to the first node.

7. The scan driver of claim 6, wherein the second driver further includes a second capacitor connected between the output node and the first node.

8. The scan driver of claim 1, wherein the output unit includes:

a ninth transistor connected between a first power input terminal to which a voltage of the first power source is supplied and the first output terminal, the ninth transistor including a gate electrode connected to the output node; and a tenth transistor connected between the first output terminal and a second power input terminal to which a voltage of the second power source is supplied, the tenth transistor including a gate electrode connected to the output node.

9. The scan driver of claim 8, wherein the ninth transistor is a p-type transistor, and the tenth transistor is an n-type transistor.

10. The scan driver of claim 1, wherein the first charge pump circuit includes:

an eleventh transistor connected between a third power input terminal to which a voltage of the third power source is supplied and a third node, the eleventh transistor including a gate electrode connected to the third power input terminal;

a twelfth transistor including a first electrode connected to a third input terminal to which the second clock signal is supplied and a gate electrode connected to the third node;

a third capacitor connected between a second electrode of the twelfth transistor and the third node;

a fourth capacitor including a first electrode connected to any one of a first power input terminal to which a voltage of the first power source is supplied, a second power input terminal to which a voltage of the second power source is supplied, and the third power input terminal; and a thirteenth transistor connected between a second electrode of the fourth capacitor and the third node, the thirteenth transistor including a gate electrode connected to the third node.

11. The scan driver of claim 1, wherein the first charge pump circuit includes:

a fourteenth transistor including a first electrode connected to a third power input terminal to which a voltage of the third power source is supplied and a gate electrode connected to a second input terminal to which the first clock signal is supplied;

an eleventh transistor connected between a second electrode of the fourteenth transistor and a third node, the eleventh transistor including a gate electrode connected to a second power input terminal to which a voltage of the second power source is supplied;

a twelfth transistor including a first electrode connected to a third input terminal to which the second clock signal is supplied and a gate electrode connected to the third node; and a third capacitor connected between a second electrode of the twelfth transistor and the third node.

12. The scan driver of claim 11, wherein the first charge pump circuit further includes:

a fourth capacitor including a first electrode connected to any one of a first power input terminal to which a voltage of the first power source is supplied, the second power input terminal, and the third power input terminal; and a thirteenth transistor connected between a second electrode of the fourth capacitor and the third node, the thirteenth transistor including a gate electrode connected to the third node.

13. The scan driver of claim 12, wherein the bias voltage corresponds to a voltage of a node to which the second electrode of the fourth capacitor is connected.

14. The scan driver of claim 11, wherein the first charge pump circuit further includes:

a fourth capacitor including a first electrode connected to any one of a first power input terminal to which a voltage of the first power source is supplied, the second power input terminal, and the third power input terminal;

a thirteenth transistor including a first electrode connected to a second electrode of the fourth transistor, a second electrode, and a gate electrode; and a fifteenth transistor connected between a node to which the second electrode and the gate electrode of the thirteenth transistor are connected and the third node, the fifteenth transistor including a gate electrode connected to the third node.

15. A scan driver comprising:

a plurality of sub-stage circuits configured to supply scan signals to scan lines and a plurality of charge pump circuits configured to generate a bias voltage, wherein each of the sub-stage circuits includes:

a first driver configured to control voltages of a first node and a second node, based on an input signal, a first clock signal, a second clock signal, a first power source, and a second power source;

a second driver configured to control a voltage of an output node, based on the voltage of the first node, the voltage of the second node, the first power source, and the second power source; and an output unit configured to output a scan signal through an output terminal, based on the voltage of the output node, the first power source, and the second power source, and wherein a first sub-stage circuit configured to generate a first scan signal as the scan signal and a second sub-stage circuit configured to generate a second scan signal as the scan signal among the sub-stage circuits are commonly connected to a first charge pump circuit among the charge pump circuits.

16. The scan driver of claim 15, wherein the first charge pump circuit supplies the bias voltage to each of the output unit included in the first sub-stage circuit and the output unit included in the second sub-stage circuit.

17. A scan driver comprising:

a plurality of stages configured to supply first sub-scan signals to first sub-scan lines, and supply second sub-scan signal to second sub-scan lines, wherein a first stage among the stages includes:

a first sub-stage circuit configured to generate a (1-1)th sub-scan signal and a (2-1)th sub-scan signal, based on an input signal, a first clock signal, a second clock signal, a fourth clock signal, a first power source, and a second power source; and a first charge pump circuit configured to supply a bias voltage to the first sub-stage circuit, based on a third power source, wherein the first sub-stage circuit includes:

a first driver configured to control voltages of a first node and a second node, based on the input signal, the first clock signal, the second clock signal, the first power source, and the second power source;

a second driver configured to control a voltage of an output node, based on the voltage of the first node, the voltage of the second node, the first power source, and the fourth clock signal;

a first sub-output unit configured to output the (1-1)th sub-scan signal through a (1-1)th sub-output terminal, based on the voltage of the output node, the first power source, and the second power source; and a second sub-output unit configured to output the (2-1)th sub-scan signal through a (2-1)th sub-output terminal, based on the voltage of the first node, the voltage of the second node, the first power source, and the second clock signal, and wherein the (1-1)th sub-scan signal has a pulse of a high level, and the (2-1)th sub-scan signal has a pulse of a low level.

18. The scan driver of claim 17, wherein the first sub-output unit includes:

a ninth transistor connected between a first power input terminal to which a voltage of the first power source is supplied and the (1-1)th sub-output terminal, the ninth transistor including a gate electrode connected to the output node; and a tenth transistor connected between the (1-1)th sub-output terminal and a fifth input terminal to which the fourth clock signal is supplied, the tenth transistor including a gate electrode connected to the output node, and wherein the ninth transistor is a p-type transistor, and the tenth transistor is an n-type transistor.

19. The scan driver of claim 18, wherein the second sub-output unit includes:

a sixteenth transistor connected between the first power input terminal and the (2-1)th sub-output terminal, the sixteenth transistor including a gate electrode connected to the second node; and a seventeenth transistor connected between a third input terminal to which the second clock signal is supplied and the (2-1)th sub-output terminal, the seventeenth transistor including a gate electrode connected to the first node.

20. The scan driver of claim 17, wherein the first stage among the stages receives the fourth clock signal, and a second stage among the stages receives a third clock signal, and wherein the fourth clock signal is a signal shifted from the third clock signal.

* * * * *